US007154816B2

(12) United States Patent
Igarashi et al.

(10) Patent No.: US 7,154,816 B2
(45) Date of Patent: Dec. 26, 2006

(54) ELECTRONIC WATCH AND ELECTRONIC WATCH CONTROL METHOD

(75) Inventors: Kiyotaka Igarashi, Tokyo (JP); Kenji Shimoda, Tokyo (JP); Masahiro Sase, Fussa (JP)

(73) Assignee: Citizen Watch Co., Ltd., Tokyo (JP)

( * ) Notice: Subject to any disclaimer, the term of this patent is extended or adjusted under 35 U.S.C. 154(b) by 323 days.

(21) Appl. No.: 10/343,637

(22) PCT Filed: Sep. 25, 2001

(86) PCT No.: PCT/JP01/08293

§ 371 (c)(1),
(2), (4) Date: Feb. 3, 2003

(87) PCT Pub. No.: WO02/27414

PCT Pub. Date: Apr. 4, 2002

(65) Prior Publication Data

US 2004/0100870 A1 May 27, 2004

(30) Foreign Application Priority Data

Sep. 27, 2000 (JP) ..... 2000-294443
Nov. 9, 2000 (JP) ..... 2000-342237

(51) Int. Cl.
*G04B 9/00* (2006.01)

(52) U.S. Cl. ..... 368/66; 368/204

(58) Field of Classification Search ..... 368/64, 368/66, 203, 204, 80, 205
See application file for complete search history.

(56) References Cited

U.S. PATENT DOCUMENTS 4,690,568 A * 9/1987 Odagiri et al. ..... 368/204
5,446,702 A * 8/1995 Mossuz et al. ..... 368/37
5,889,736 A 3/1999 Fujita et al.
5,940,348 A 8/1999 Murakami et al.
5,943,301 A * 8/1999 Igarashi ..... 368/204
6,122,226 A * 9/2000 Murakami et al. ..... 368/80
6,140,863 A * 10/2000 Fujisawa ..... 327/540
6,144,621 A * 11/2000 Sase ..... 368/204
6,424,600 B1 7/2002 Okeya et al.
6,483,781 B1 * 11/2002 Igarashi et al. ..... 368/66
6,580,665 B1 6/2003 Kamiyama et al.
2001/0043513 A1 * 11/2001 Grupp ..... 368/281

FOREIGN PATENT DOCUMENTS

| | | |
|---|---|---|
| EP | 0 657 793 | 6/1995 |
| EP | 0 766 150 | 4/1997 |
| EP | 0 823 677 | 2/1998 |
| EP | 0 860 757 | 8/1998 |
| EP | 0 982 637 | 3/2000 |
| EP | 1 006 640 | 6/2000 |
| EP | 1 026 559 | 8/2000 |
| JP | 56-36080 | 4/1981 |

(Continued)

*Primary Examiner*—Ren Yan
*Assistant Examiner*—Leo T. Hinze
(74) *Attorney, Agent, or Firm*—Smith, Gambrell & Russell, LLP

(57) ABSTRACT

An electronic timepiece (10) comprises time information generating unit (A) for generating time information, information generating unit for generating information (function information, warning information, etc.) other than the time information, and power-saving operation unit (D) for operating the electronic timepiece in a power-saving operation state entailing lower power consumption than in a normal operation state. The information generating unit or the power-saving operation unit (D) is operated preferentially.

31 Claims, 35 Drawing Sheets

FOREIGN PATENT DOCUMENTS

| | | |
|---|---|---|
| JP | 1-27112 | 8/1989 |
| JP | 1-43667 | 12/1989 |
| JP | 9-90066 | 4/1997 |
| JP | 2000-180566 | 6/2000 |
| JP | 2000-180567 | 6/2000 |

* cited by examiner

ELECTRONIC WATCH AND ELECTRONIC WATCH CONTROL METHOD

REFERENCE TO CROSS-RELATED APPLICATION

This application is a U.S. National Stage application of PCT/JP01/08293, that was filed Sep. 25, 2001, in which the content is included in its entirety herein.

TECHNICAL FIELD

The present invention relates to an electronic timepiece having a function for generating function information and warning information besides watch information and a control method for the electronic timepiece.

BACKGROUND ART

Among modern electronic timepieces, electronic timepieces that have therein systems for displaying a plurality of kinds of functions, including a chronographic display function, alarm display function, atmospheric pressure display function, sounding display function, temperature display function, etc. have started to be put to practical use, and are configured so that one or a plurality of kinds of function information is displayed simultaneously with or alternatively to time information on specific display means.

Conventionally, on the other hand, some known electronic timepieces additionally have a power-saving mode function that serves to lower the power consumption of the electronic timepiece unless it constitutes any special hindrance to the use of the electronic timepiece, in order to maximize the durability of power source means that is composed of a battery or an accumulator used in combination with power generating means.

As is described in Japanese Patent Application Laid-Open No. 61-77788, for example, an electronic timepiece is known that has a solar cell as its main power source and is constructed so that a power-saving mode is established to lower its power consumption if the sunlight is not incident upon a solar cell of the electronic timepiece for a predetermined fixed continuous time, and that the power-saving mode is canceled when the sunlight is incident again upon the solar cell.

The power-saving mode function of this conventional electronic timepiece is designed so that the power-saving mode is established to stop the display of time information if the power source is in an unfavorable situation or if the solar cell as the power source is used in the dark, for example.

Although both the power-saving mode function and the function information operation state mode serve to improve the commercial value of the electronic timepiece, they may possibly interfere with each other, so that the drive of the respective operations of the two functions requires adjustment.

If the display function for function information is activated when the environment of power generation or the level of charge is lowered, for example, the battery is consumed by power that is required by the display of the function information, so that the original time display function of the electronic timepiece may possibly be stopped.

Further, some known rechargeable electronic timepieces are designed so that information on the state of the power source of the watch and the past history of stoppage can be given to a user of the watch and that trouble caused as the watch run-down due to undercharge can be avoided to the utmost. Described in Japanese Patent Application Laid-Open No. 62-194484, for example, is an electronic timepiece, in which normal operation (one-second-step movement) is performed if the charge level (supply voltage) of the power source is adequate, first modulated hand movement operation (two-second-step movement) as a charge warning is performed if the charge level is about to fail, and second modulated hand movement operation as a run-down state warning, modulated differently from the first modulated hand movement operation, is performed to warn the user of the past history of a run-down state (and therefore, wrongness of indicated time) despite later recovery of the charge level and restart of the hand movement if the charge level is so low that the watch is stopped, whereby two types of warning display are performed. Also known is an electronic timepiece that performs residue warning information display such that the residual capacity (residue) of a battery is indicated by the movement of a pointer. Described in Japanese Patent Application Laid-Open No. 55-22153, for example, is an electronic timepiece that displays residue warning information in accordance with the movement of a pointer in a residue warning display monitor mode based on switch operation.

If the hand movement operation is stopped so that the display is stopped in a power-saving state, warning information also ceases to be displayed, so that the electronic timepiece inevitably cannot fulfill its function, as in the case of the aforementioned invention described in Japanese Patent Application Laid-Open No. 61-77788. The warning information, in particular, is information that is related to the state of the power source, and is generated when the supply voltage is lowered if accumulator means is undercharged by power generating means. The same applies to the aforementioned residue warning display of Japanese Patent Application Laid-Open No. 55-22153. Further, the power-saving function, especially in a rechargeable electronic timepiece, is a function that is required when the accumulator means is undercharged. The warning display is needed with high possibility in a state that requires power-saving operation.

Accordingly, a first object of the present invention is to provide an electronic timepiece having both of functions for function display operation and power-saving operation and a driving method for the electronic timepiece, and to provide an electronic timepiece with high commercial value, which is configured to be able to use separately a power-saving mode function that entails lower power consumption and a function information operation state mode that provides many kinds of additional function information, and a driving method for the electronic timepiece.

Further, a second object of the present invention is to provide an electronic timepiece, in which display of a power-saving state and warning information is optimally controlled so that the electronic timepiece can fulfill its function, and a control method therefor.

DISCLOSURE OF THE INVENTION

A first form of an electronic timepiece according to the present invention comprises time information generating unit for generating time information, information generating unit for generating information (e.g., function information, warning information, etc.) other than the time information, display unit capable of alternatively displaying the time information and/or the other information, power-saving operation unit for operating the electronic timepiece in a power-saving operation state entailing lower power consumption than in a normal operation state, and preferential operation selecting unit for preferentially operating the information generating unit or the power-saving operation unit according to circumstances. The individual unit are driven by a power source unit.

Accumulator unit such as a primary battery or a secondary battery or power generating unit and accumulator unit to be charged by the power generating unit can be used as the power source unit.

Further, a second form of the electronic timepiece according to the present invention comprises time information generating unit for generating time information, function information generating unit for generating function information, warning information generating unit for generating warning information for prompting a predetermined warning, display unit capable of alternatively displaying the time information and/or the function information and/or the warning information, power-saving operation unit for operating the electronic timepiece in a power-saving operation state entailing lower power consumption than in a normal operation state, and preferential operation selecting unit for preferentially operating the function information generating unit and/or the warning information generating unit or the power-saving operation unit according to circumstances. The individual unit are driven by a power source unit.

The electronic timepiece according to the present invention can have the following form.

In a situation where the preferential operation selecting unit causes the function information generating unit or the warning information generating unit to operate with priority over the power-saving operation unit, the warning information generating unit is further operated with priority over the function information generating unit.

The electronic timepiece further comprises residual capacity detecting unit for detecting the residual capacity of the accumulator unit, and the preferential operation selecting unit, based on residual capacity detection information from the residual capacity detecting unit, causes the information generating unit to operate with priority over the power-saving operation unit if the detected residual capacity is not lower than a predetermined value and, on the other hand, causes the power-saving operation unit to operate with priority over the information generating unit if the detected residual capacity is lower than the predetermined value.

The electronic timepiece further comprises power generation detecting unit for detecting the power generating state of the power generating unit, and the preferential operation selecting unit, based on power generation detection information from the power generation detecting unit, causes the information generating unit to operate with priority over the power-saving operation unit if the detected power generating state is not lower than a predetermined power generation level and, on the other hand, causes the power-saving operation unit to operate with priority over the information generating unit if the detected power generating state is lower than the predetermined power generation level.

The electronic timepiece further comprises residual capacity detecting unit for detecting the residual capacity of the accumulator unit and power generation detecting unit for detecting the power generating state of the power generating unit, and the preferential operation selecting unit, based on residual capacity detection information from the residual capacity detecting unit and power generation detection information from the power generation detecting unit, causes the information generating unit to operate with priority over the power-saving operation unit if the detected residual capacity is not lower than a predetermined value and also if the detected power generating state is not lower than a predetermined power generation level and, on the other hand, causes the power-saving operation unit to operate with priority over the information generating unit if the detected residual capacity is lower than the predetermined value or if the detected power generating state is lower than the predetermined power generation level.

The electronic timepiece further comprises residual capacity detecting unit for detecting the residual capacity of the accumulator unit and power generation detecting unit for detecting the power generating state of the power generating unit, and the preferential operation selecting unit, based on residual capacity detection information from the residual capacity detecting unit and power generation detection information from the power generation detecting unit, causes the information generating unit to operate with priority over the power-saving operation unit if the detected residual capacity is not lower than a predetermined value or if the detected power generating state is not lower than a predetermined power generation level and, on the other hand, causes the power-saving operation unit to operate with priority over the information generating unit if the detected residual capacity is lower than the predetermined value and also if the detected power generating state is lower than the predetermined power generation level.

The residual capacity detecting unit detects the output voltage or output current of the accumulator unit.

The power generation detecting unit detects the quantity of generated electricity, power generation voltage, or power generation current of the power generating unit.

The display of warning information by the warning information generating unit is given priority over the operation of the function information generating unit and the operation of the power-saving unit.

The display of warning information by the warning information generating unit is given priority over the operation of the function information generating unit and the operation of the power-saving unit.

The function information generating unit or the power-saving unit is not operated even if conditions for the operation of the function information generating unit or the power-saving unit are met during the display of the warning information.

The operation of the function information generating unit or the operation of the power-saving unit is stopped and the warning information generating unit is operated to display the warning information if conditions for the operation of the warning information generating unit are met during the operation of the function information generating unit or the operation of the power-saving unit.

Display unit for displaying the function of the function information generating unit when the same is operated or display unit for stopping the display when the power-saving unit is operated and display unit for displaying the warning information when the warning information generating unit is operated are configured to be duplicate at least partially.

The warning information is time adjustment warning information for warning of wrong time indication when the electronic timepiece temporarily undercharged and stopped is restarted by recharge, charge warning information as a warning for prompting charge, or residue warning information as a residue warning for the accumulator unit.

At least a part of the display unit is composed of a digital display system or an analog display system.

A power source for driving each unit of the electronic timepiece is selected from power generating unit including a solar cell, windup generator, self-winding generator, and temperature-difference generator, or a combination of the power generating unit and accumulator unit such as a secondary battery or a high-capacity condenser.

The electronic timepiece further comprises selecting unit for causing the preferential operation selecting unit to select the preferential operation, the selecting unit being adapted to cause the preferential operation selecting unit to select the preferential operation at the request of a user.

A first form of a control method for an electronic timepiece according to the present invention is a control method for an electronic timepiece comprising time information generating unit for generating time information, warning information generating unit for generating warning information for prompting a predetermined warning, function information generating unit for generating function information, display unit capable of alternatively displaying the time information and/or the function information and/or the warning information, power-saving operation unit for operating the electronic timepiece in a power-saving operation state entailing lower power consumption than in a normal operation state, and a power source unit for driving the individual unit. The method is characterized in that the function information generating unit and/or the warning information generating unit or the power-saving unit is caused to perform the preferential operation according to circumstances.

The warning information generating unit may be configured further to be operated with priority over the function information generating unit in a situation where the preferential operation selecting unit causes the function information generating unit or the warning information generating unit to operate with priority over the power-saving operation unit.

The preferential operation may be selected in accordance with the output voltage and/or output current of the power source unit.

The preferential operation may be selected at the request of a user.

A second form of the control method for an electronic timepiece according to the present invention is a control method for an electronic timepiece comprising reference signal generating unit, general information generating unit for generating general information such as time information or function information in response to a reference signal from the reference signal generating unit, warning information generating unit for generating warning information for prompting a predetermined warning, display drive unit for outputting a drive signal for displaying the warning information and the general information, and display unit for displaying the general information and the warning information in response to the drive signal from the display drive unit, and can assume a power-saving state entailing lower power consumption than in a normal operation state. The method is characterized in that the display of the warning information based on the operation of the warning information generating unit is given priority over the operation of the power-saving operation unit.

A third form of the control method for an electronic timepiece according to the present invention is a control method for an electronic timepiece comprising reference signal generating unit, general information generating unit for generating general information such as time information or function information in response to a reference signal from the reference signal generating unit, warning information generating unit for generating warning information for prompting a predetermined warning, display drive unit for outputting a drive signal for displaying the warning information and the general information, and display unit for displaying the general information and the warning information in response to the drive signal from the display drive unit, and can assume a power-saving state entailing lower power consumption than in a normal operation state. The method is characterized in that the power-saving state is not established even if conditions for the establishment of the power-saving state are met during the display of the warning information by the warning information generating unit.

A fourth form of the control method for an electronic timepiece according to the present invention is a control method for an electronic timepiece comprising reference signal generating unit, general information generating unit for generating general information such as time information or function information in response to a reference signal from the reference signal generating unit, warning information generating unit for generating warning information for prompting a predetermined warning, display drive unit for outputting a drive signal for displaying the warning information and the general information, and display unit for displaying the general information and the warning information in response to the drive signal from the display drive unit, and can assume a power-saving state entailing lower power consumption than in a normal operation state. The power-saving state is canceled to establish a display state for the warning information if conditions for the operation of the warning information generating unit are met during the power-saving state.

BEST MODE FOR CARRYING OUT THE INVENTION

A first embodiment of the present invention will be described with reference to FIGS. 1 to 29.

In this embodiment, an electronic timepiece comprises power-saving means, function information generating means, and preferential operation selecting means for selecting one of these means and urging it to perform preferential operation. When the preferential operation selecting means selects the power-saving operation means, it causes the power-saving operation means to perform preferential operation to establish a power-saving operation state without operating the function information generating means if conditions for power-saving operation are met. When the preferential operation selecting means selects the function information generating means, on the other hand, it causes the function information generating means to operate, and displays function information on display means, taking preference over the power-saving operation state, even if the conditions for the operation of the power-saving operation means are met.

Figure 1:
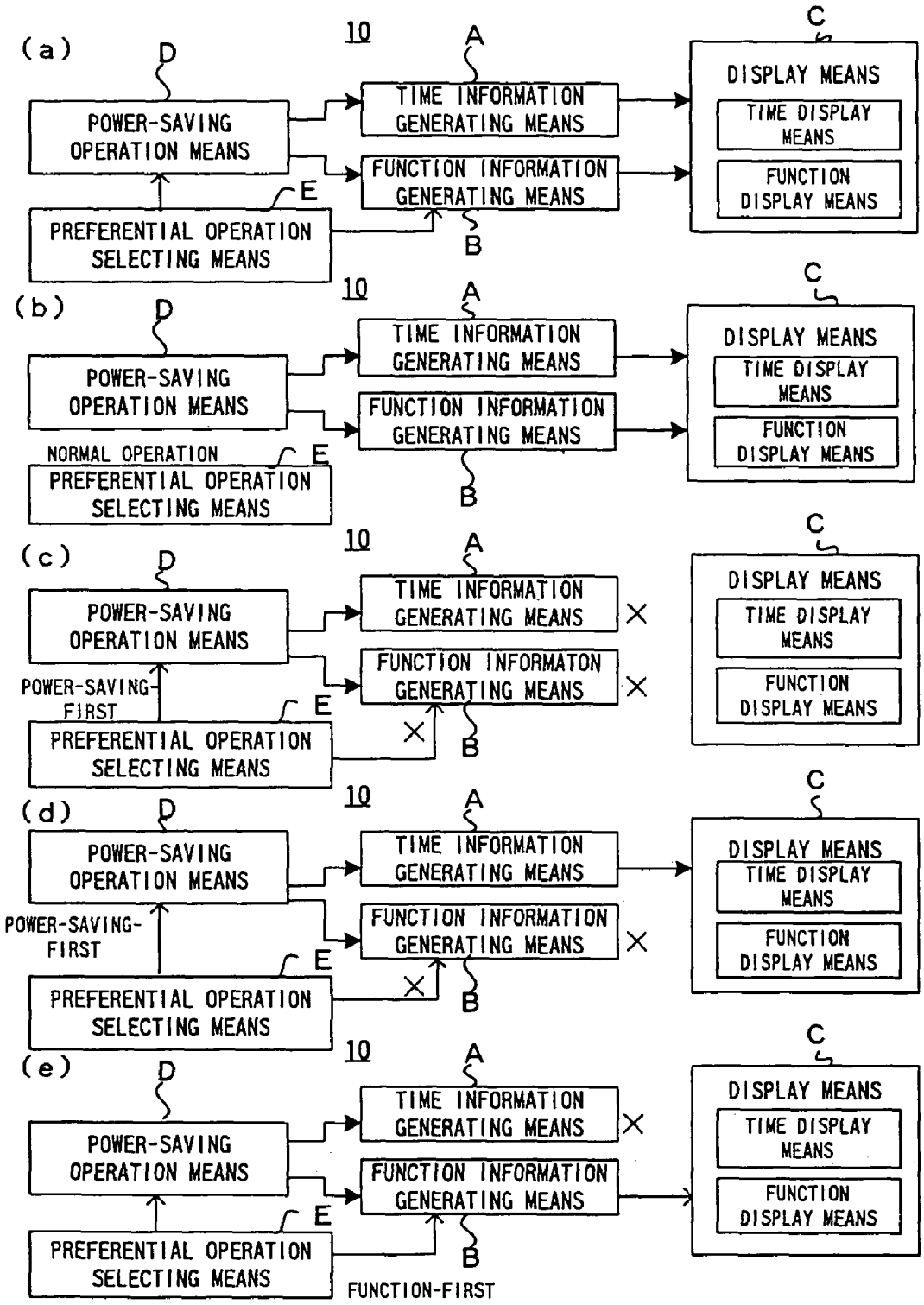
FIG. 1 is a diagram for illustrating a first operation example of a first embodiment of an electronic timepiece according to the present invention.
Figure 2:
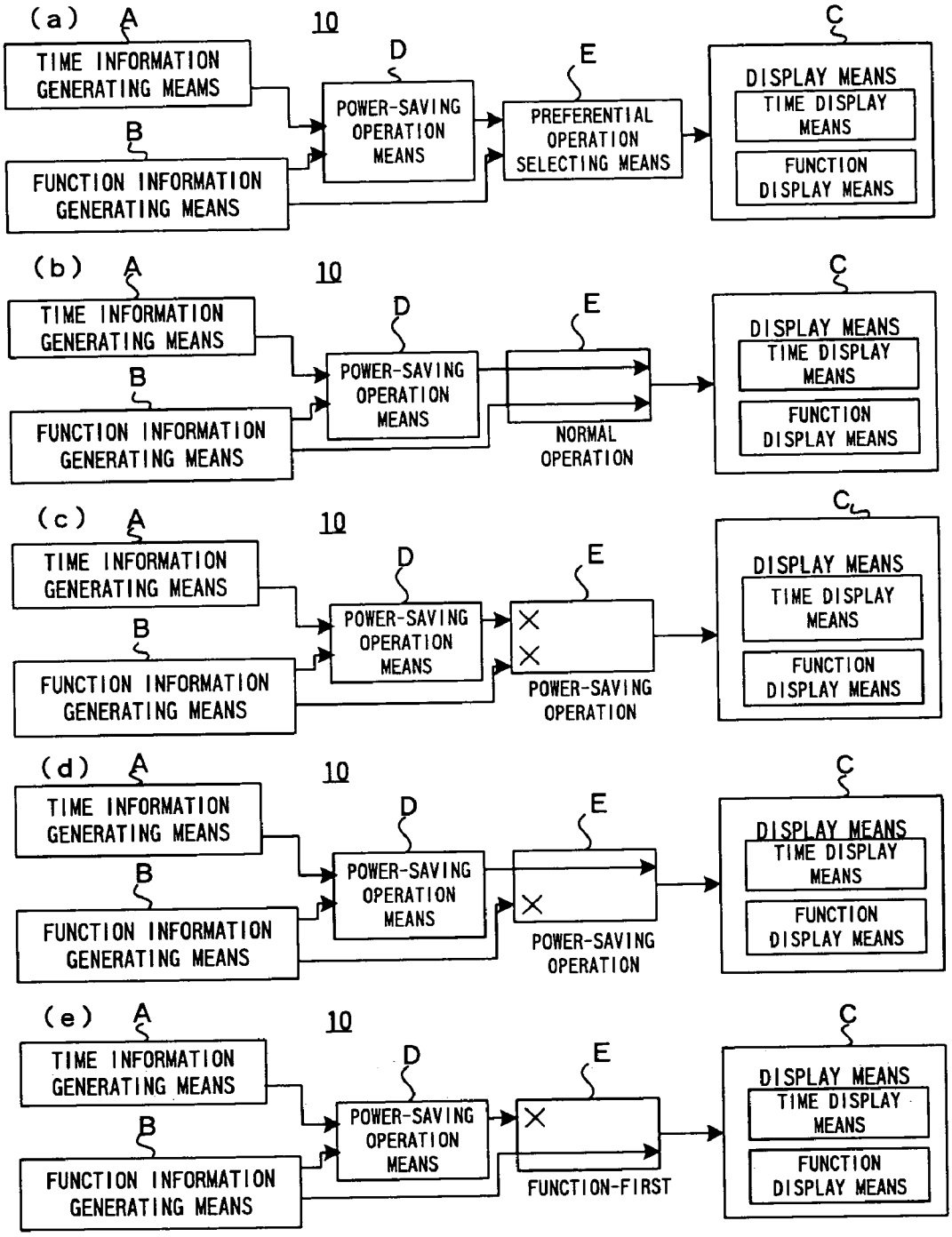
FIG. 2 is a diagram for illustrating a second operation example of the first embodiment of the electronic timepiece according to the present invention.

FIGS. 1 and 2 are diagrams for illustrating the operation of the present embodiment, in which FIG. 1 shows a first example, and FIG. 2 shows a second example.

In the first example, the power-saving operation state or a functional operation state is given priority by selecting and actuating any one of the power-saving operation means and the function information generating means by the preferential operation selecting means. In the second example, the power-saving operation state or the functional operation state is given priority by controlling the drive of the power-saving operation means by the preferential operation selecting means to activate the power-saving operation state or inactivate the power-saving operation, thereby enabling the functional operation.

The first example will be described first.

In FIG. 1(*a*), an electronic timepiece 10 comprises time information generating means A for generating time information, function information generating means B for generating function information, display means C capable of alternatively displaying the time information and the function information, power-saving operation means D for operation in the power-saving operation state that entails lower power consumption than a normal operation state, and preferential operation selecting means E for giving priority to any one of the function information generating means B and the power-saving operation means D.

In the normal operation state, as shown in FIG. 1(*b*), the preferential operation selecting means E does not give priority to any of the means B and D, and the display means C continually displays the time information and selectively displays the function information.

If the power-saving operation state is established in the normal operation state or in a state where the power-saving operation means D is given priority by the preferential operation selecting means E, as shown in FIG. 1(*c*), on the other hand, the power-saving operation means D gives priority to the power-saving operation over function information display operation, and stops the display of the time information and the function information. Depending on the conditions for the power-saving operation, the display of the function information can be stopped with a part of the time information displayed, as shown in FIG. 1(*d*). In display stop operation for the time information and/or the function information, moreover, counting the time information and the function information can be continued.

If the function information generating means B is given priority by the preferential operation selecting means E, as shown in FIG. 1(*e*), furthermore, the function information is displayed without regard to the performance of the power-saving operation.

Next, the second example will be described.

In FIG. 2(*a*), an electronic timepiece 10 comprises time information generating means A for generating time information, function information generating means B for generating function information, display means C capable of alternatively displaying the time information and the function information, power-saving operation means D for operation in the power-saving operation state that entails lower power consumption than a normal operation state, and preferential operation selecting means E for controlling the power-saving operation means D to give priority to the power-saving operation or the functional operation.

In the normal operation state, the preferential operation selecting means E does not give priority any of the power-saving and functional operations, the power-saving operation means D does not function, and the display means C continually displays the time information and selectively displays the function information, as shown in FIG. 2(*b*). If the power-saving operation state is established in the normal operation state or in a state where the power-saving operation means D is given priority by the preferential operation selecting means E, as shown in FIG. 2(*c*), on the other hand, the power-saving operation means D gives priority to the power-saving operation over function information display operation, and stops the display of the time information and the function information. Depending on the conditions for the power-saving operation, the display of the function information can be stopped with the time information displayed, as shown in FIG. 2(*d*). In display stop operation for the time information and/or the function information, moreover, counting the time information and the function information can be continued.

If the functional operation is given priority by the preferential operation selecting means E, as shown in FIG. 2(*e*), furthermore, the function information is displayed without regard to the performance of the power-saving operation.

Thus, in the present embodiment, the electronic timepiece is provided with both a function to make the consumption period of a battery as long as possible by driving as many power-savable parts as possible in a power-saving mode and an additional function for improving the commercial value of the electronic timepiece, and is designed so that the power-saving operation state and the functional operation state can be alternatively selected according to the power supply condition of the electronic timepiece or a user's request. If the power-saving operation is esteemed, the power-saving operation state is given priority over the function display operation state. If the functional operation is esteemed, the function display operation state is given priority over the power-saving operation state.

Objective parts to be brought to the power-saving operation state are parts that require the establishment of the power-saving operation state or the function display operation state, depending on various environments such as the working conditions and the purpose of use of the electronic timepiece. These objective parts include display means, such as hour, minute, and second hands or a liquid crystal notation device, and all or some of associated circuit elements for controlling them. Those circuit elements include, for example, drive circuit elements of various display means.

The display means of the electronic timepiece of the present embodiment may include all or some of display means that belong to the electronic timepiece and can include display means associated with function display. Those display means which are not associated with function display can be constructed in a manner such that the power-saving mode is started when the quantity of electricity generated by power generating means is lowered, without regard to the performance of the function display operation.

An example of configuration of the electronic timepiece of the present embodiment and a driving method for the electronic timepiece will now be described in detail with reference to the drawings.

In the description of the configuration example to follow, the display means (hour, minute, and second hands, functional hand, or liquid crystal display) is used as an object for which the power-saving operation state or the functional operation state is realized. It is to be understood, however, that this display means is nothing but an example according to the present embodiment, and is included in the present embodiment only if it is a circuit element that can realize the power-saving operation state or the functional operation state.

Figure 3:
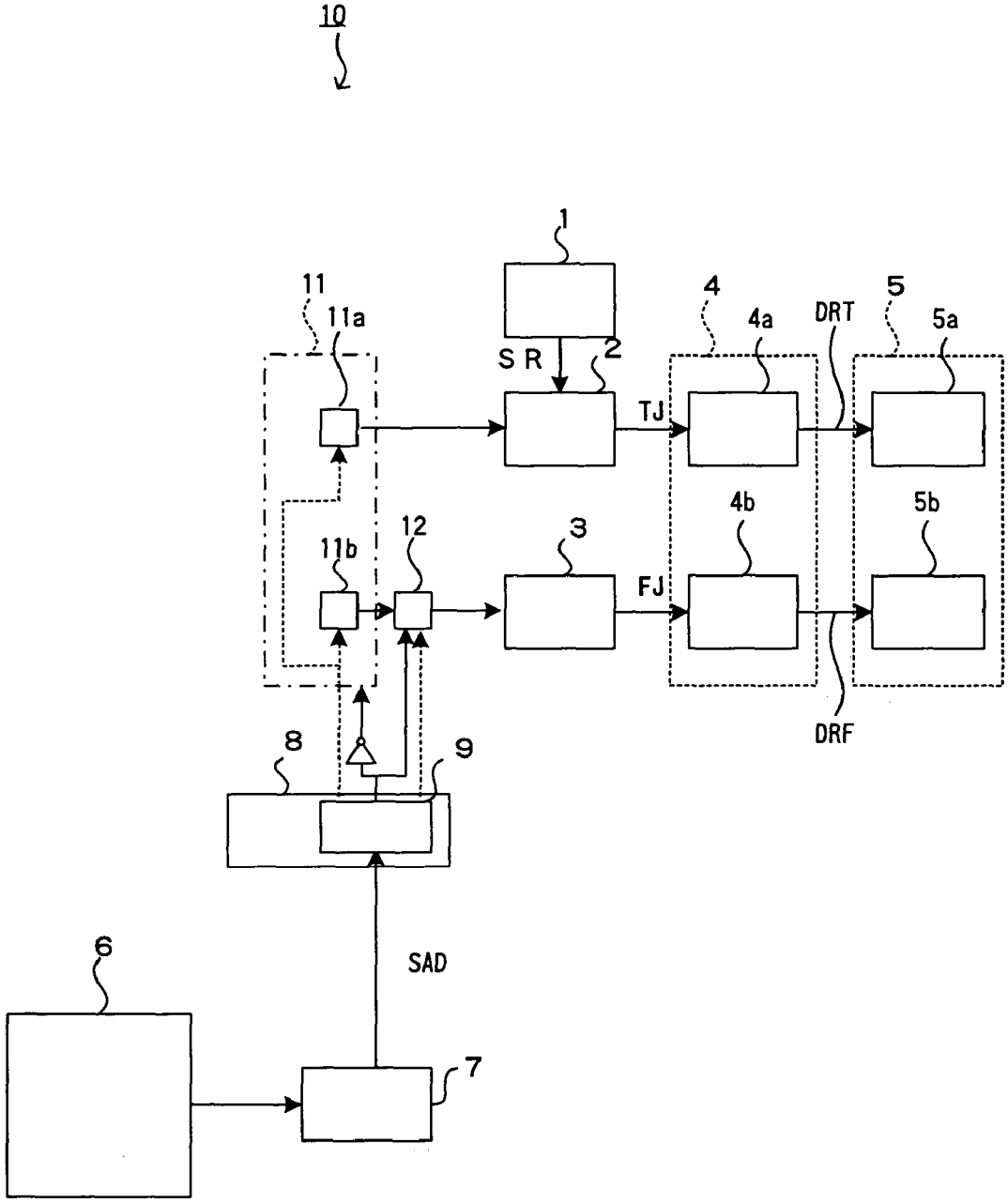
FIG. 3 is a schematic block diagram showing a configuration example of the electronic timepiece corresponding to the operation example of FIG. 1.
Figure 4:
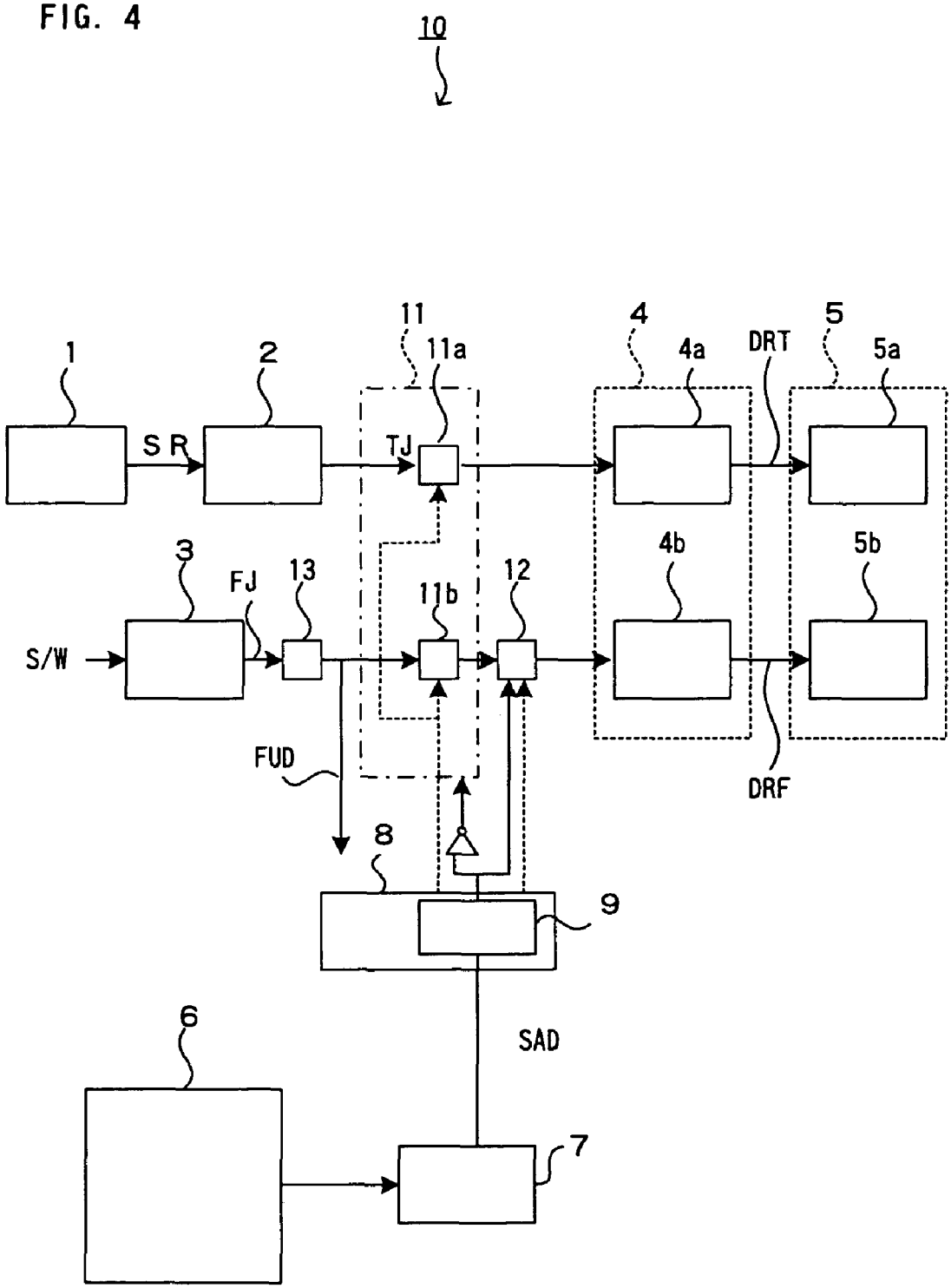
FIG. 4 is a schematic block diagram showing a configuration example of the electronic timepiece corresponding to the operation example of FIG. 2.

FIGS. 3 and 4 are schematic block diagrams for illustrating configuration examples of the electronic timepiece 10 according to the present embodiment. The configuration example of FIG. 3 corresponds to the example of operation shown in FIG. 1, and the configuration example of FIG. 4 to the example of operation shown in FIG. 2.

In FIGS. 3 and 4, the electronic timepiece 10 comprises reference signal generating means 1, time information generating means 2 for generating time information TJ in response to a reference signal SR from the reference signal generating means 1, function information generating means 3 for generating function information FJ, display drive means 4 for outputting drive signals DRF and DRT for displaying the function information FJ and the time information TJ on a display means, display means 5 for displaying the function information FJ and the time information TJ in response to the drive signals DRF and DRT, a power source 6, power-saving operation state detecting means 7, and control means 8.

Further, the electronic timepiece 10 comprises preferential operation selecting means 9 for giving priority to the power-saving operation or the functional operation, whereby the power-saving operation state that entails lower power consumption than the normal operation state can be realized.

Furthermore, the electronic timepiece 10 shown in FIGS. 3 and 4 comprises power-saving operation state setting means 11 for carrying out the power-saving operation, functional operation state setting means 12 for carrying out the functional operation, and the preferential operation selecting means 9 for preferentially operating the power-saving operation state setting means 11 or the functional operation state setting means 12.

In the configuration example of FIG. 3, the power-saving operation state setting means 11 is means for setting the time information generating means 2 and/or the function information generating means 3 in the power-saving operation state in response to a detection signal SAD from the power-saving operation state detecting means 7. The functional operation state setting means 12 is means for setting the function information generating means 3 in the functional operation state, and is set in accordance with a control signal (broken line in the drawing) from the control means 8. Further, any one of the power-saving operation state setting means 11 and the functional operation state setting means 12 is preferentially set in response to a selection signal from the preferential operation selecting means 9, and the time information generating means 2 or the function information generating means 3 to which only the preferentially set setting means corresponds is allowed to operate.

In the configuration example of FIG. 3, therefore, any one of the power-saving operation and the functional operation is preferentially performed by controlling the permission of the operation of the time information generating means 2 or the function information generating means 3 by the preferential operation selecting means 9.

In the configuration example of FIG. 4, on the other hand, the power-saving operation state setting means 11 is means for setting at least a part of the display means, e.g., at least a part of time information display means 5*a* and/or at least a part of function information display means 5*b*, in the power-saving operation state in response to the detection signal SAD from the power-saving operation state detecting means 7. Further, the functional operation state setting means 12 is means for setting at least a part of function information display means 5*b* in the functional operation state in response to a detection signal FUD from functional operation state detecting means 13. The preferential selection of the respective operations of the aforesaid individual means is set in accordance with the control signal (broken line in the drawing) from the control means 8.

Further, the power-saving operation state setting means 11 or the functional operation state setting means 12 is preferentially set in response to the selection signal from the preferential operation selecting means 9, and the time information generating means 2 or the function information generating means 3 to which only the preferentially set setting means corresponds is allowed to operate. In the drawing, 11*a* denotes power-saving operation state setting means for time display means, and 11*b* denotes power-saving operation state setting means for function information display means.

In the configuration example of FIG. 4, therefore, any one of the power-saving operation and the functional operation is preferentially performed by controlling the permission of operation for causing display means to display information generated in the time information generating means 2 and/or the function information generating means 3, by the preferential operation selecting means 9.

In the configuration example described above, the time information display means 5*a* and the function information display means 5*b* are composed of separate circuits, in some cases. In other cases, they are partially or wholly overlapped. During chronographic display by the function information display means 5*b*, a second hand 23 (FIG. 29) of the time information display means 5*a* in the normal operation state, for example, may be used overlapped as means for displaying chronographic seconds, in some cases.

Figure 5:
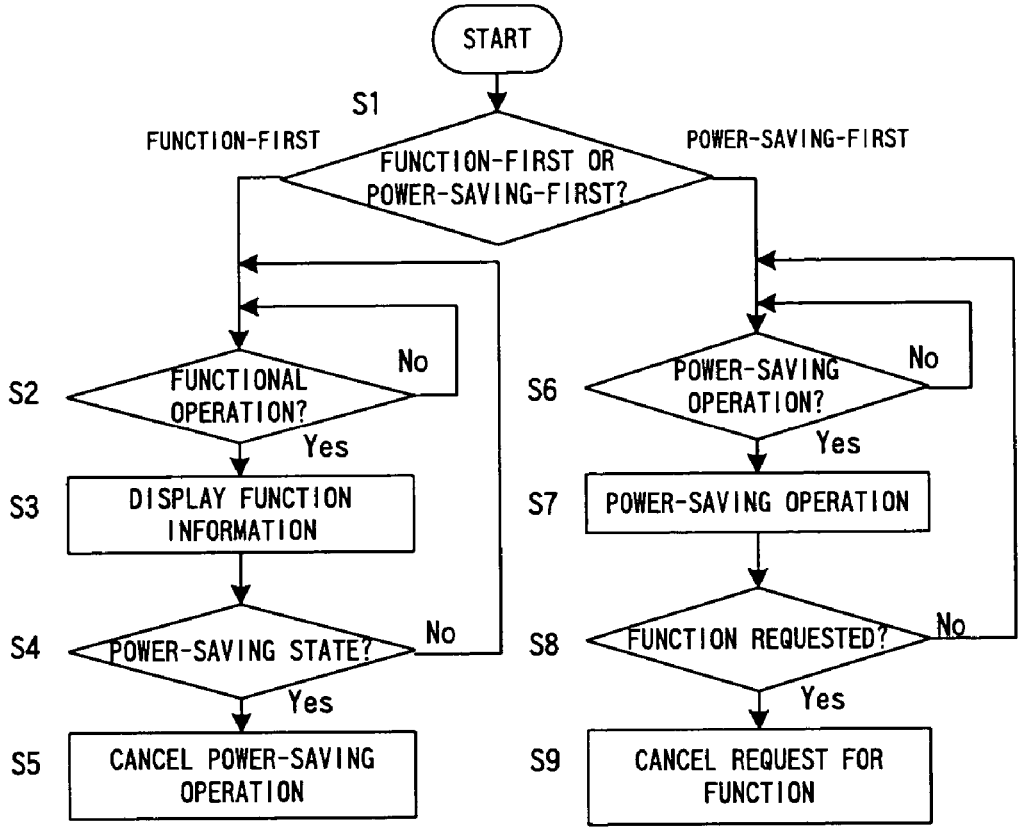
FIG. 5 is a flowchart for illustrating general operation for preferential selection of the electronic timepiece.

The flowchart of FIG. 5 shows an outline of the operation for preferential selection of the electronic timepiece of the present embodiment. The functional operation or the power-saving operation is selected by the preferential operation selecting means 9 (Step S1).

If the functional operation is requested (Step S2) when the functional operation is selected (Step S1), function information is displayed on the display means (Step S3). Even if power-saving conditions are met (Step S4) owing to a drop of the supply voltage or the like when the functional operation is preferentially selected (Step S4), the power-saving operation is cancelled (Step S5) since the functional operation is given priority.

If the power-saving conditions are met owing to a drop of the supply voltage or the like when the power-saving operation is selected (Step S6), on the other hand, power-saving operation, such as stopping displaying the time information on the display means 5, is performed (Step S7). If the generation of function information is requested when the power-saving operation is preferentially selected (Step S8), this request for functions is canceled (Step S9) since the power-saving operation is given priority.

Figure 6:
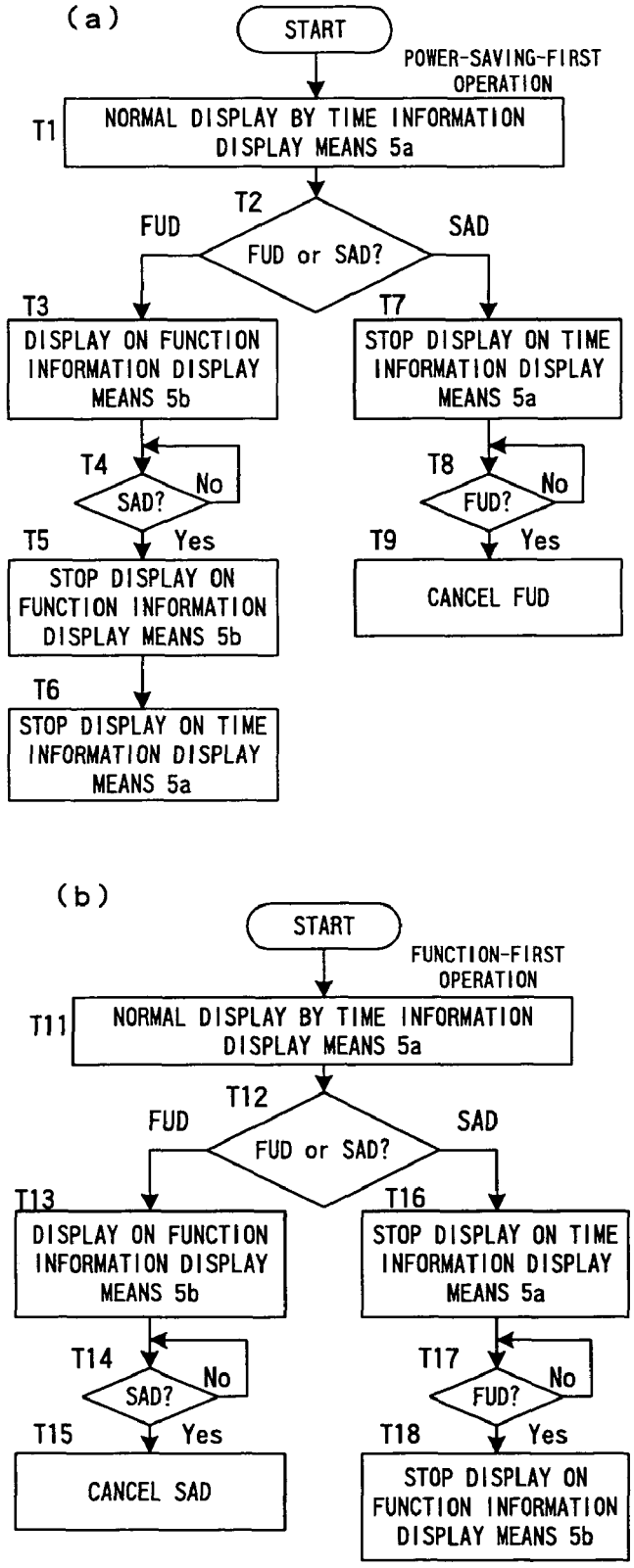
FIGS. 6(*a*) and 6(*b*) are diagrams for illustrating power-saving-first operation and function-first operation.
Figure 7:
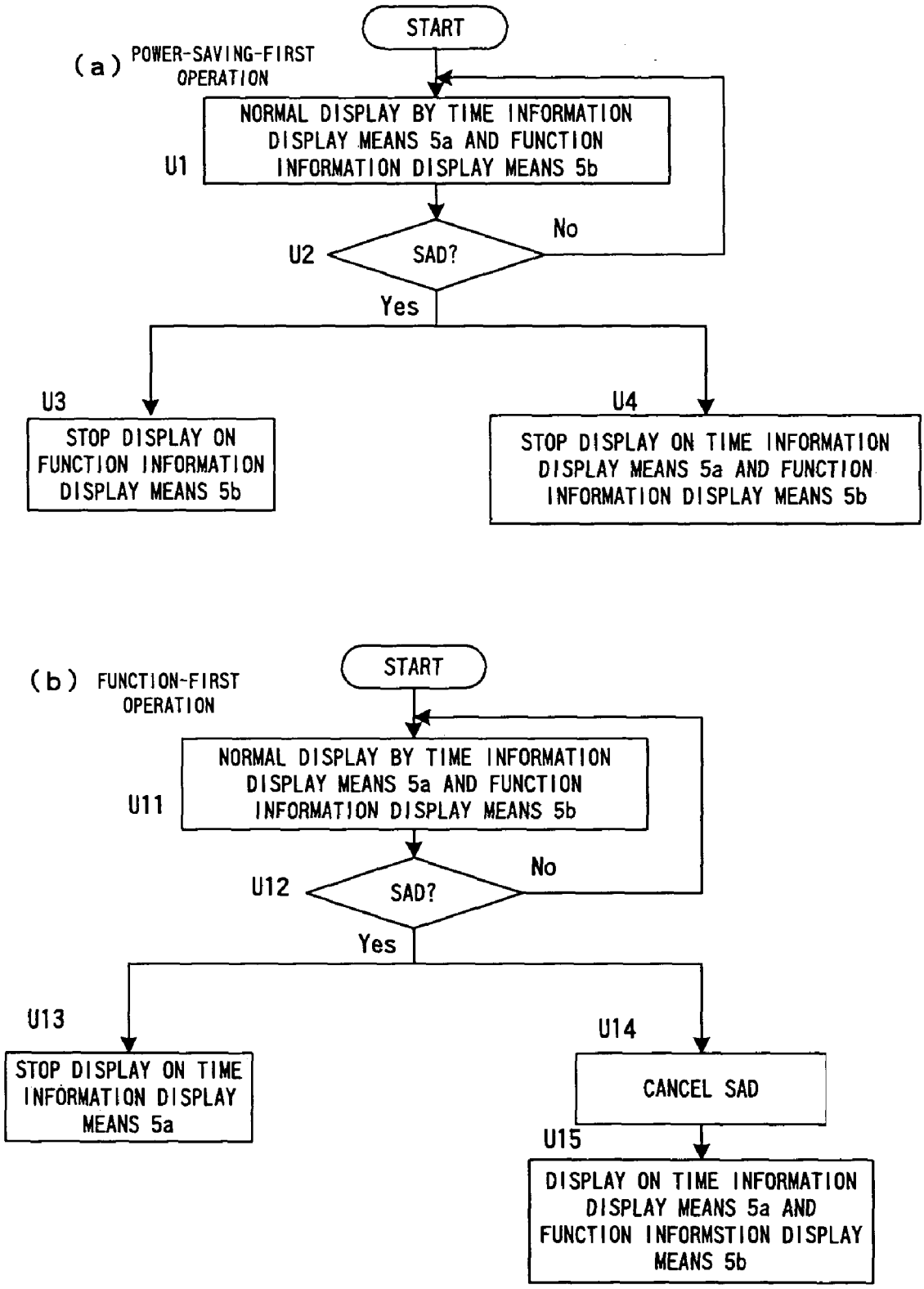
FIG. 7 is a diagram for illustrating the power-saving-first operation and the function-first operation.

Referring to FIGS. 6 and 7, moreover, there will be described power-saving-first operation and function-first operation for each of cases where only the time information is displayed and where the time information and the function information are displayed, in the configuration example shown in FIGS. 3 and 4. FIG. 6 shows the case where only the time information is displayed, and FIG. 7 shows the case where the time information and the function information are displayed.

If the power-saving-first operation is selected (FIG. 6(*a*)) in the case of FIG. 6 where only the time information is displayed, the function information is displayed on the function information display means 5*b* (Step T3) when the FUD (functional operation detection signal) is detected (Step T2) with normal displaying performed on the time information display means 5*a* (Step T1). When the SAD (power-saving operation detection signal) is detected thereafter (Step T4), the display of the function information display means 5*b* is stopped (Step T5). Further, the display on the time information display means 5*a* is stopped (Step T6).

If the SAD (power-saving operation detection signal) is detected (Step T2), on the other hand; the display on the time information display means 5*a* is stopped (Step T7). If the FUD (functional operation detection signal) is detected thereafter (Step T8), the FUD is canceled (Step T9).

If the function-first operation is selected (FIG. 6(*b*)) in the case of FIG. 6 where only the time information is displayed, the function information is displayed on the function information display means 5*b* (Step T13) when the FUD (functional operation detection signal) is detected (Step T12) with normal displaying performed on the time information display means 5*a* (Step T11). Even if the SAD (power-saving operation detection signal) is detected thereafter (Step T14), the SAD is canceled and the functional operation is given priority (Step T15).

If the SAD (power-saving operation detection signal) is detected (Step T12), on the other hand, the display on the time information display means 5*a* is stopped (Step T16). If the FUD (functional operation detection signal) is detected thereafter (Step T17), the function information is displayed on the function information display means 5*b* in response to the FUD even when the SAD is detected (Step T18).

If the SAD (power-saving operation detection signal) is detected (Step U2) with normal displaying performed on the time information display means 5*a* and the function information display means 5*b* (Step U1) in the case where the power-saving-first operation is selected (FIG. 7(*a*)), moreover, the display of the function information display means 5*b* is stopped (Step U3) or the display on the time information display means 5*a* and the function information display means 5*b* is executed (Step U4), depending on the power-saving conditions such as the supply voltage.

If the SAD (power-saving operation detection signal) is detected (Step U12) with normal displaying performed on the time information display means 5*a* and the function information display means 5*b* (Step U11) in the case where the function-first operation is selected (FIG. 7(*b*)), on the other hand, the display on the time information display means 5*a* is stopped (Step U13) or the SAD is canceled (Step U14), and the display on the time information display means 5*a* and the function information display means 5*b* is stopped (Step U15), depending on the power-saving conditions such as the supply voltage.

The following is a description of a mode example for selecting the display means to be set in the power-saving operation state when the functional operation state and the power-saving operation state compete with each other.

In the present embodiment, the time information display means 5*a* and the function information display means 5*b* can be configured to overlap each other. In a configuration, for example, the second hand serves as a display member that is common to the two display means, the time information display means 5*a* and the function information display means 5*b*.

In the power-saving operation state, according to this configuration, a mode can be effected such that only the display on the function information display means 5*b* is stopped while the display on the time information display means 5*a* is performed, besides the mode in which the display on the time information display means 5*a* and the display on the function information display means 5*b* are stopped. According to this mode, the operation of the display member (e.g., second hand 23) that is common to the two display means may or may not be stopped.

Further, the time information display means 5*a* and the function information display means 5*b* may be designed to enjoy a plurality of display modes. In the electronic timepiece 10 of the present embodiment, the time information display means 5*a* and/or the function information display means 5*b* may be composed of a digital display system or an analog display system.

Furthermore, the display means 5 of the electronic timepiece 10 of the present embodiment, like the time information display means 5*a* and the function information display means 5*b*, may be configured to be formed separately, or these means may be configured to be partially or wholly duplicate. In the case where the electronic timepiece 10 uses the analog display system, for example, the second hand 23 may be configured to display information for both means.

Power source means used in the electronic timepiece 10 of the present embodiment need not have any specific configuration, in particular, and may be formed using a primary battery such as an ordinary silver battery, or accumulator means such as a rechargeable secondary battery or high-capacity condenser (trade name: Gold Capacitor), or power generating means including a solar cell, self-winding generator, temperature-difference generator, etc.

Further, there is a preferred example of power source means that combines power generating means and accumulator means.

In FIGS. 3 and 4, the power-saving operation state detecting means 7 of the electronic timepiece 10 of the present embodiment judges the current state of the power source means 6 that is composed of a battery of power generating means, and outputs the power-saving operation detection signal SAD which provides the ground in determining as to whether or not the power consumption of the display drive means 4 and the display means 5 of the electronic timepiece 10 should be adjusted to the power-saving operation state in which it is much lower than the power consumption in the normal operation state.

In the determination of the state of the power source means, the power-saving operation detection signal SAD may be outputted when automatically detecting various cases, such as where the residual capacity of the battery of the power source means 6 becomes lower than a given threshold value, where the output voltage or output current of the battery becomes lower than a given threshold value, where the quantity of electricity generated by the power generating means becomes lower than a given threshold value, where the quantity of light that is continuously incident upon a solar cell as the power generating means for a given period is not greater than a predetermined value, etc. Alternatively, the power-saving operation detection signal SAD may be outputted when detecting a user's manual operation of a specific button, stem, etc.

The power-saving operation state may possibly be set by the user's manual operation in the case where the electronic timepiece is set in the power-saving operation state by manual operation when some of a plurality of electronic timepieces owned by the user are not expected to be used for some time, for example.

In the case where at least a part of the display drive means 4 and at least a part of the display means 5 of the electronic timepiece according to the present embodiment are in the power-saving operation state, the display information on at least a part of the display means is displayed faintly or erased, and the operation of the display section is stopped. Even in this case, the time information of the electronic timepiece 10 run normally, and the time information is always stored and updated in advance in predetermined storage means. Thus, if the power-saving operation state is canceled, the current time information can be displayed immediately on the time information display means 5*a*, for example.

In the electronic timepiece 10 of the present embodiment, moreover, the condition for canceling the power-saving operation state can be the detection of the condition for the generation of the aforesaid power-saving operation detection signal SAD and a contradictory condition such that the quantity of light incident upon the solar cell exceeds the predetermined value, for example.

The function information used in the electronic timepiece 10 of the present embodiment include, for example, an alarm function, chronographic function, calendar display function, sounding information display function, atmosphere information display function, water temperature display function, etc. The electronic timepiece has at least one of additional functions for realizing these function information, in a group of additional functions.

If the user of the electronic timepiece 10 intends to use any of the aforesaid additional functions, according to the present embodiment, he/she manually operates a specific button or stem, thereby selecting the function information generating means 3 corresponding to the desired additional function in the additional function group. Thus, the functional operation state detection signal FUD is delivered from the functional operation state detecting means 13.

The individual functions of the electronic timepiece of the present embodiment, especially the preferential function for giving priority to the power-saving operation over the functional operation, and the drive of the electronic timepiece using this preferential function can be carried out by executing the aforesaid individual means by a digital configuration including a CPU, memory, etc. and software, and besides, can be constituted by hardware.

The electronic timepiece according to the present embodiment and a method for driving the electronic timepiece will now be described with reference to FIGS. 8 to 28. In the electronic timepiece of the present embodiment, the selection of the power-saving operation and the functional operation can be made in selection modes that are based on various combinations, depending on the level of the power generating voltage and/or the secondary battery voltage.

In a first selection mode, the power-saving operation and the functional operation are selected according to the respective levels of the power generating voltage and the secondary battery voltage (FIGS. 8 to 11). In a second selection mode, the power-saving operation and the functional operation are selected according to the level of the power generating voltage (FIGS. 12 to 15). In third and fourth selection modes, the power-saving operation and the functional operation are selected according to two power generating voltage levels and the secondary battery voltage (FIGS. 16 to 19 and FIGS. 20 to 23). In a fifth selection mode, the power-saving operation and the functional operation are selected in response to external operation (FIGS. 24 to 27).

In the following description, the individual selection modes can be realized by two configuration examples. In a first configuration example, the preferential operation selecting means 9 allows only any one of the power-saving operation state setting means 11 and the function information generating means 3 to operate, thereby selecting the functional operation or the power-saving operation, and corresponds to the configuration example of FIG. 3.

In a second configuration example, on the other hand, the preferential operation selecting means 9 controls whether or not to deliver the time information and the function information generated to display means via the power-saving operation means, thereby selecting the functional operation and the power-saving operation. Thus, the second configuration example corresponds to the configuration example of FIG. 4.

First, the first selection mode will be described with reference to FIGS. 8 to 11. In the first selection mode, the functional operation and the power-saving operation are selected according to an power generating voltage level VA and a secondary battery voltage level Va.

Figure 8:
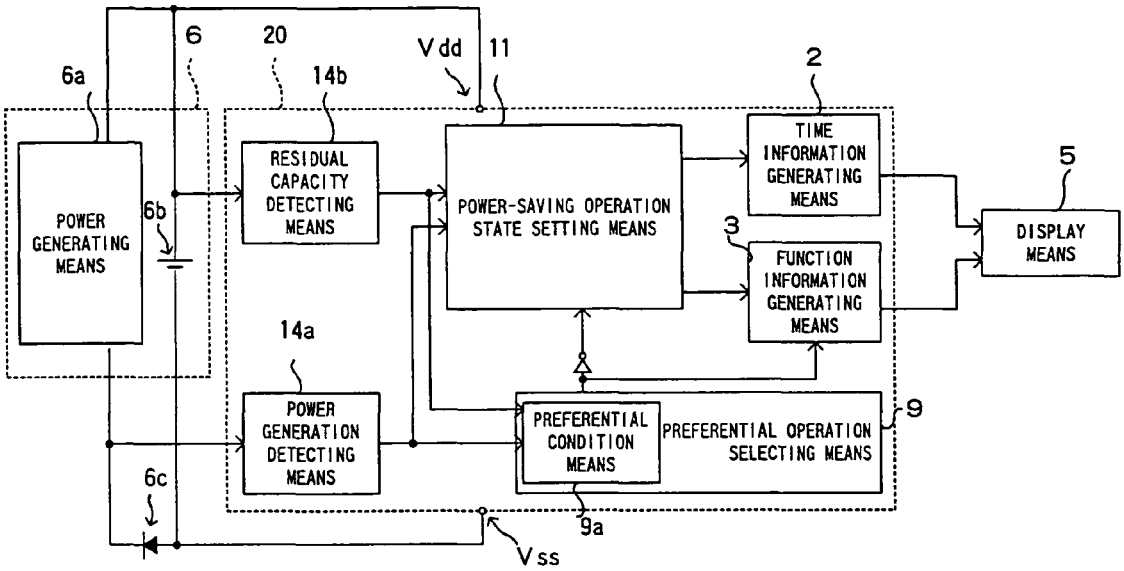
FIG. 8 is a diagram illustrating a first configuration example for realizing a first selection mode of the electronic timepiece.

FIG. 8 shows the first configuration example that realizes the first selection mode. This configuration example comprises a power source unit 6, which is provided with power generating means 6*a* and a secondary battery 6*b* that is charged by the power generating means 6*a*, time information generating means 2, function information generating means 3, power-saving operation state setting means 11 for causing the information generating means 2 and 3 to perform power-saving operation, and preferential operation selecting means 9 for delivering a command for driving any one of the power-saving operation state setting means 11 and the function information generating means 3, thereby selecting the power-saving operation and the functional operation. The first configuration example further comprises residual capacity detecting means 14*b* for detecting the voltage of the secondary battery 6*b*, thereby detecting the residual capacity of the secondary battery, power generation detecting means 14*a* for detecting the quantity of electricity generated by the power generating means 6*a*, and preferential condition means 9*a* for selecting the preferential operation in accordance with detection signals from the residual capacity detecting means 14*b* and the power generation detecting means 14*a*.

The power source unit 6 supplies driving power to an electronic circuit 20 that include the aforesaid individual means through terminals Vdd and Vss. A reverse-current preventing diode 6*c* is connected between the power generating means 6*a* and the secondary battery 6*b*, whereby electric discharge from the secondary battery 6*b* to the power generating means 6*a* is prevented.

In connecting the preferential operation selecting means 9 to the power-saving operation state setting means 11 and the function information generating means 3, a command for driving any one of the power-saving operation state setting means 11 and the function information generating means 3 can be given by providing one of junctions with reversal means.

Figure 9:
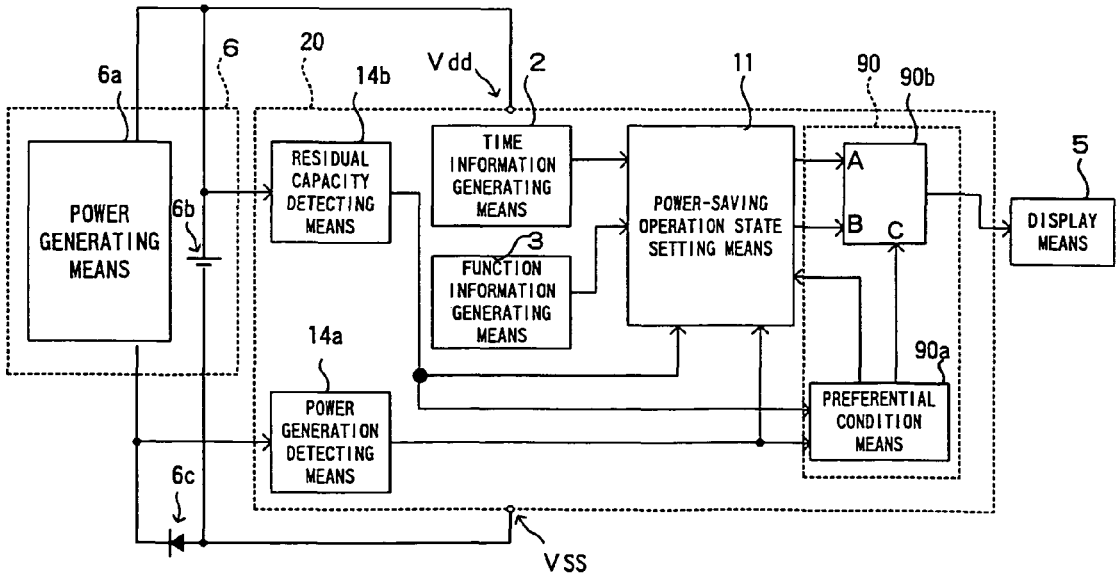
FIG. 9 is a diagram illustrating a second configurate example for realizing the first selection mode of the electronic timepiece.

FIG. 9 shows the second configuration example that realizes the second selection mode. This configuration example comprises a power source unit 6, time information generating means 2, and function information generating means 3, which are similar to those of the first configuration example. Power-saving operation state setting means 11 subjects individual information generated by the time information generating means 2 and the function information generating means to power-saving operation, and these information are selected by preferential operation selecting means 90 and delivered to display means 5. The preferential operation selecting means 90 can be configured to comprise a selector 90*b*, which selects time information and function information applied to a terminal A and a terminal B and delivers them to the display means 5, and preferential condition means 90*a*, which delivers a selection signal for preferential operation to a terminal C of the selector 90*b* in accordance with detection signals from residual capacity detecting means 14*b* and power generation detecting means 14*a*.

In the case where the power-saving operation is given priority in this configuration example, the power-saving operation state setting means 11 is driven in response to a command from the preferential condition means 90*a*. In the case where the function information is given priority, the function information is preferentially delivered to the display means 5 by delivering a command from the preferential condition means 90*a* for selecting the function information to the terminal C.

In the first and second configuration examples, the power-saving operation state setting means 11 restricts the generation and/or display on the time information and/or the function information in accordance with the detection signal from the residual capacity detecting means 14*b* and/or the detection signal from the power generation detecting means 14*a*. Further, power generated by the power generation detecting means 14*a* can be detected according to the voltage, current, and generation time.

Figure 10:
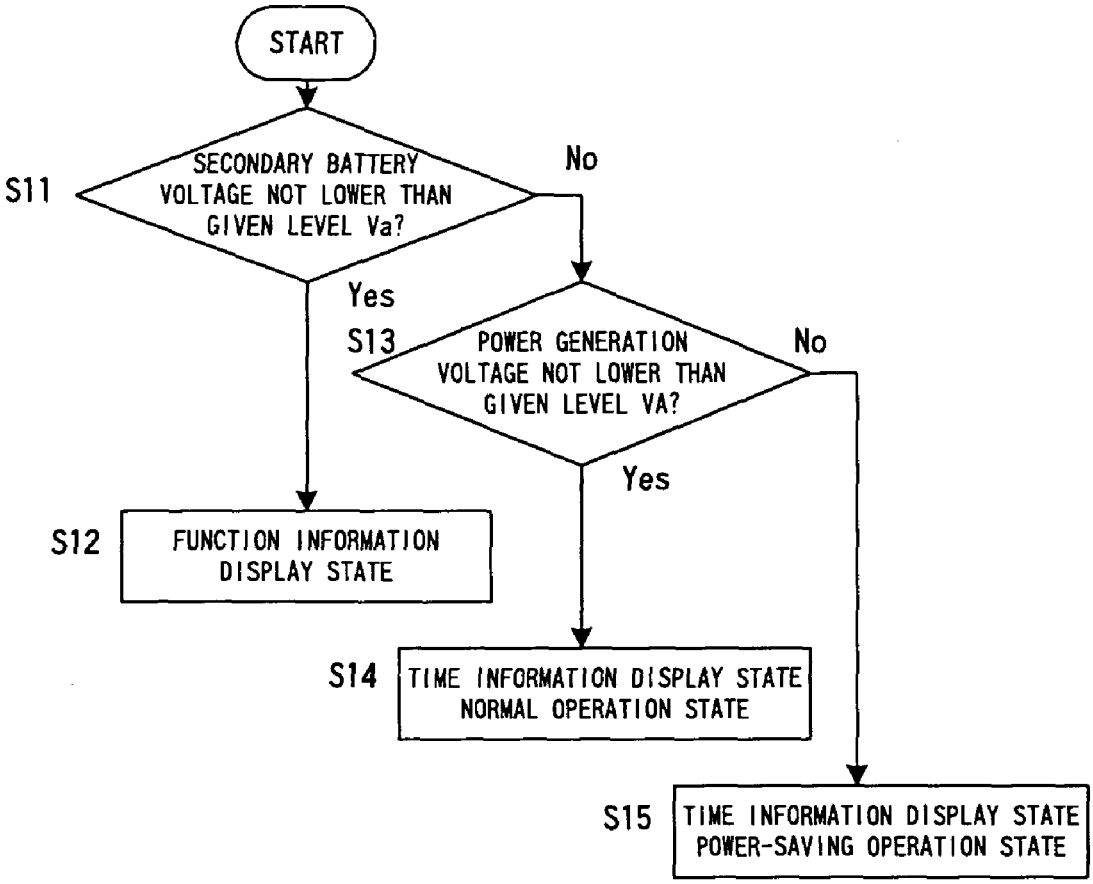
FIG. 10 is a flowchart illustrating the operation of the electronic timepiece.
Figure 11:
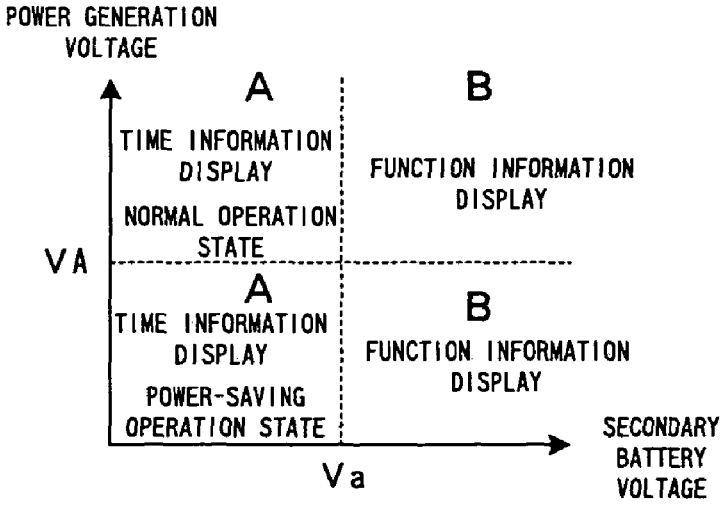
FIG. 11 is a voltage diagram illustrating operation in the first selection mode of the electronic timepiece.

FIG. 10 is a flowchart showing an example of the procedure of selecting operation according to the first selection mode, and FIG. 11 is a diagram for illustrating selecting operation for the power generating voltage and secondary battery voltage.

Va and VA are individually settled in advance as set levels for the secondary battery voltage and the power generating voltage. Va is settled as a level to determine whether or not to perform function information display, and VA is settled as a level to determine whether or not to perform power-saving operation.

First, the secondary battery voltage is compared with the level Va. If the secondary battery voltage is not lower than the level Va (Step S11), the function information is displayed (Step S12). If the secondary battery voltage is lower than the level Va (Step S11), on the other hand, the power generating voltage is compared with the level VA. If the comparison with the level Va indicates that the power generating voltage is not lower than the level VA (Step S13), the time information is displayed in the normal operation state (Step S14). If the power generating voltage is lower than the level VA (Step S13), the time information is displayed in the power-saving operation state (Step S15).

In FIG. 11, symbols A and B designate terminals that are selected by the selector 9*b* of FIG. 9. The terminal B is selected when the function information is displayed, and the terminal A is selected when the time information is displayed (normal operation state and power-saving operation state).

The second selection mode will now be described with reference to FIGS. 12 to 15. In the second selection mode, the functional operation and the power-saving operation are selected according to the power generating voltage level VA.

Figure 12:
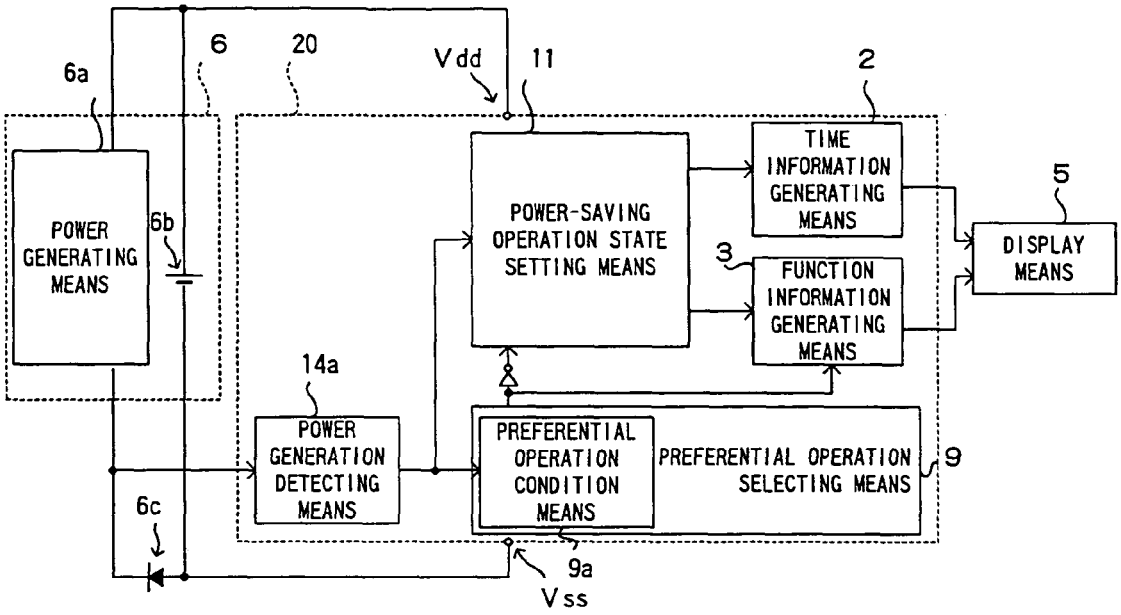
FIG. 12 is a diagram illustrating a first configuration example for realizing a second selection mode of the electronic timepiece.
Figure 13:
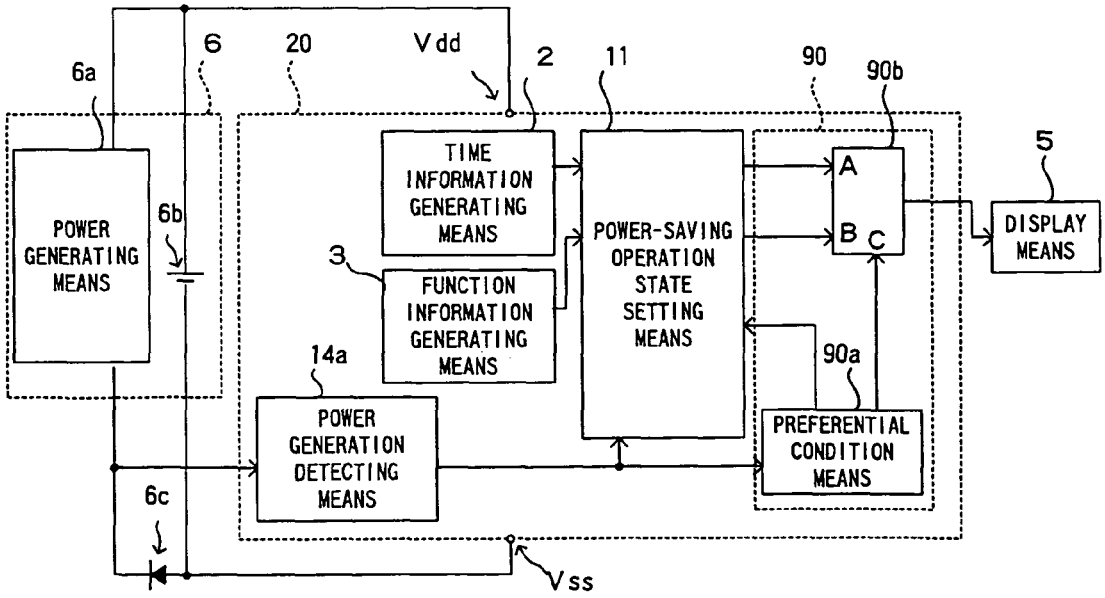
FIG. 13 is a diagram illustrating a second configuration example for realizing the second selection mode of the electronic timepiece.

FIGS. 12 and 13 show first and second configuration examples that realize the second selection mode, respectively. The configuration examples shown in FIGS. 12 and 13 can be arranged substantially in the same manner as the configuration examples of FIGS. 8 and 9 for the first selection mode except for the residual capacity detecting means 14*b*. Since other configurations are common, a description of FIGS. 12 and 13 is omitted herein. According to the second selection mode, the preferential operation selecting means 9 and 90 perform selecting operation in accordance with the detection signal from the power generation detecting means 14*a*.

Figure 14:
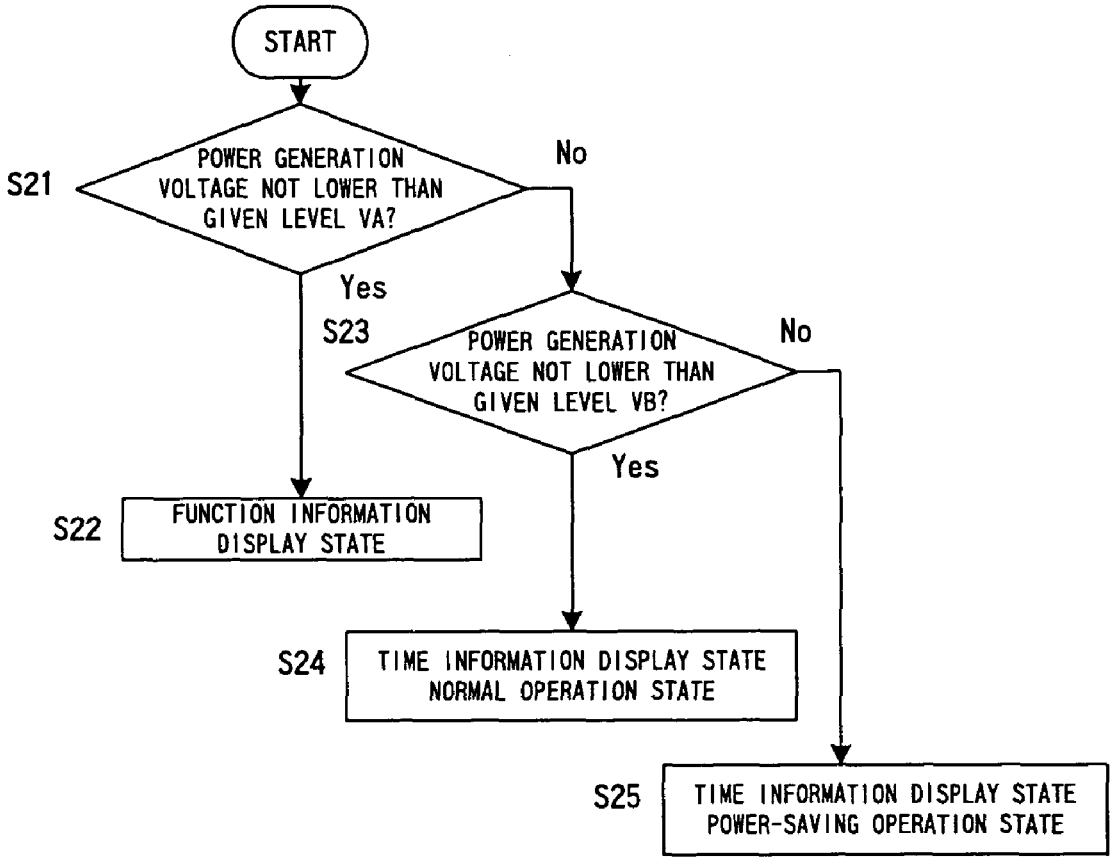
FIG. 14 is a flowchart illustrating operation in the second selection mode of the electronic timepiece.
Figure 15:
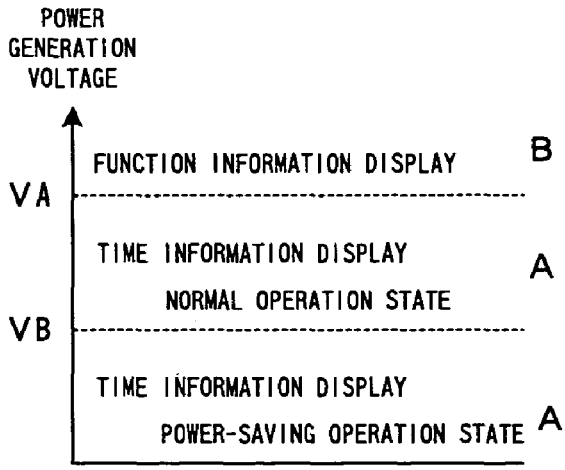
FIG. 15 is a voltage diagram illustrating the operation in the second selection mode of the electronic timepiece.

FIG. 14 is a flowchart showing an example of the procedure of selecting operation according to the second selection mode, and FIG. 15 is a diagram for illustrating selecting operation for the power generating voltage.

VA and VB are individually settled in advance as set levels for the power generating voltage. Although VA>VB is given in this embodiment, the relation between the set levels is not limited to it. Va is a level to determine whether or not to perform function information display, and VA is a level to determine whether or not to perform power-saving operation.

First, the power generating voltage is compared with the level VA. If the power generating voltage is not lower than the level VA (Step S21), the function information is displayed (Step S22). If the power generating voltage is lower than the level VA (Step S21), on the other hand, the power generating voltage is compared with the level VB. If the comparison with the level VB indicates that the power generating voltage is not lower than the level VB (Step S23), the time information is displayed in the normal operation state (Step S24). If the power generating voltage is lower than the level VB (Step S23), the time information is displayed in the power-saving operation state (Step S25).

In FIG. 15, symbols A and B designate terminals that are selected by a selector 9*b* of FIG. 13. The terminal B is selected when the function information is displayed, and the terminal A is selected when the time information is displayed (normal operation state and power-saving operation state).

The third selection mode will now be described with reference to FIGS. 16 to 19. In the third selection mode, the power-saving operation and the functional operation are selected according to two power generating voltage levels and the secondary battery voltage.

Figure 16:
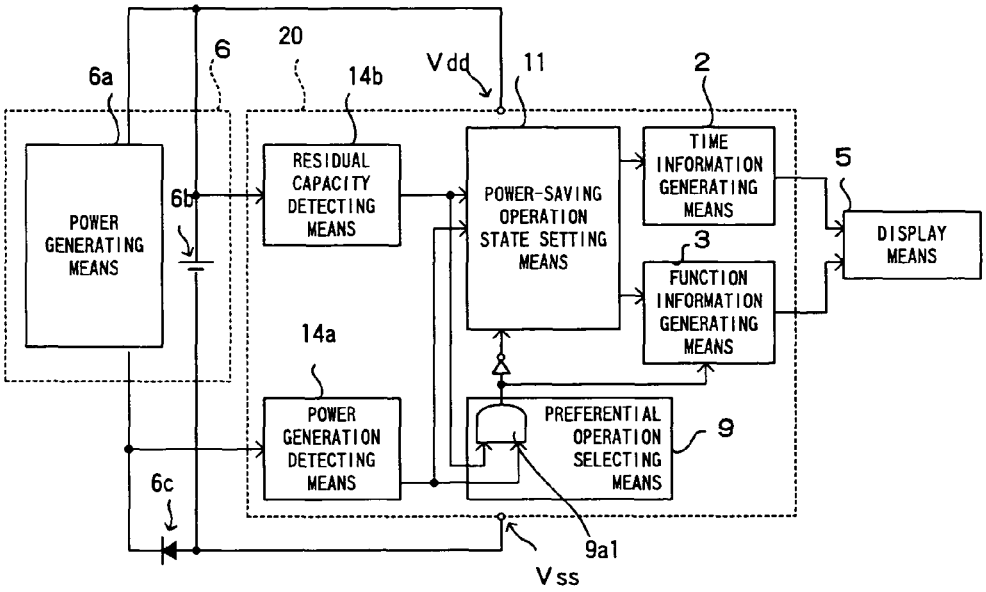
FIG. 16 is a diagram illustrating a first configuration example for realizing a third selection mode of the electronic timepiece.
Figure 17:
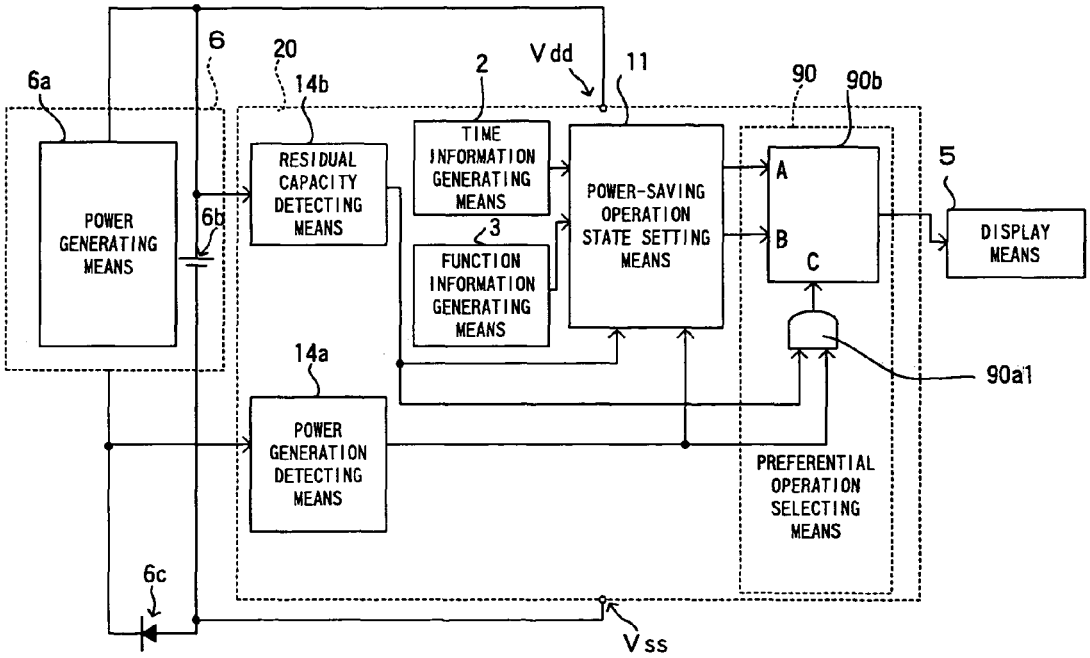
FIG. 17 is a diagram illustrating a second configuration example for realizing the third selection mode of the electronic timepiece.

FIGS. 16 and 17 show first and second configuration examples that realize the third selection mode, respectively. The configuration examples shown in FIGS. 16 and 17 are arranged substantially in the same manner as the configuration examples of FIGS. 8 and 9 for the first selection mode. AND circuits 9*a*1 and 90*a*1 are used as the preferential condition means 9*a* and 90*a*, respectively, and the logical product of the detection signals from the residual capacity detecting means 14*b* and the power generation detecting means 14*a* is used as a selection signal.

Since other configurations are common, a description of FIGS. 16 and 17 is omitted herein. According to the third selection mode, therefore, the preferential operation selecting means 9 and 90 perform selecting operation in accordance with the logical product of the detection signals from the residual capacity detecting means 14*b* and the power generation detecting means 14*a*.

Figure 18:
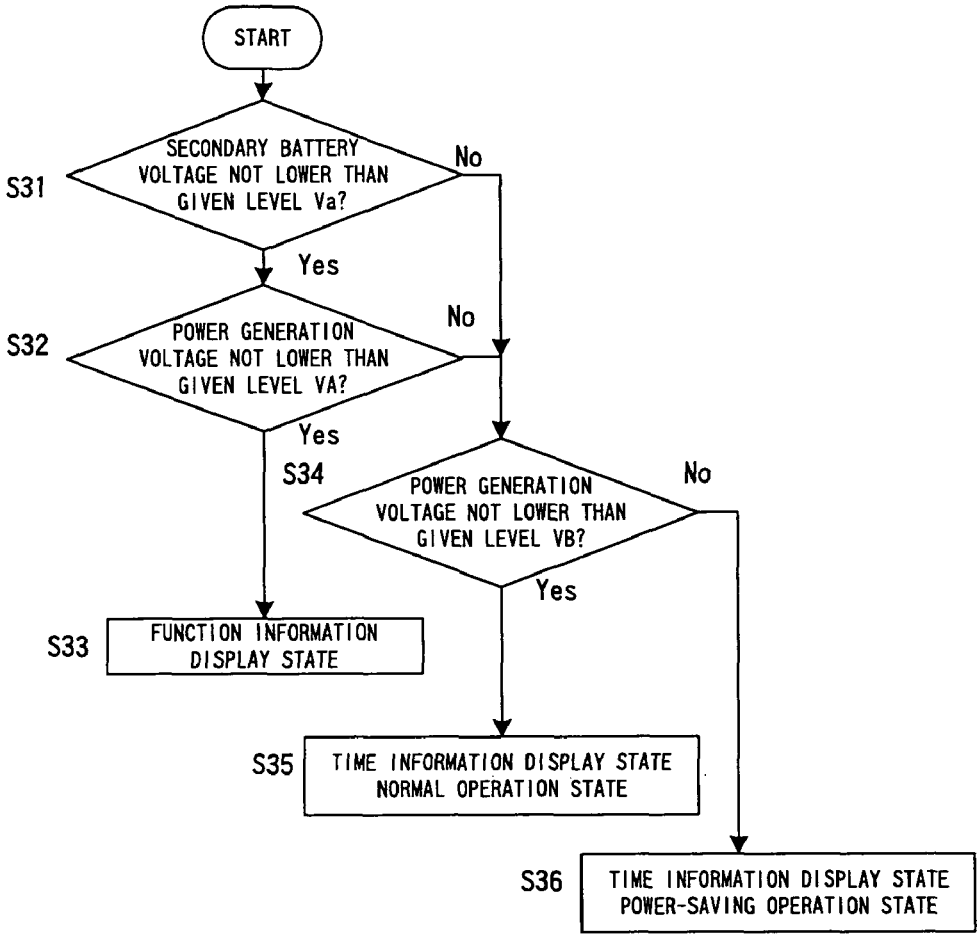
FIG. 18 is a flowchart illustrating operation in the third selection mode of the electronic timepiece.
Figure 19:
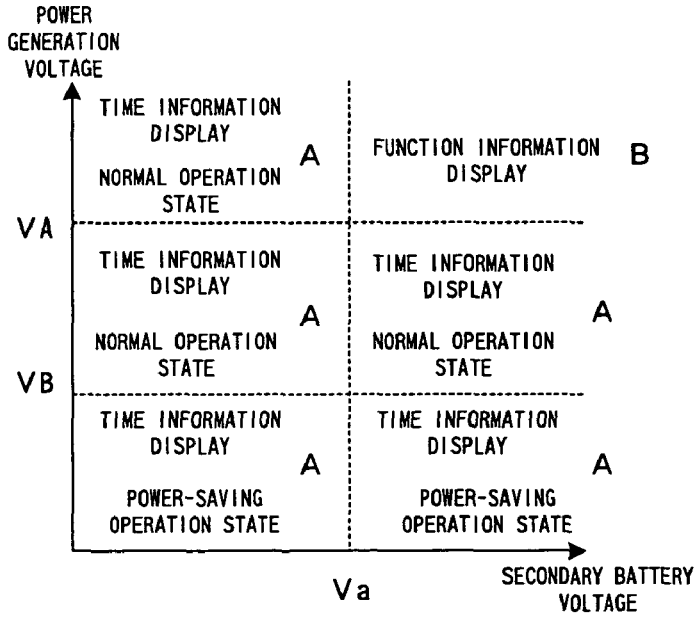
FIG. 19 is a voltage diagram illustrating the operation in the third selection mode of the electronic timepiece.

FIG. 18 is a flowchart showing an example of the procedure of selecting operation according to the third selection mode, and FIG. 19 is a diagram for illustrating selecting operation for the power generating voltage and the secondary battery voltage.

Va is settled in advance as a set level for the secondary battery voltage, and VA and VB are settled as set levels for the power generating voltage. Although VA>VB is given in this embodiment, the relation between the set levels is not limited to it. Va and VA are levels to determine whether or not to perform function information display, and VB is a level to determine whether or not to perform power-saving operation.

First, the secondary battery voltage is compared with the level Va. If the secondary battery voltage is not lower than the level Va (Step S31), the power generating voltage is further compared with the level VA (Step S32). If the comparison with the level VA indicates that the power generating voltage is not lower than VA (Step S32), the function information is displayed (Step S33).

If the secondary battery voltage is lower than the level Va (Step S31) and if the power generating voltage is lower than the level VA (Step S32), on the other hand, the power generating voltage is compared with the level VB (Step S34). If the comparison with the level VB indicates that the power generating voltage is not lower than the level VB (Step S34), the time information is displayed in the normal operation state (Step S35). If the power generating voltage is lower than the level VB (Step S34), the time information is displayed in the power-saving operation state (Step S36).

In FIG. 19, symbols A and B designate terminals that are selected by a selector 90*b* of FIG. 17. The terminal B is selected when the function information is displayed, and the terminal A is selected when the time information is displayed (normal operation state and power-saving operation state).

The fourth selection mode will now be described with reference to FIGS. 20 to 23. In the fourth selection mode, the power-saving operation and the functional operation are selected according to two power generating voltage levels and the secondary battery voltage.

Figure 20:
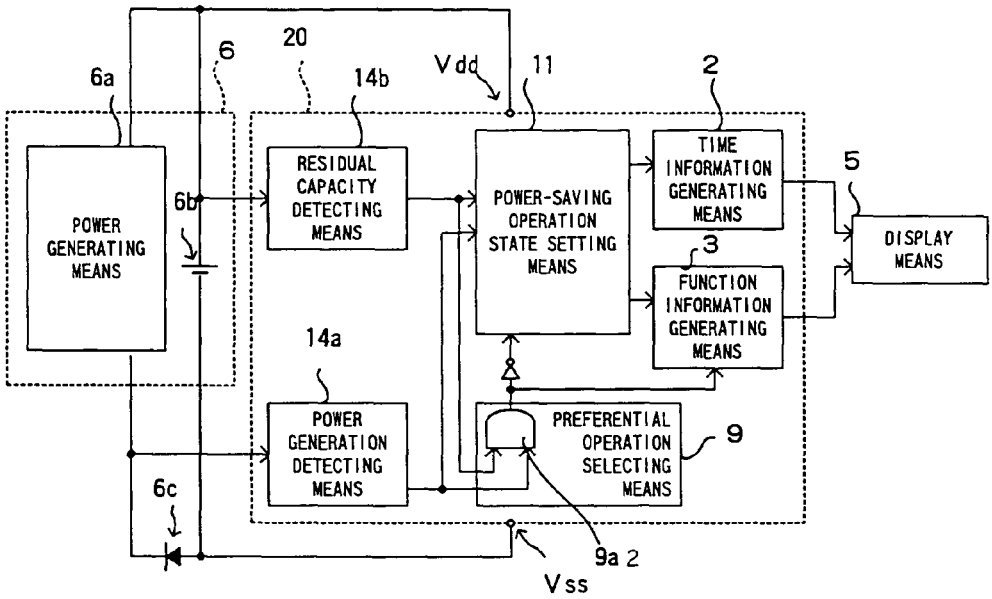
FIG. 20 is a diagram illustrating a first configuration example for realizing a fourth selection mode of the electronic timepiece.
Figure 21:
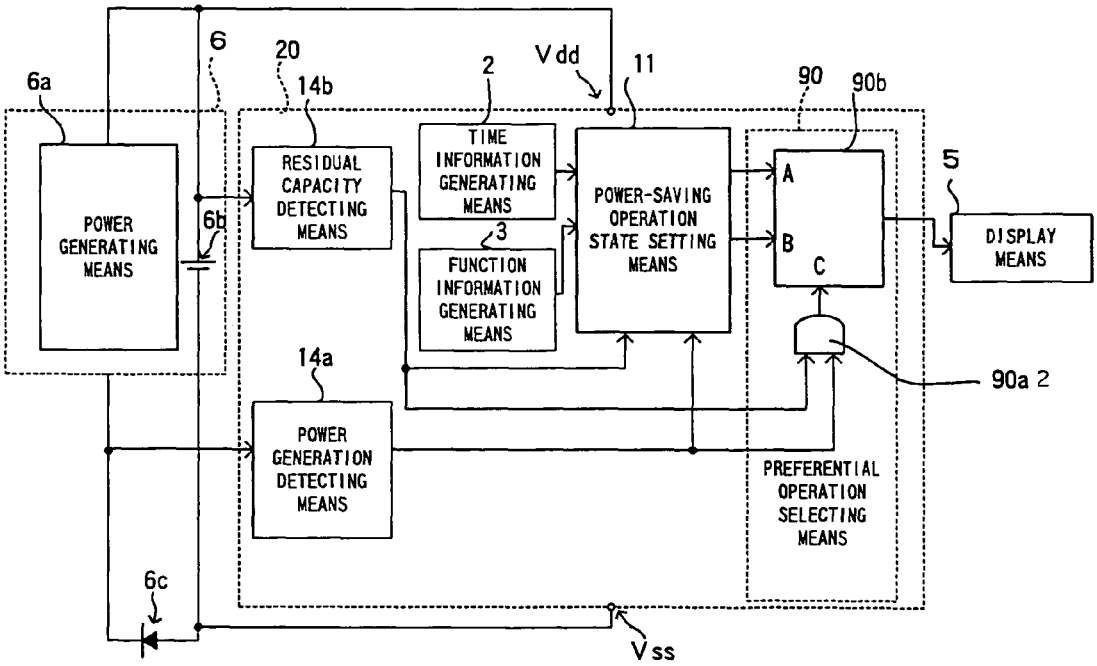
FIG. 21 is a diagram illustrating a second configuration example for realizing the fourth selection mode of the electronic timepiece.

FIGS. 20 and 21 show first and second configuration examples that realize the fourth selection mode, respectively. The configuration examples shown in FIGS. 20 and 21 are arranged substantially in the same manner as the configuration examples of FIGS. 8 and 9 for the first selection mode. OR circuits 9*a*2 and 90*a*2 are used as the preferential condition means 9*a* and 90*a*, respectively, and the logical sum of the detection signals from the residual capacity detecting means 14*b* and the power generation detecting means 14*a* is as a selection signal.

Since other configurations are common, a description of FIGS. 20 and 21 is omitted herein. According to the fourth selection mode, therefore, the preferential operation selecting means 9 and 90 perform selecting operation in accordance with the logical sum of the detection signals from the residual capacity detecting means 14*b* and the power generation detecting means 14*a*.

Figure 22:
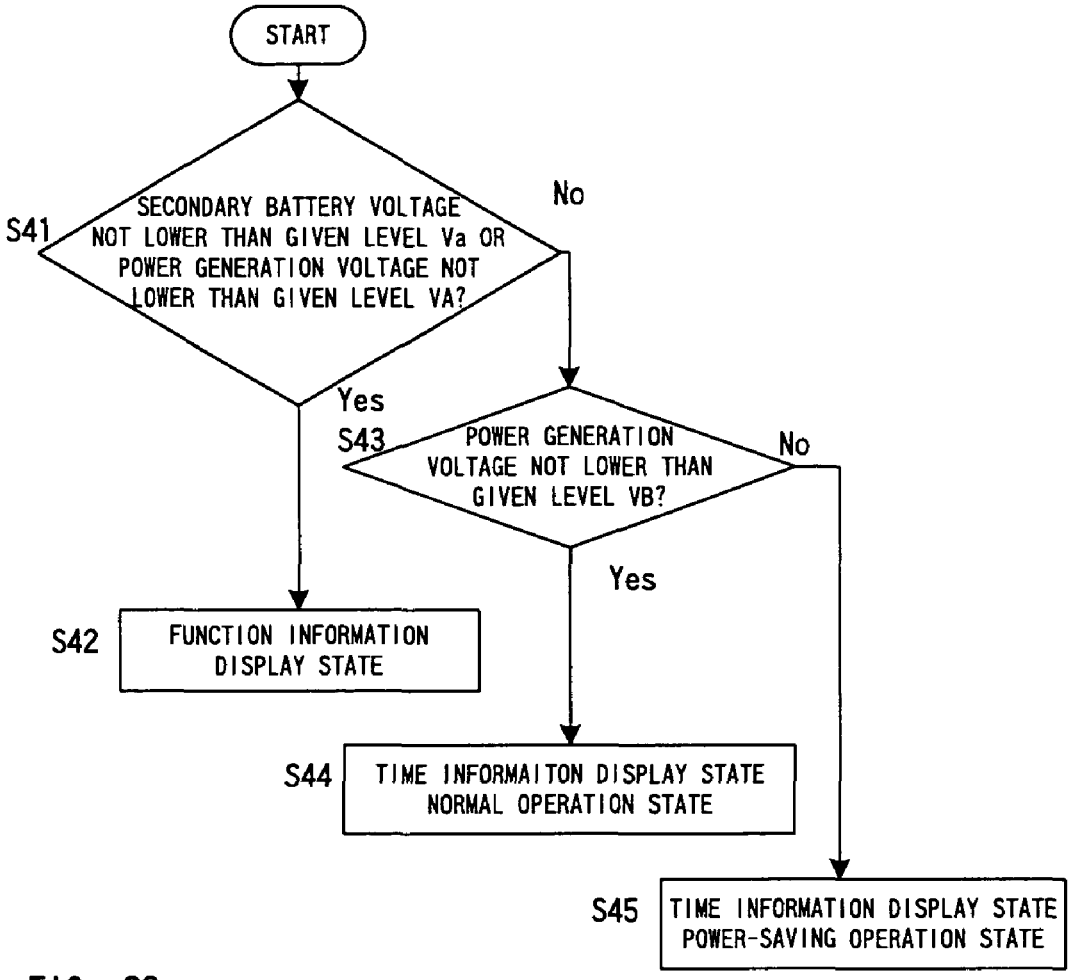
FIG. 22 is a flowchart illustrating operation in the fourth selection mode of the electronic timepiece.
Figure 23:
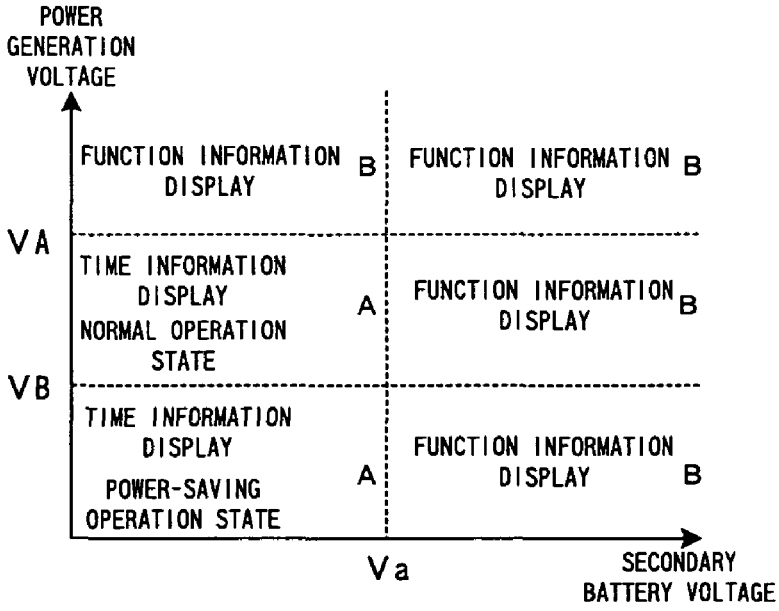
FIG. 23 is a voltage diagram illustrating the operation in the fourth selection mode of the electronic timepiece.

FIG. 22 is a flowchart showing an example of the procedure of selecting operation according to the fourth selection mode, and FIG. 23 is a diagram for illustrating selecting operation for the power generating voltage and the secondary battery voltage.

Va is settled in advance as a set level for the secondary battery voltage, and VA and VB are settled as set levels for the power generating voltage. Although VA>VB is given in this embodiment, the relation between the set levels is not limited to it. Va and VA are levels to determine whether or not to perform function information display, and VB is a level to determine whether or not to perform power-saving operation.

First, the secondary battery voltage is compared with the level Va, and the power generating voltage is compared with the level VA. If the secondary battery voltage is not lower than the level Va or if the power generating voltage is not lower than the level VA (Step S41), the function information is displayed (Step S42).

If the secondary battery voltage is lower than the level Va and if the power generating voltage is lower than the level VA (Step S41), on the other hand, the power generating voltage is compared with the level VB (Step S43). If the comparison with the level VB indicates that the power generating voltage is not lower than the level VB (Step S43), the time information is displayed in the normal operation state (Step S44). If the power generating voltage is lower than the level VB (Step S43), the time information is displayed in the power-saving operation state (Step S45).

In FIG. 23, symbols A and B designate terminals that are selected by a selector 90*b* of FIG. 21. The terminal B is selected when the function information is displayed, and the terminal A is selected when the time information is displayed (normal operation state and power-saving operation state).

The fifth selection mode will now be described with reference to FIGS. 24 to 27. In the fifth selection mode, the functional operation and the power-saving operation are selected in response to external operation.

Figure 24:
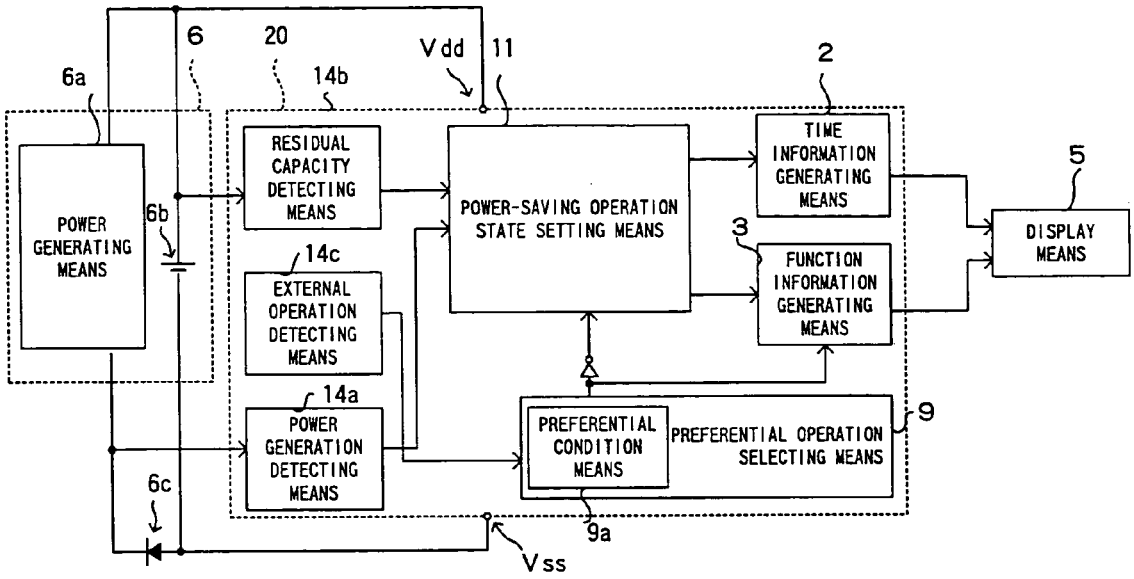
FIG. 24 is a diagram illustrating a first configuration example for realizing a fifth selection mode of the electronic timepiece.
Figure 25:
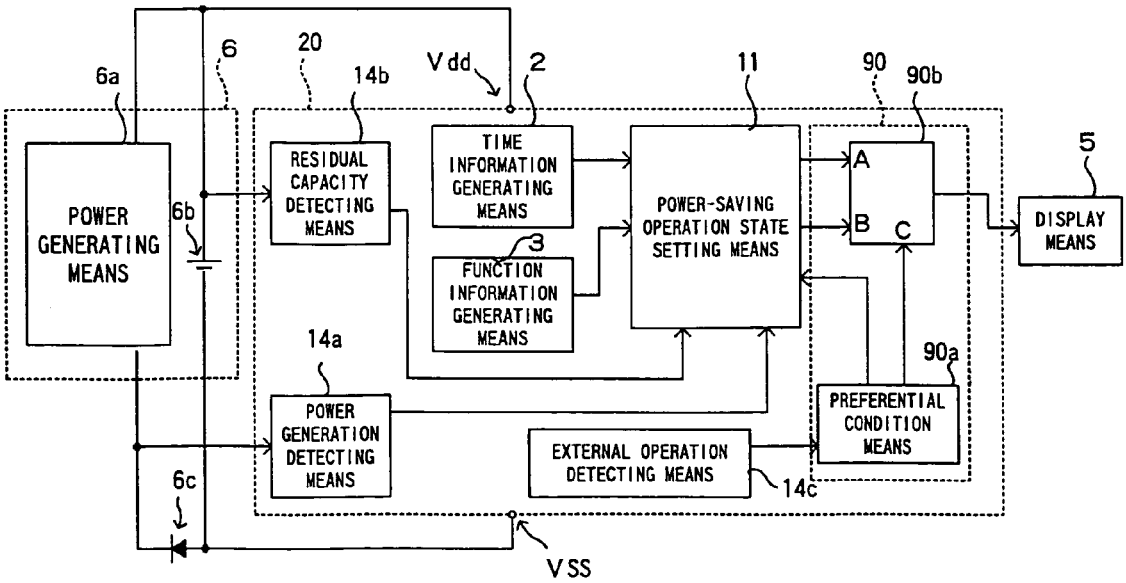
FIG. 25 is a diagram illustrating a second configuration example for realizing the fifth selection mode of the electronic timepiece.

FIGS. 24 and 25 show first and second configuration examples that realize the fifth selection mode, respectively. The configuration examples shown in FIGS. 24 and 25 can be arranged substantially in the same manner as the configuration examples of FIGS. 8 and 9 for the first selection mode except for external operation detecting means 14*c*. The external operation detecting means 14*c* can be composed of an external operation member, such as switch means, setup memory, or wire. According to the switch means or any other external operation member, selection can be made at any desired point of time after the electronic timepiece is manufactured. In the case where selection is made in the process of manufacturing an electronic timepiece, moreover, such selection can be made by setup in a memory in an IC circuit or by a hardware configuration based on wire option. Since other configurations are common, a description of FIGS. 24 and 25 is omitted herein. According to the fifth selection mode, the preferential operation selecting means 9 and 90 perform selecting operation in accordance with a signal by the external operation.

Figure 26:
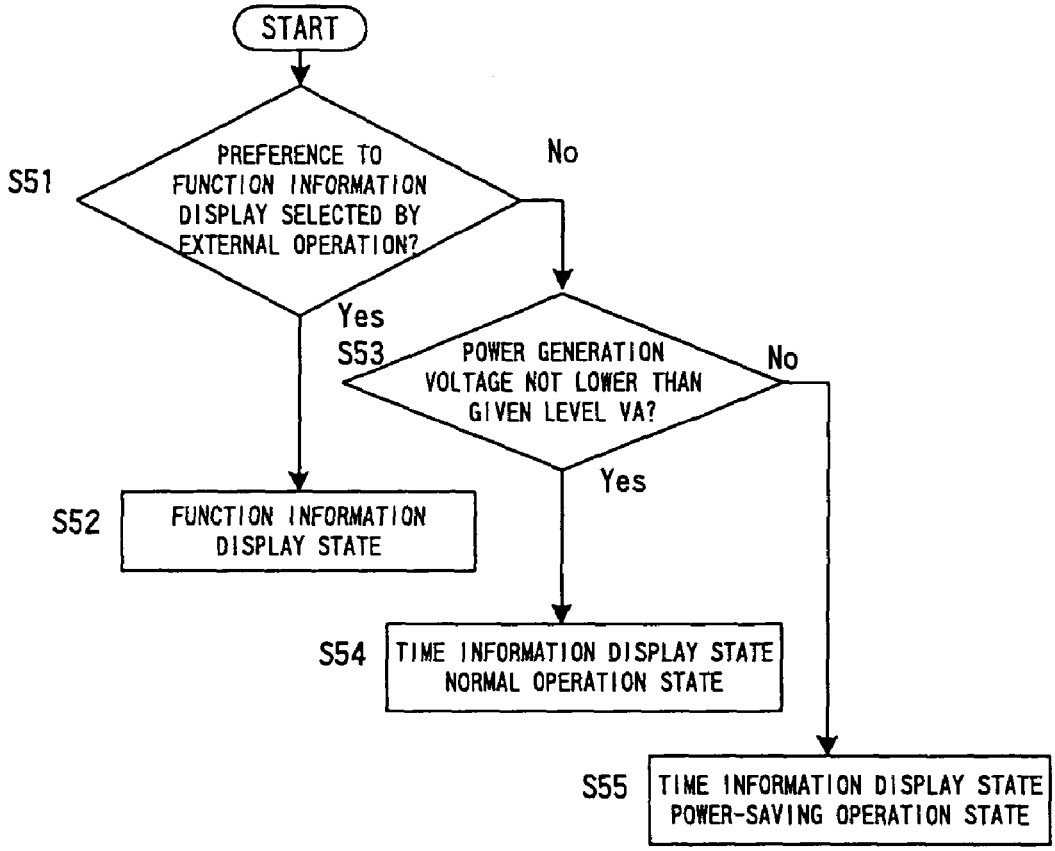
FIG. 26 is a flowchart illustrating operation in the fifth selection mode of the electronic timepiece.
Figure 27:
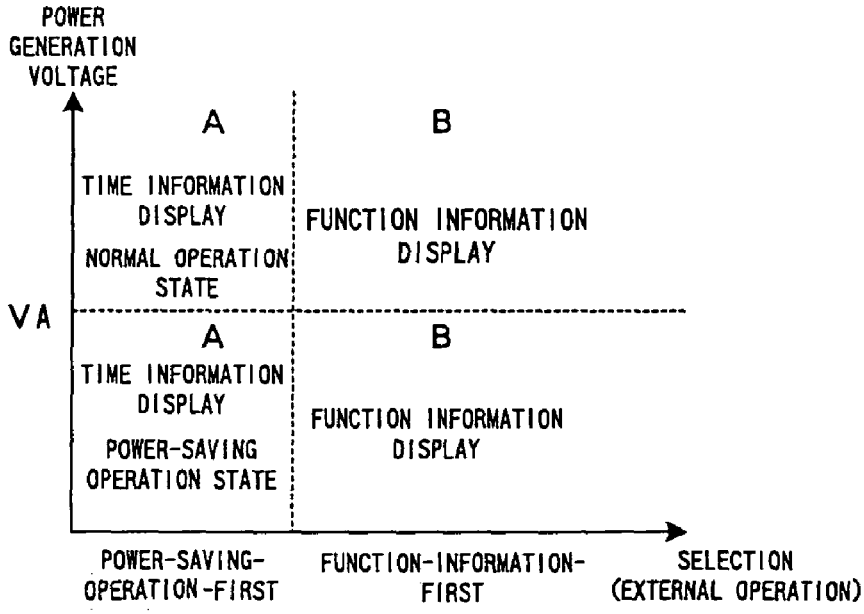
FIG. 27 is an external operation selection and voltage diagram illustrating the operation in the fifth selection mode of the electronic timepiece.

FIG. 26 is a flowchart showing an example of the procedure of selecting operation according to the fifth selection mode, and FIG. 27 is a diagram for illustrating the external operation and selecting operation for the power generating voltage.

A level VA to determine whether or not to perform power-saving operation is settled in advance for the power generating voltage.

First, the selection of preference to function information by external operation means is detected (Step S51). If the preference to function information is selected (Step S51), the function information is displayed (Step S52). If the preference to function information is not selected (Step S51), on the other hand, the power generating voltage is compared with the level VA (Step S52). If the comparison with the level VA indicates that the power generating voltage is not lower than the level VA (Step S53), the time information is displayed in the normal operation state (Step S54). If the power generating voltage is lower than the level VA (Step S53), the time information is displayed in the power-saving operation state (Step S55).

In FIG. 27, symbols A and B designate terminals that are selected by a selector 90*b* of FIG. 25. The terminal B is selected when the function information is displayed, and the terminal A is selected when the time information is displayed (normal operation state and power-saving operation state).

The selection of the functional operation and the power-saving operation in response to the external operation according to the fifth selection mode can be combined with the first to fourth selection modes. The priority between the fifth selection mode based on the external operation and the first to fourth selection modes can be set by separate selecting means.

Figure 28:
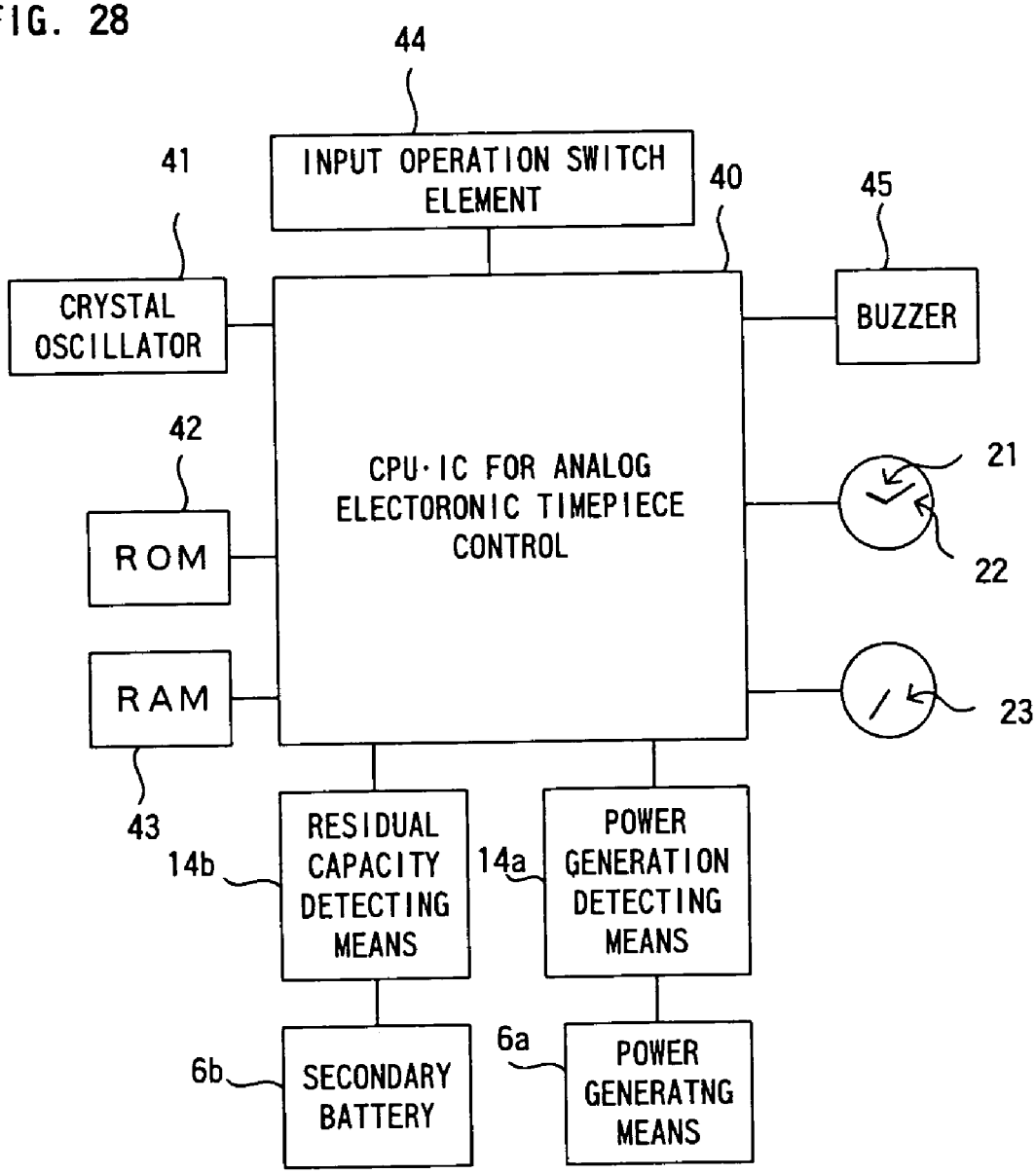
FIG. 28 is a diagram showing a block configuration example of the electronic timepiece to be realized by software.

As described in connection with the foregoing configurations, the electronic timepiece of the present embodiment may be composed of hardware or software. FIG. 28 is a diagram showing a configuration example of the electronic timepiece of the present embodiment based on software. In FIG. 28, the individual functions the electronic circuit 20 in each of the foregoing configuration examples performs can be composed of a CPU•IC 40 for analog electronic timepiece control, ROM 42, and RAM 43. The ROM 42 is loaded with a program for generating time information, a program for generating function information, a program for performing preferential operation selection, and a program for realizing the functions of other electronic timepieces. Further, the CPU•IC 40 for analog electronic timepiece control has an oscillator circuit therein, and forms clock signals by using the output of a crystal oscillator 41.

The CPU•IC 40 for analog electronic timepiece control is connected with the power generation detecting means 14*a* for detecting the state of power generation of the power generating means 6*a*, the residual capacity detecting means 14*b* for detecting the residual capacity by detecting the voltage of the secondary battery 6*b* or the like, and an input operation switch element 44 for inputting various operations and selection for the electronic timepiece, and detection signals, control signal and selection signal are inputted to the CPU•IC 40 for analog electronic timepiece control. Further, the CPU•IC 40 for analog electronic timepiece control is connected with a buzzer 45, hour hand 21, minute hand 22 and second hand 23, and displays the time information and function information. Besides the hour hand 21, minute hand 22, and second hand 23, liquid crystal display means may be used as the display means.

Figure 29:
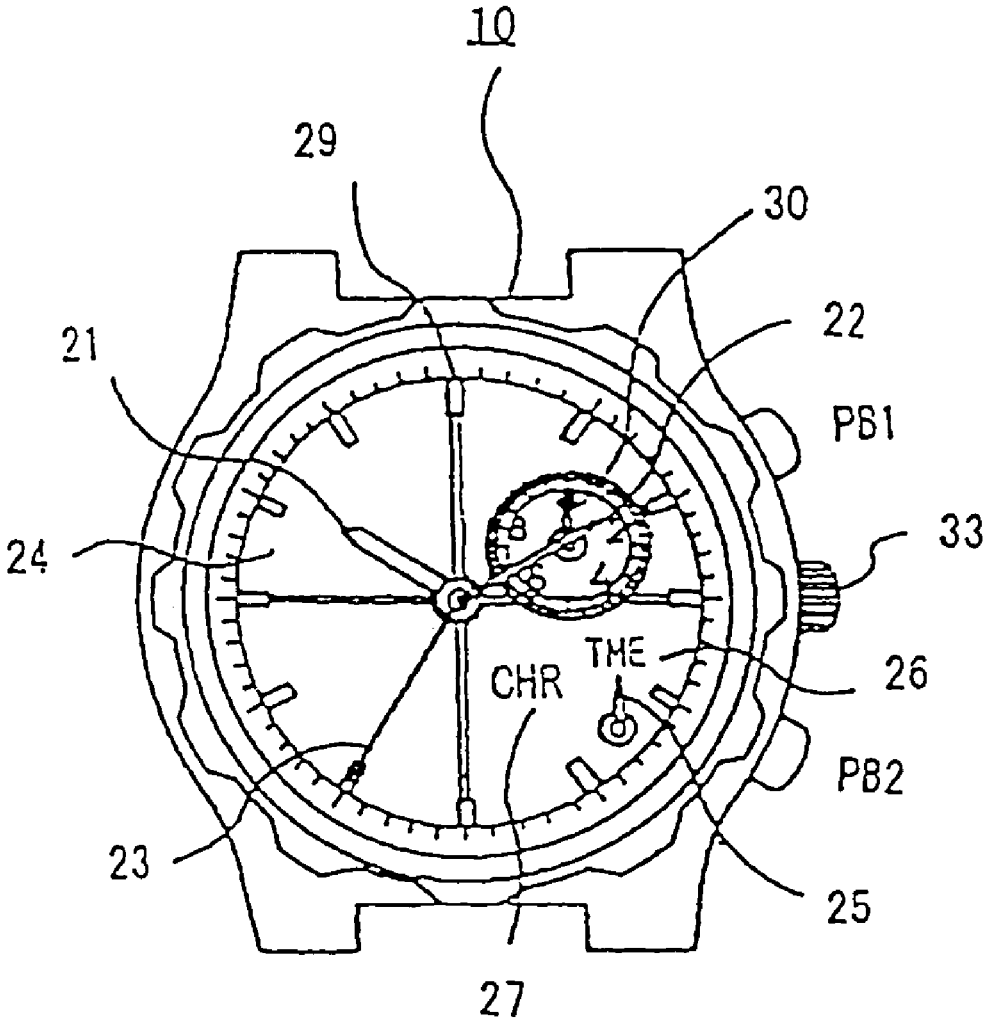
FIG. 29 is an external front view of the electronic timepiece according to the present embodiment.

FIG. 29 shows a configuration example of the electronic timepiece 10 according to the present embodiment.

This electronic timepiece has a dial plate 24 for ordinary time information display and a minute hand 30 for chronographic display, as well as the hour and minute hands 21 and 22 and the second hand 23. In this example, the second hand 23 serves also as a chronographic second hand for chronographic display.

Further, this configuration example is provided with a mode display hand 25, and different functions can be set depending on the position of the mode display hand 25. In this configuration example, the mode display hand 25 can be shifted between two different positions, a time information display position (TME) 26 for displaying normal time information and a chronographic display position (CHR) 27 for executing a chronographic display function, and can be moved to the position TME 26 or CHR 27 by operating a stem 33.

Thus, if the mode display hand 25 is set in the time information display position (TME) 26, according to the present configuration example, the hour and minute hands 21 and 22 and the second hand 23 individually indicate the current time. If the mode display hand 25 is set in the chronographic display position (CHR) 27, on the other hand, the hour and minute hands 21 and 22 indicate the hour and minute, respectively, of the current time, and when a starting operation is carried out after shift to a chronographic mode at the set point of time, the chronographic display function is started, so that the second hand 23 indicates the chronographic second, and along with the chronographic minute hand 30, indicates the chronographic time.

If the requirements for the power-saving operation state are detected when the mode display hand 25 is set in the time information display position (TME) 26 or the chronographic display position (CHR) 27, the second hand 23 is moved to a power-saving position 29 (e.g., position for 0 second) automatically or with the user's depression of a button PB1 or PB2, thereby indicating that the electronic timepiece 10 is set in the power-saving operation state.

The power-saving operation state can be canceled by automatic processing based on a detection signal for detecting the failure to fulfill the requirements for the power-saving operation state or manual operation in which the specific button PB1 or PB2 on the electronic timepiece is depressed.

The functions of the electronic timepiece include an alarm function, chronographic display function, calendar function, sounding function, and altitude measuring function. In the case where the electronic timepiece is a rechargeable, generator-type electronic timepiece having power generating means such as a solar cell, in particular, moreover, the function information of the present invention further includes time adjustment warning function information for warning of wrong time indication when the electronic timepiece undercharged and temporarily stopped is restarted by recharge, charge warning function information or a warning for prompting charge, and residue warning function information for indicating the residual capacity of the secondary battery or accumulator for use as accumulator means. In the case where the power generating means is a solar cell, in particular, if the power-saving state is given priority after the darkened ambiance of the watch is detected, then the ambiance is too dark to sight the display and visually recognize the aforesaid warning information, anyway. It is very reasonable, therefore, to stop the display means in the power-saving state.

In the case where the power generating means is of the self-winding or thermal generator type, moreover, the darkness of the ambiance of the watch and the performance of power generation are independent of each other, and the aforesaid circumstances do not apply to this case. Naturally, the same effect can be obtained with use of any other power generating means than a solar cell only if it is provided with a sensor for detecting the darkness of the ambiance of the watch.

As described above, the electronic timepiece according to the first embodiment and the driving method for the electronic timepiece use the foregoing technical configurations. In the field of multifunctional electronic timepieces that can provide many kinds of additional function information, therefore, there may be easily realized an electronic timepiece with high commercial value that is configured to be able to use the power-saving mode and the function information operation state mode separately and a driving method for the electronic timepiece. Thus, the power-saving mode and the function information operation state mode can be selected and preferentially controlled.

An outline of a second embodiment of the present invention will now be described with reference to FIGS. 30A to 45.

An electronic timepiece according to the present embodiment comprises means for giving priority to a power-saving operation state, functional operation state, or warning operation state. Even if the power-saving operation state, functional operation state, and warning operation state for display means are competitive, any one of the power-saving operation state, functional operation state and warning operation state is adopted according to priority.

More specifically, the present embodiment is configured to give priority to any one of the power-saving operation state, functional operation state and warning operation state according to circumstances by selection by preferential operation selecting means.

Figure 30A:
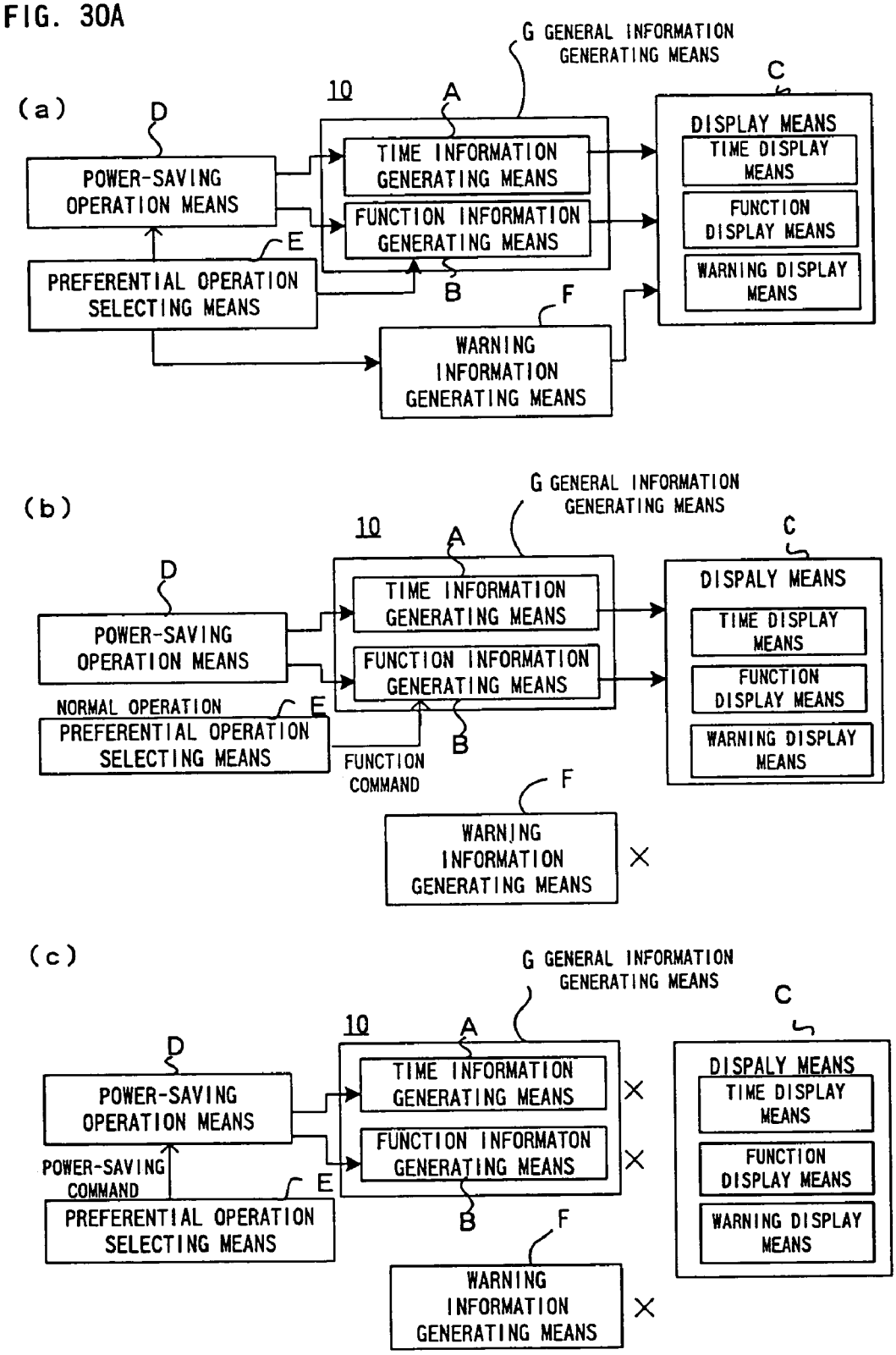
FIGS. 30A(a)–30A(c) and 30B(d)–30B(f) are diagrams for illustrating examples of operation of a second embodiment of the electronic timepiece according to the present invention.
Figure 30B:
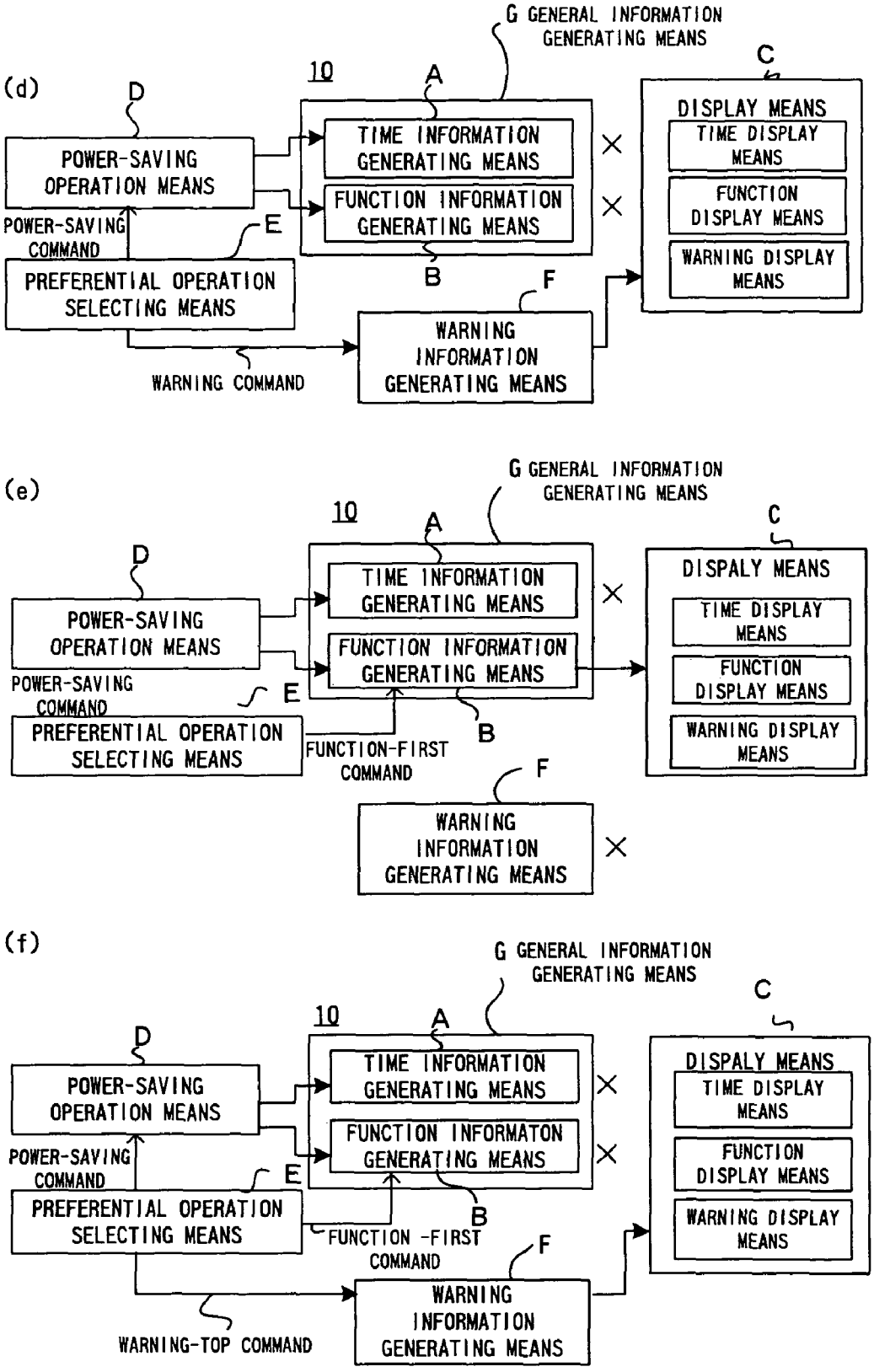

FIGS. 30A and 30B are diagrams for illustrating several means of the electronic timepiece of the present embodiment and their operations. In FIGS. 30A and 30B, any one of the power-saving operation state, functional operation state and warning operation state is given priority by selecting and operating power-saving operation means, function information generating means, or warning information generating means by the preferential operation selecting means.

The electronic timepiece according to the present embodiment will now be described with reference to FIGS. 30A and 30B.

In FIG. 30A(a), an electronic timepiece 10 comprises time information generating means A for generating time information, function information generating means B for generating function information on additional functions, such as a chronographic measuring function, timer function, alarm function, sounding function, altitude measuring function, time radio-wave modifying function, computer function, etc., warning information generating means F for generating warning information such as a charge warning, residue warning, time adjustment warning, etc., display means C capable of alternatively displaying the time information, function information, or warning information, power-saving operation means D for operation in the power-saving operation state that entails lower power consumption than a normal operation state, and preferential operation selecting means E for giving priority to the function information generating means B, warning information generating means F, or power-saving operation means D. The time information generating means A and the function information generating means B, which generate the time information and the function information, which are general information, constitute general information generating means G.

In the normal operation state, as shown in FIG. 30A(b), the preferential operation selecting means E gives priority to neither the function information generating means B, nor the power-saving operation means D, nor the warning information generating means F, and the display means C continually displays the time information. If a function command for the selective use of the function information is given, it is displayed on the display means C.

On the other hand, the display of the time information, function information, and warning information is stopped if neither the function command nor a warning command which is an operation command directing to the warning information generating means F is given with a power-saving command given to the power-saving operation means D by the preferential operation selecting means E, as shown in FIG. 30A(c).

FIG. 30B(d) shows the case where the warning command is given in the presence of the power-saving command for ordering the power-saving operation. A warning display state is given priority over the power-saving state under the control of the preferential operation selecting means E, and the display means C is brought to the warning display state. In display stop operation for the time information, moreover, counting the time information can be continued.

If the function information generating means B is given priority by a function-first command from the preferential operation selecting means E, as shown in FIG. 30B(e), furthermore, the display of the function information is given priority over the power-saving operation.

FIG. 30B(f) shows a state in which the warning command is given as a warning-first command with the function-first command given from the preferential operation selecting means E. In this case, the warning display state is given priority over the function information display state that gives priority over the power-saving operation. Thus, the warning display is more important as display information on the watch than any other general information including the time information and the function information, and should be given the highest priority. As described with reference to FIG. 30B(d) or 30B(f), therefore, the display state for the warning information is given priority over the power-saving operation state and the function information display state. Thus, the electronic timepiece that displays the time information, function information, and warning information and has the power-saving operation state is made reasonable and easy to handle.

The following is a description of a specific configuration of the second embodiment.

Figure 31:
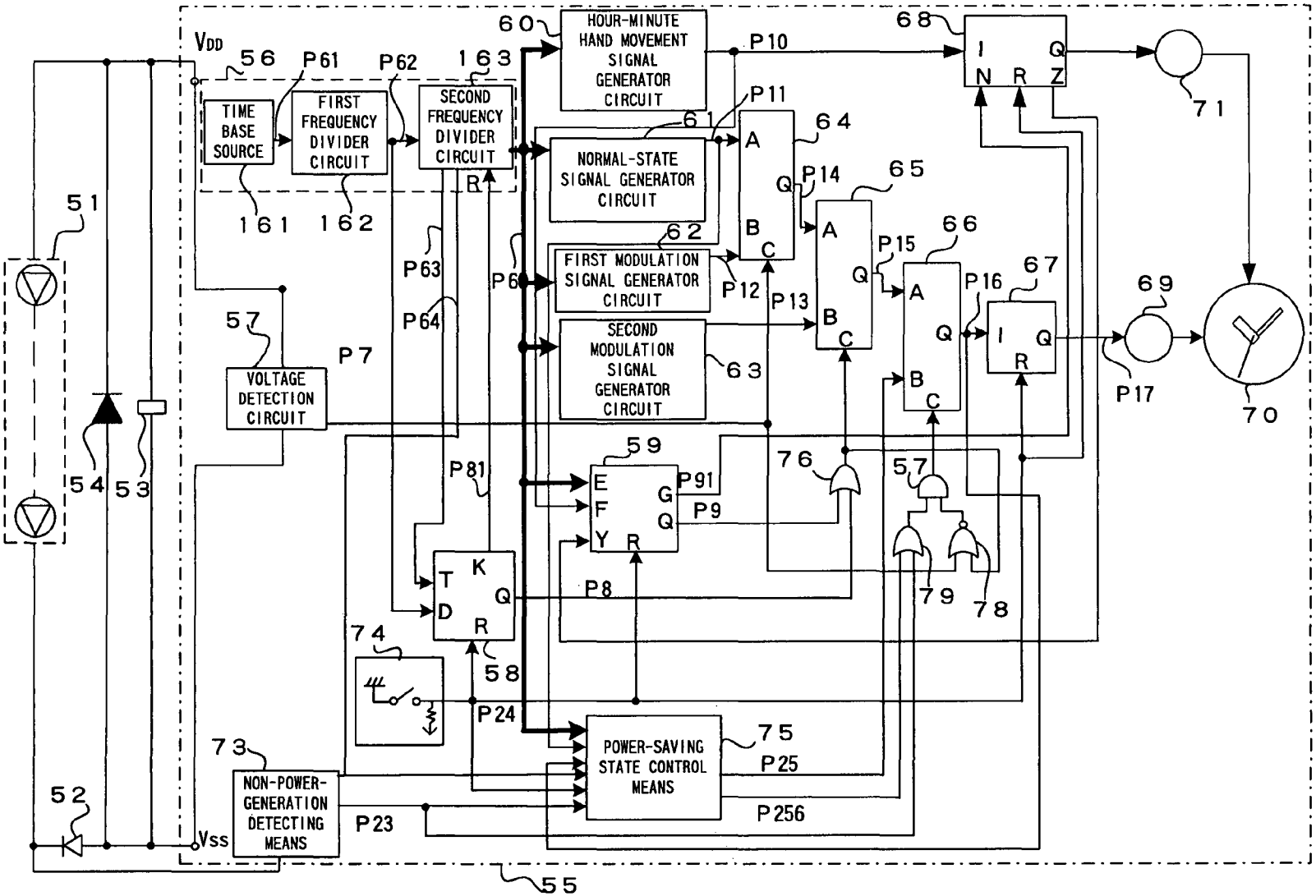
FIG. 31 is a block diagram showing the principal part of a first example of the second embodiment of the electronic timepiece according to the present invention.

FIG. 31 is a block diagram showing the principal part of an electronic timepiece of a second example. In FIG. 31, a power source is connected to an electronic timepiece 55. In this example, the power source is composed of power generating means 51, such as a solar cell, self-winding generator system, windup generator system, thermal generator means, or spring-type generator system, accumulator means 53, such as a high-capacity condenser or secondary battery, Zener diode 54 for use as overcharge preventing means, and diode 52 for preventing reverse-current charge. When light such as the sunlight is incident upon the solar cell 51, electricity is generated, the accumulator means 53 is charged through the diode 52, the charged voltage of the accumulator means 53 is applied to the electronic timepiece 55, and electric power is applied to the electronic timepiece 55.

Numeral 56 denotes a reference signal generator circuit, which outputs a group of reference signals P6 (including a plurality of pulses with different periods divided from a time base source 161). Numeral 60 denotes an hour-minute hand movement signal generator circuit, which outputs a twenty-second-step pulse signal P10 that causes hour and minute hands to rotate so that the minute hand makes two revolutions (and the hour hand makes a ⅙ revolution) for each twenty seconds, in the normal operation state, and causes a second motor drive circuit 68 to drive a second pulse motor 71, thereby driving the minute and hour hands of a display unit 70. Numeral 61 denotes a normal signal generator circuit of the watch for use as means for generating general information, and outputs a one-second-step pulse P11 (accurate time information signal) as a normal second-hand movement signal in the normal operation state. Although the time information is given as an example of the general information in the present embodiment, the general information also include function information, such as chronographic information, timer information, alarm function information, etc., which are added to the watch. The output of the normal signal generator circuit 61 is applied to an A-input terminal of a first selection circuit 64 for use as a selector. (A selector described herein is a control circuit designed so that the input applied to its A-input terminal is selected and delivered to its Q-terminal when an input to its C-terminal is at "L" level and that the input to its B-input terminal is selected and delivered to the Q-terminal when the input to the C-terminal is at "H" level, and the following selectors are control circuits having the same functions.)

Numeral 62 denotes a first modulation signal generator circuit, which generates a charge warning signal for urging the user to establish a state where the watch is charged (e.g., light is applied in the case of the watch that has the solar cell as charging means or the watch is carried around and vibrated in the case of the watch of the self-winding generator type). This signal is a two-second-step pulse P12 for two-second-step drive (e.g., pulse that generates a pair of driving pulses of a 40-ms duration at intervals of two seconds), and is originated and outputted in accordance with a specific reference signal P6. This output is applied to the B-input terminal of the first selection circuit 64. An output signal P14 from the Q-terminal of the first selection circuit 64 is either the one-second-step pulse P11 or the two-second-step pulse P12, which is applied to the A-input terminal of a second selection circuit 65 for use as a selector.

In a first example of the present embodiment, the hour-minute hand movement signal generator circuit 60 and the normal signal generator circuit 61, which output accurate time information signals, constitute general information generating means.

Numeral 63 denotes a second modulation signal generator circuit, which generates a run-down state warning signal P13 that informs the user that the watch is run-down. This run-down state warning signal P13 is an irregular two-second-step pulse P13 that is modulated for an irregular speed different from that of the two-second-step pulse P12 based on the output of the first modulation signal output circuit (e.g., pulse that alternately generates driving pulses of a 40-ms duration and driving pulses of a 250-ms duration at intervals of two seconds), and is originated and outputted in accordance with the specific reference signal P6. This output is applied to the B-input terminal of the second selection circuit 65, and the Q-output signal P14 of the first selection circuit 64 is applied to the A-input terminal. A Q-output signal P15 of the second selection circuit 65 is applied to the A-input terminal of a third selection circuit 66 for use as a selector. The first modulation signal generator circuit 62 and the second modulation signal generator circuit 63 constitute warning information generating means in this example.

Further, an output signal P25 from power-saving state control means 75 (mentioned later) is applied to the B-input terminal of the third selection circuit 66, and an output signal P16 from the Q-terminal of the third selection circuit 66 is applied to an I-terminal of a first motor drive circuit 67 for driving the second hand of the watch.

The first motor drive circuit 67 converts the driving signal applied to its I-terminal into a bipolar driving pulse P17 that suits a double-pole pulse motor, outputs it through its Q-terminal, and drives a first pulse motor 69. Besides, it is provided with a reset input terminal R for fixing an operation that corresponds to a time adjustment state when an external-operation switch, e.g., the stem, of the watch is pulled. The first pulse motor 69 is a conventional pulse motor that has a permanent magnet rotor that is magnetized for two poles. Numeral 70 denotes a display device that displays the time and the like, and the second hand of the display device 70 is driven by the first pulse motor 69.

Numeral 57 denotes a voltage detection circuit for detecting an undercharged state. If the supply voltage of the accumulator means 53 is lowered so that the normal working state of the watch changes into a state that requires charge, an output signal P7 is delivered at "L" level in a state where the supply voltage is higher than a reference voltage V1 that urges the user to establish the state for the charge of the watch. This output is a C-terminal input of the first selection circuit 64, and the first selection circuit 64 selects the A-input terminal and outputs the one-second-step pulse P11 for the normal state through its Q-terminal. If the voltage drops and becomes lower than the reference voltage V1, however, the detection signal P7 turns to "H" level. Thereupon, the two-second-step pulse P12 of the B-input is selectively outputted, in place of the one-second-step pulse P11, from the Q-terminal of the first selection circuit 64.

A reference signal stop storage circuit 58 uses a 512-Hz output signal P62 of a first frequency divider circuit 162 of the reference signal generator circuit 56 and a ½-Hz output signal P63 of a second frequency divider circuit 163 to monitor oscillating operation of the time base 161 of the reference signal generator circuit 6. If the oscillation stops, a stop detection signal P81 is outputted from a K-terminal, and the second frequency divider circuit 163 is reset. The reference signal stop storage circuit 8 is stored with the stoppage of the oscillation. If the supply voltage is recovered thereafter to restore the oscillation, a reference signal stop storage signal P8 of "H" level is then outputted. When this signal P8 is applied to the C-terminal of the second selection circuit 65 through an OR gate 126, the irregular two-second-step pulse P13, which is a run-down state warning signal, is selected as the signal P15. This reference signal stop storage signal P8 is reset at "L" level when a reset signal is applied to an R-terminal of the reference signal stop storage circuit 58. Since the details of the reference signal stop storage circuit 8 are generally known, a detailed description of them is omitted (see Japanese Patent Application Laid-Open No. 62-194484 and the like for details).

A pulse motor stop storage circuit 59 can observe time-based change of induced voltage that is generated in a coil by residual vibration in a rotor and determines whether or not the rotor is rotated normally or is not rotated, immediately after the twenty-second-step pulse signal P10 is given to the second motor drive circuit 68 that monitors the detection of normal operation of the second pulse motor 71 by transmitting to or receiving signals from the second motor drive circuit 68. The pulse motor stop storage circuit 59 receives the twenty-second-step pulse signal P10 from the hour-minute hand movement signal generator circuit 60 at its F-terminal, originates some strobe signals P91 for fetching induced voltage with given timing based on the reference signal P6 applied to its E-terminal, and delivers them through its G-terminal to an N-terminal of the second motor drive circuit 68. The second motor drive circuit 68 outputs a series of induced voltage signals for induced voltage values for individual instants, and returns them to a Y-terminal of the pulse motor stop storage circuit 59. If it is determined in accordance with the induced voltage signals that the rotor is not rotated, the determination is stored. When the rotation of the second pulse motor 21 is stopped, a pulse motor stop storage signal P9 of "H" level is delivered to an output terminal Q. The signal P9 is applied to one terminal of the OR gate 126. As mentioned before, the reference signal stop storage signal P8 of the reference signal stop storage circuit 58 is applied to the other input terminal of the OR gate 126. The output of the OR gate 126 is applied to the C-terminal of the second selection circuit 65 and an OR gate 128. This pulse motor stop storage circuit 59 is also a conventional one, and a detailed description of its configuration is omitted (see Japanese Patent Application Laid-Open No. 62-194484 and the like for details).

Numeral 74 denotes a manual switch circuit, which changes the state by an external-operation switch or by pushing or pulling a stem. When the stem is pulled, for example, a reset signal P24 of "H" level is outputted. The reset signal P24 is applied to the reference signal stop storage circuit 58, the pulse motor stop storage circuit 59, and the respective reset terminals R of the first and second motor drive circuits 67 and 68, and moreover, to the power-saving state control means 75. In response to the reset signal P24, these circuits are restored their respective initial logical states, and the memories of the reference signals and the stoppage of the motor are erased. Manual hand alignment or the like is carried out on the display with the supply voltage of the accumulator means 53 in its normal state, and the stem is pushed in thereafter. Thereupon, the reset circuits are released together from restriction, and the watch operation starts from its initial state.

Non-power-generating state detecting means 73, which detects the power generating state of the power generating means 51, delivers an output signal P23 of "H" level when a non-power-generating state lasts for a preset time.

Figure 32:
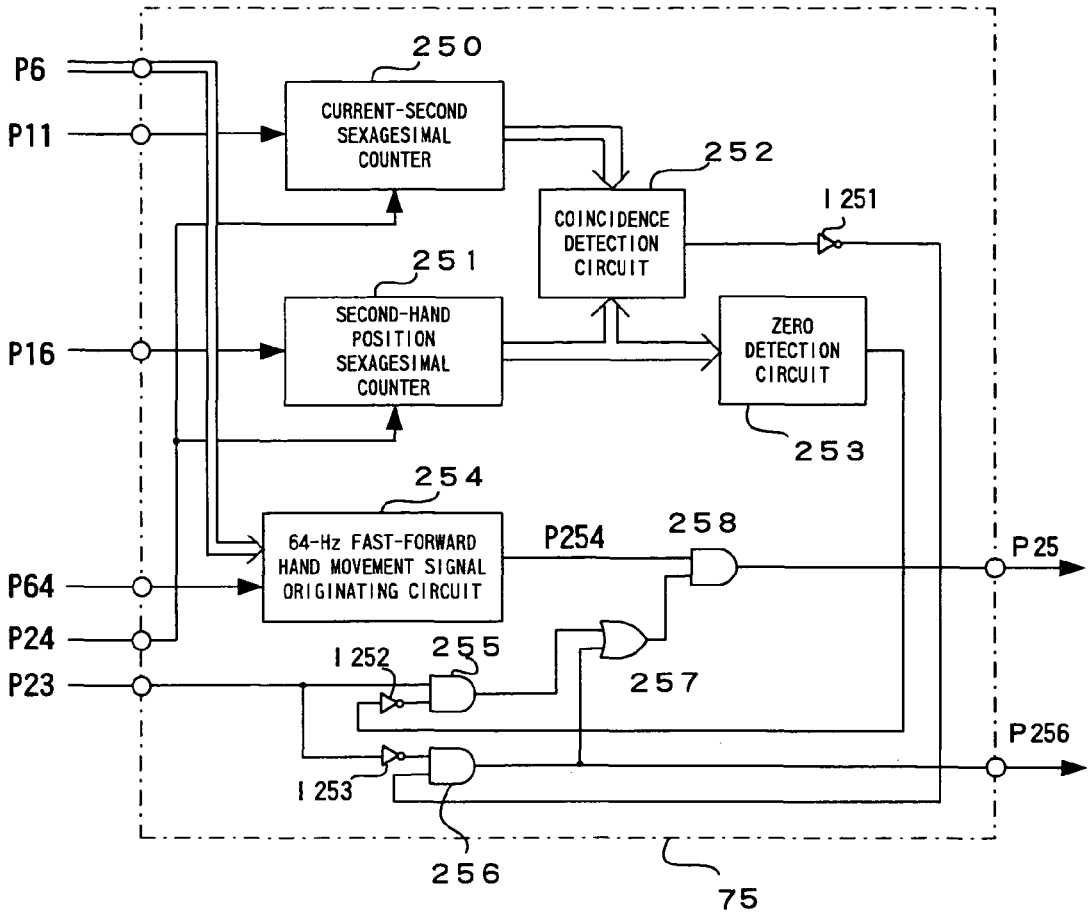
FIG. 32 is a detailed block diagram of power-saving state control means of the electronic timepiece of FIG. 31.
Figure 33:
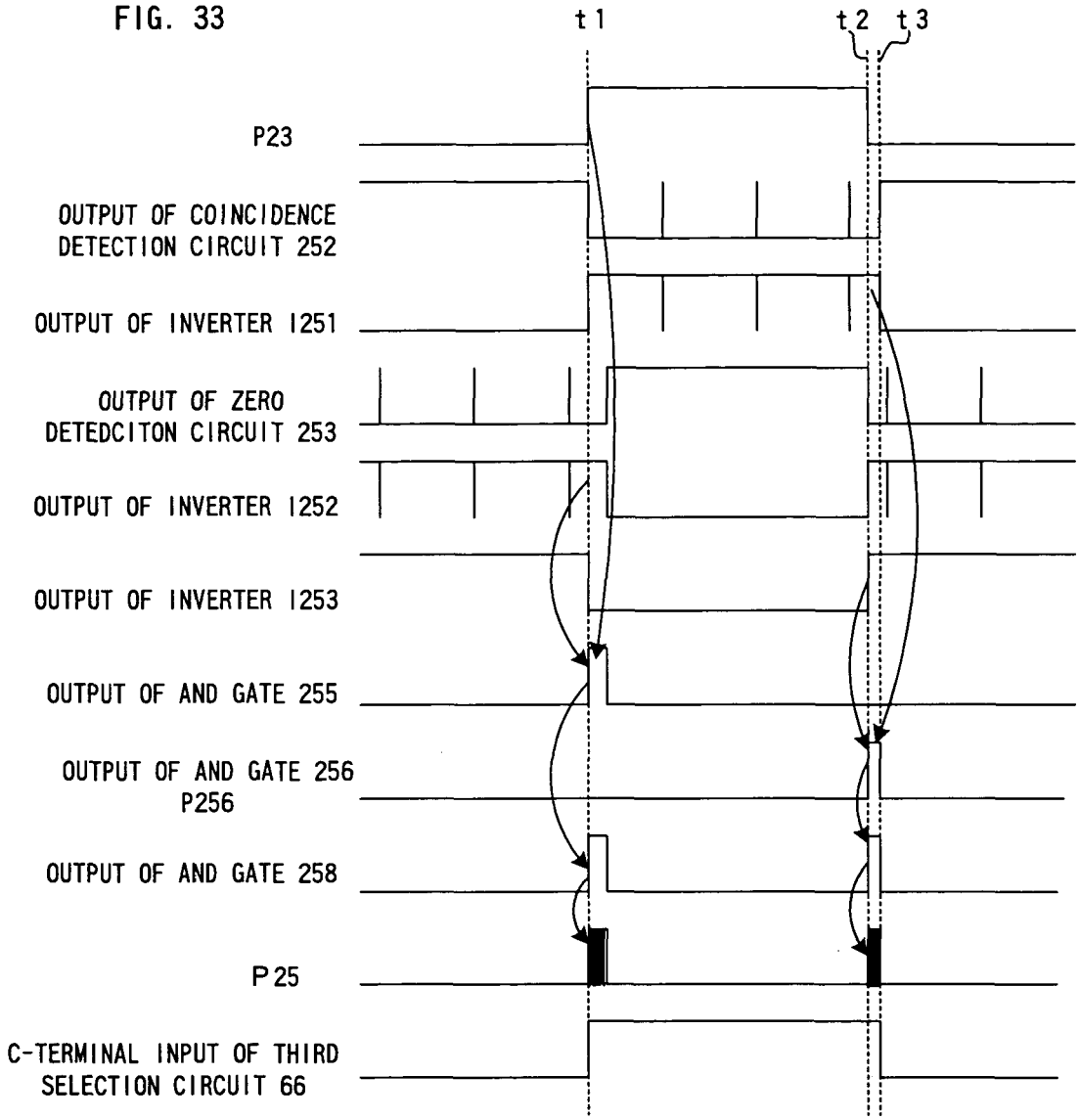
FIG. 33 is a timing chart showing the operation timing of the power-saving state control means.

FIG. 32 is a detailed block diagram of the power-saving state control means 75. The reference signal P6 from the reference signal generator circuit 56 is applied to a 64-Hz fast-forward hand movement signal originating circuit 254. The output signal P11 of the normal-state signal generator circuit 61 is applied to a current-second sexagesimal counter 250. The output signal P16 from the Q-terminal of the third selection circuit 66 is applied to a second-hand position sexagesimal counter 251. Further, a signal P64 of 64 Hz from the second frequency divider circuit 162 of the reference signal generator circuit 6 is applied to the 64-Hz fast-forward hand movement signal originating circuit 254, whereupon a fast-forward pulse P254 is originated by also using the reference signal P6. Furthermore, the reset signal P24 from the manual switch circuit 74 is applied to the respective reset terminals of the current-second sexagesimal counter 250 and the second-hand position sexagesimal counter 251, and resets these counters. The output P23 of the non-power-generating state detecting means is applied to one terminal of an AND gate 255 and to one terminal of an AND gate 256 through an inverter I253. Count values in the current-second sexagesimal counter 250 and the second-hand position sexagesimal counter 251 are compared with each other in a coincidence detection circuit 252. If they are equal, an output signal of "H" level is delivered and applied to the other terminal of the AND gate 256 through an inverter I251. Further, a zero detection circuit 253 is provided that receives the output signal of the second-hand position sexagesimal counter 251 as its input and detects a zero count value of the second-hand position sexagesimal counter 251. If the zero detection circuit 253 detects zero, an output signal of "H" level is delivered and applied to the other terminal of the AND gate 255 through an inverter I252. The respective outputs of these two AND gates are applied to an input terminal of an AND gate 258 through an OR gate 257, while the fast-forward pulse P254 from the 64-Hz fast-forward hand movement signal originating circuit 254 is applied to the other terminal. The output of the AND gate 258 is applied as the output signal P25 of the power-saving state control means to the B-input terminal of the third selection circuit 66. An output signal P256 of the AND gate 256 is delivered from the power-saving state control means 75 to an OR gate 129. The output signal P23 of the non-power-generating state detecting means 73 is applied to the other terminal of the OR gate 129. The output of the OR gate 129 is applied to an AND gate 127, and the output of the NOR gate 128 is applied to the other terminal of the AND gate 127. Further, the output signal P7 of the voltage detection circuit 57 and the output signal of the OR gate 126 are applied to the NOR gate 128. Furthermore, the output of the AND gate 127 is applied to the C-terminal of the third selection circuit.

The following is a description of the operation of this example. First, the voltage of the accumulator means 53 is not lower than the reference voltage, and the voltage detection signal P7 of "L" level is delivered from the voltage detection circuit 7, and the power generating means 1 is generating power. The output signal P23 of the non-power-generating state detecting means 73 indicates that electricity is being generated when it is at "L" level. In this normal state, the hour-minute hand movement signal generator circuit 60 outputs the twenty-second-step pulse signal P10 that drives the minute and hour hands in accordance with the reference signal P6 from the reference signal generator circuit 56, and the second motor drive circuit 68 drives the second pulse motor 71, thereby driving the hour and minute hands of the display device 70 to display the current hour and minute. Since the output signal P7 of the voltage detection circuit 7 is at "L" level, on the other hand, an "L" level signal is applied to the C-terminal of the first selection circuit 64, whereupon the A-input terminal is selected. Since both the reference signal stop storage signal P8, which is an output signal of the reference signal stop storage circuit 58, and the pulse motor stop storage signal P9 from the pulse motor stop storage circuit 59 are at "L" level in the normal state, the output signal of the OR gate 126 is at "L" level, and an "L" level signal is applied to the C-terminal of the second selection circuit 65, whereupon the A-input terminal is selected.

When the power generating means 51 is generating power, moreover, the output signal P23 of the non-power-generating state detecting means 73 is at "L" level, and the output signal P256 from the AND gate 256 of the power-saving state control means 75 is also at "L" level, so that the output signal of the OR gate 129 is also at "L" level. In consequence, the output of the AND gate 127 turns to "L" level, so that an "L" level signal is applied to the C-terminal of the third selection circuit 66, whereupon the A-input terminal is selected. Accordingly, the one-second-step pulse P11, which is an output signal of the normal-state signal generator circuit 61, is applied as the signal P16 to the I-terminal of the first motor drive circuit 67 through the respective A-input terminals and Q-terminals of the first, second, and third selection circuits 64, 65 and 66. The first pulse motor 69 is driven by the output signal P17 of the first motor drive circuit 67, and the second hand of the display device 70 is driven to tick the seconds as a normal one-second movement hand. Thus, the display device 70 performs the normal display of the hour, minute, second for the time.

If the non-power-generating state detecting means 73 detects that electricity is not generated for the preset time, and if the output signal P23 of the non-power-generating state detecting means 73 turns to "H" level, in this normal state, the respective outputs of the OR gate 129 and the AND gate 127 turn to "H" level. Since the "L" level voltage detection signal P7 from the voltage detection circuit 57 and the output signal of the OR gate 126 at "L" level are the inputs of the NOR gate 128, moreover, the output signal of the NOR gate 128 is at "H" level. If the output signal P23 of the non-power-generating state detecting means 73 turns to "H" level, as mentioned before, the output of the AND gate 127 delivered through the OR gate 129 turns to "H" level, so that the output signal of the AND gate 127 also turns to "H" level. In consequence, an "H" level is applied to the C-terminal of the third selecting means, so that the third selecting means 66 selects the B-terminal side. Since the voltage detection signal P7 and the output signal of the OR gate 126 are at "L" level, the first and second selecting means 64 and 65 select the A-input terminal side.

In the power-saving state control means 75 (see the operation timing chart of FIG. 33 for the power-saving state control means 75), on the other hand, the count value of the current-second sexagesimal counter 250 and the count value of the second-hand position sexagesimal counter 251 are equal in the normal state for power generation. Therefore, an "H" level signal is delivered from the coincidence detection circuit 252, and this signal is inverted and turned into an "L" level signal by the inverter I251 and applied to the AND gate 256. In consequence, the output signal P256 of the AND gate 256 is at "L" level. Since the "L" level signal P23 is delivered from the non-power-generating state detecting means 73 while electricity is being generated, moreover, the output of the AND gate 255 is at "L" level. In consequence, the output of the OR gate 257 is also at "L" level, and the AND gate 258 is closed, so that no output signal is delivered from the AND gate 258. Thus, no output is delivered from the power-saving state control means 75.

If the non-power-generating state detecting means 73 detects that the power generation is stopped for the preset time and outputs the "H" level signal P23, therefore, the AND gate 255 outputs an "H" level signal unless the count value of the second-hand position sexagesimal counter 251 is "0".

The reason is that if the zero detection circuit 253 detects that the count value of the second-hand position sexagesimal counter 251 is not "0", an "L" level signal is delivered from the zero detection circuit 253, and inverted and turned to "H" level by the inverter I252 and applied to the AND gate 255. Therefore, both of the two inputs of the AND gate 255 are at "H" level, so that an "H" level output signal is delivered from the AND gate 255.

Since this "H" level signal is applied to the AND gate 258 through the OR gate 257, the AND gate 258 opens, whereupon the fast-forward pulse p254 originated in the 64-Hz fast-forward hand movement signal originating circuit 254 is outputted as the output signal P25 of the power-saving state control means 75. This signal P25 is applied to the B-terminal of the third selection circuit 66. In the state where power generation is stopped, as mentioned before, the B-terminal of the third selection circuit 66 is selected, so that the fast-forward pulse P254 of the signal P25 is delivered as the signal P16 from the Q-terminal of the third selection circuit 66 and applied to the first motor drive circuit 67, whereupon the second hand is fast-forwarded.

Since the signal P16 from the Q-terminal of the third selection circuit 66 is applied to the second-hand position sexagesimal counter 251, moreover, the second-hand position sexagesimal counter 251 is also fast-forwarded at 64 Hz as it counts. If the zero detection circuit 253 detects that the count value of the counter 251 is "0", an "H" level signal is delivered from the zero detection circuit 253 and inverted by the inverter I252, and the input of the AND gate 255 turns to "L" level. Accordingly, the output of the AND gate 255 also turns to "L" level, so that the AND gate 258 is closed, whereupon the fast-forward pulse p254 ceases to be outputted as the output signal P25. In consequence, the second hand stops at a position "0" (upright position). Although the position "0" is used in this example, the second hand may be stopped in any desired position. This is because it is necessary only that power be saved by stopping the second hand. In many cases, however, the second hand is stopped at the position "0", since the stoppage of the second hand at the position "0" is accustomed to serve also for power-saving mode display. When power generation is not restarted with the second hand stopped at the position "0", the output signal P23 of the non-power-generating state detecting means 73 is at "H" level, and this signal is inverted by the inverter I253 so that an "L" level signal is inputted. Accordingly, the output signal P256 of the AND gate 256 is at "L" level. Since an "H" level signal is delivered from the zero detection circuit 253, moreover, it is inverted by the inverter I252 and applied to the AND gate 255, so that its output signal is "L", therefore, the input of the AND gate 258 from the OR gate 257 is at "L" level, so that the gate is closed. In this state, the output signal P25 of the power-saving state control means 75 is not outputted at all. Thus, the second hand is stopped at the position "0" and never moves unless power generation is restarted. Since the second hand is not driven, energy consumption can be saved to maintain the power-saving state.

When the movement of the second hand is stopped to maintain the power-saving state in this manner, the current-second sexagesimal counter 250 counts the one-second-step pulse P11. However, the second position sexagesimal counter, receiving no input, is set at zero. Every time the count value of the current-second sexagesimal counter 250 becomes "0", an "H" level signal is delivered from the coincidence detection circuit 252 for the counting period, while an "L" level signal is outputted in any other sections. Thus, an "L" level signal is outputted normally. The signal applied to the AND gate 256 via the inverter I251 is normally an "H" level signal in any other sections than the section in which the count value of the current-second sexagesimal counter 250 is "0".

If power generation is restarted so that the output signal P23 of the non-power-generating state detecting means 73 turns to "L" level, an "H" level signal inverted by the inverter I253 is applied to the AND gate 256. Therefore, the "H" level signal P256 is delivered from the AND gate 256 in any other sections than the section in which the count value of the counter 250 is "0". In response to this signal, the AND gate 258 is opened through the OR gate 257, and the fast-forward signal P254 from the 64-Hz fast-forward hand movement signal originating circuit 254 is outputted as the signal P25. Since the signal P25 is applied to the second-hand position sexagesimal counter 251, the counter 251 is fast-forwarded at 64 Hz as it counts. If the resulting count value is equal to the count value of the current-second sexagesimal counter 250, an "H" level signal is delivered from the coincidence detection circuit 252, and an "L" level signal is applied to the AND gate 256 via the inverter I251, so that the output P256 of the AND gate 256 turns to "L" level. Thereupon, the AND gate 258 is closed, and the signal P25 ceases to be outputted. Thus, the fast-forward signal P254 is delivered as the signal P25 from the power-saving state control means 75 during the time interval that elapses from the instant that power generation is restarted until the second hand is moved to the position indicated by the count value of the current-second sexagesimal counter 250.

Even if the output signal P23 of the non-power-generating state detecting means 73 turns to "L" level as power generation is restarted, on the other hand, the output of the AND gate 127 is kept at "H" level by the "H" level output signal P256 of the AND gate 256 that is applied to the OR gate 129, and is applied to the C-terminal of the third selection circuit. If the output signal P23 of the non-power-generating state detecting means 73 turns to "L" level, therefore, the output of the C-terminal is kept at "H" level. Thus, the third selection circuit 66 selects the B-terminal side until the signal P256 turns to "L" level, that is, until the second hand is fast-forwarded at 64 Hz to the position indicated by the count value of the current-second sexagesimal counter 250, and delivers the fast-forward signal P254 through its Q-terminal. Thereupon, the first pulse motor 69 is driven by the first motor drive circuit 67 to fast-forward the second hand. When the second hand moves to the position indicated by the count value of the current-second sexagesimal counter 250, the output signal P256 of the AND gate 256 turns to "L" level, so that the input of the C-terminal turns to "L" level. Thereupon, the third selection circuit 66 selects the A-terminal and delivers through its Q-terminal the one-second-step pulse P11, which is an output signal of the normal signal generator circuit 61, which is delivered through the respective A-input terminals and Q-terminals of the first and second selection circuits 64 and 65, thereby restoring the second hand to the normal state of movement.

In the process of operation described above, the non-power-generating state is detected when the watch is performing the normal operation with the voltage of the accumulator means 53 not lower than the given voltage, and the power-saving state is entered. As power generation is restarted, the power-saving state is canceled, and the normal watch display is restored.

The following is a description of charge warning information display operation to be performed when the voltage of the accumulator means 53 is lower than the given voltage.

If the voltage of the accumulator means 53 falls below the given voltage, the output signal P7 of the voltage detection circuit 7 turns to "H" level. Thereupon, the input of the C-terminal of the first selection circuit 64 turns to "H" level, so that the first selection circuit 64 selects the B-terminal and delivers the two-second-step pulse signal P12 from the first modulation signal generator circuit 62 through its Q-terminal. The inputs applied to the respective C-terminals of the second and third selection circuits 65 and 66 are at "L" level, and the A-input terminal is selected. Accordingly, the two-second-step pulse signal P12 from the first modulation signal generator circuit 62 is applied to the first motor drive circuit 67, and the first pulse motor 69 is driven by the two-second-step pulse P12 to move the second hand for two seconds, thereby giving a warning of charge. Thus, the two-second movement operation of the second hand serves as a warning to prompt charge to cope with the lowered voltage of the accumulator means 53.

Even if the "H" level signal P23, which indicates a non-power-generating state as power generation has not been carried out for a predetermined time, is delivered from the non-power-generating state detecting means 73 while the charge warning operation is being carried out, the output of the AND gate 127 is kept at "L" level without any change (because the "H" level output signal P7 of the voltage detection circuit 57 is applied to the NOR gate 128, so that the respective outputs of the NOR gate 128 and the AND gate 127 are at "L" level), and the third selection circuit 66 selects the A-terminal and outputs the two-second-step pulse P12, which is an output signal of the first modulation signal generator circuit 62, through its Q-terminal, thereby continuing the warning for prompting charge.

If the voltage detection circuit 57 detects a voltage not higher than the reference voltage such that its output signal P7 is at "H" level in a state where the "H" level signal P23, which indicates non-power-generating state, is delivered from the non-power-generating state detecting means 73 in the power-saving state, where the aforesaid second hand is stopped at the position "0", in contrast with this, the output of the NOR gate 128 turns to "L" level in response to the "H" level signal of the output signal P7, and the output of the AND gate 127 also turns to "L" level. Since the C-terminal of the third selection circuit 66 is turned to "L" level, therefore, the A-terminal is selected. Thus, the two-second-step pulse P12 or the output signal of the first modulation signal generator circuit 62 is applied to the first motor drive circuit 67 through the B-terminal and Q-terminal of the first selection circuit 64, the A-terminal and Q-terminal of the second selection circuit 65, and the A-terminal and Q-terminal of the third selection circuit, whereupon the operation of the second hand is switched over to two-second movement where the second hand is driven in accordance with the two-second-step pulse P12, thereby giving the warning to prompt charge.

Once the warning state to prompt charge is established in this manner, the charge warning display lasts even in the power-saving state. Even if it is detected that power has not been generated for the preset time in the charge warning display state, moreover, the charge warning display state is maintained without entering the power-saving state. Thus, warning is displayed with priority over the power-saving state.

The following is a description of the state priority relation between the power-saving state and a run-down state warning display state, warning information for a state where the watch must be adjusted to accurate time when the watch is restarted by recharge after the second pulse motor 71 or the reference signal generator circuit 56 is stopped.

If the voltage of the accumulator means 53 lowers so that the second pulse motor 71 is stopped, the pulse motor stop storage means 59 detects the stoppage of this pulse motor, whereupon it delivers the "H" level signal P9 from Q terminal. Even after the voltage of the accumulator means 3 is recovered so that the drive of the pulse motor is started, this signal P9 is kept at "H" level until the stem is pulled so that the reset signal P24 from the manual switch circuit 74 is outputted and reset. Further, the reference signal stop storage circuit 58 stores the fact that the operation of the reference signal generator circuit 56 is stopped. If the operation of the reference signal generator circuit 56, e.g., an oscillator of the time base source 161, is started again as the accumulator means 53 is recharged, the reference signal stop storage circuit 58 delivers the "H" level signal P8 through its Q-terminal, and is kept at "H" level until the stem is pulled so that the reset signal P24 from the manual switch circuit 74 is reset.

In consequence, after the second pulse motor 71 is stopped or the operation of reference signal generator circuit 56 is stopped (the pulse motor is also stopped in this operation stop state), the accumulator means 53 is recharged so that its voltage is recovered, and the operations of the reference signal generator circuit 56 and the pulse motor are recovered so that the watch starts operation. If the time display is wrong in a state where time adjustment has not been performed by pulling the stem, the "H" level signal P8 or P9 is delivered from the Q-terminal of the reference signal stop storage circuit 58 or the Q-terminal of the pulse motor stop storage circuit 59, and an "H" level signal is applied to the C-terminal of the second selection circuit 65 through the OR gate 126. Thereupon, the second selection circuit selects the B-terminal and delivers the modulated two-second-step pulse P13 or the output of the second modulation signal generator circuit 63 through its Q-terminal. Since the output of the OR gate 126 is at "H" level, moreover, the output of the NOR gate 128, which receives the output of the OR gate 126 as its input, turns to "L" level. Thereupon, the output of the AND gate 127 turns to "L" level, the C-terminal of the third selection circuit 66 is adjusted to "L" level, and the A-terminal is selected. In consequence, the modulated two-second-step pulse P13, which is an output of the second modulation signal generator circuit 63, is applied to the first motor drive circuit 67 through the B-terminal and Q-terminal of the second selection circuit and the A-terminal and Q-terminal of the third selection circuit 66.

While the second hand is being driven by the modulated two-second-step pulse P13, the time is wrong with a delay corresponding to the duration of the stoppage of the pulse motor or the reference signal. Accordingly, run-down state warning information, which is warning information that notifies the user of the necessity of time adjustment, is indicated by irregular two-second movement of the second hand. In the case where this run-down state warning information is displayed, the output of the OR gate 126 is at "H" level, the output of the NOR gate 128 is at "L" level, the output of the AND gate 127 is at "L" level, and the input of the C-terminal of the third selection circuit 66 is at "L" level. Accordingly, the A-terminal is selected, and the B-terminal is not selected, so that the mode cannot be switched over to the power-saving state. This is based on the power-saving state (i.e., state in which the input of the C-terminal of the third selection circuit 66 is at "H" level). In this state, the respective output signals P9 and P8 of the pulse motor stop storage circuit 59 and the reference signal stop storage circuit 8 turn to "H" level as the pulse motor or the operation of the reference signal generator circuit 56 is stopped, for example. Even if electricity is not generated for the preset time and if the "H" level signal 73 indicative of the non-power-generating state is delivered from the non-power-generating state detecting means 73, in this case, the "L" level signal is applied to the C-terminal of the third selection circuit 66, as mentioned before, so that the A-terminal is selected. Thus, the modulated two-second-step pulse P13 is delivered from the second modulation signal generator circuit, whereupon the run-down state warning information, which indicates the wrongness of the displayed time of the watch and notifies the user of the necessity of time adjustment for the watch, is displayed preferentially. If the respective output signals P9 and P8 of the pulse motor stop storage circuit 59 and the reference signal stop storage circuit 8 turn to "H" level in the power-saving state where aforesaid second hand has been stopped at the position "0", in contrast with this, the watch is switched from the power-saving state over to the run-down state warning information display state under the same control for the case of the aforesaid warning information display state (two-second movement) that prompts charge. Thus, the warning information display (run-down state warning information and warning information that prompts charge) is given priority over the power-saving state.

Figure 34:
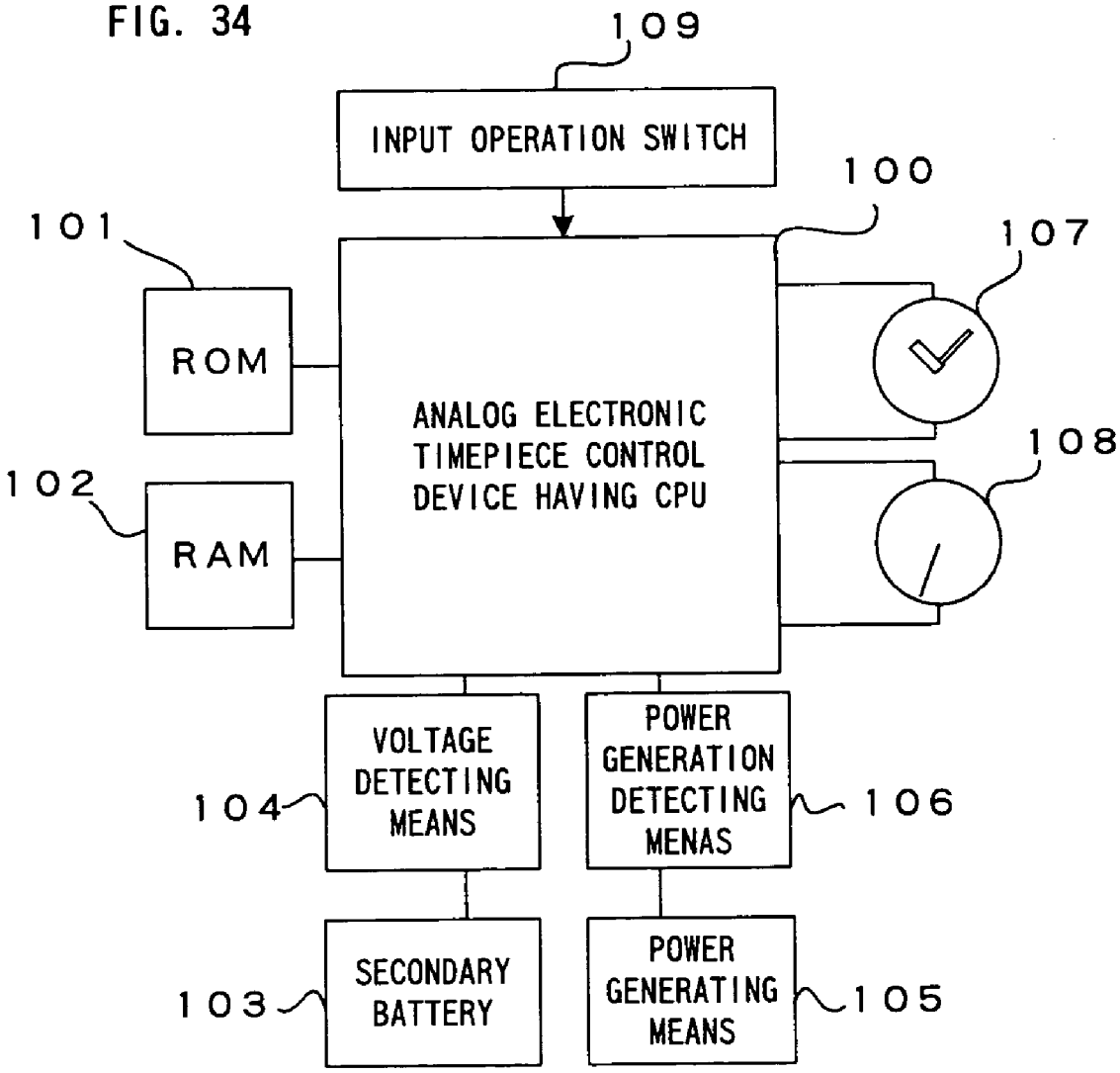
FIG. 34 is a block diagram showing the principal part of a second example of the second embodiment of the electronic timepiece according to the present invention.

FIG. 34 is a block diagram of the second example of the present embodiment. In this second example, the hand movement of the watch is controlled by a processor, and warning display and power-saving display are also controlled by this processor.

In FIG. 34, numeral 100 denotes an analog electronic timepiece control device that has a CPU (processor). This analog electronic timepiece control device 100 is bus-connected with a ROM 101 loaded with a system program for controlling the electronic timepiece and a RAM 102 that is used for temporary storage of data, and moreover, with voltage detecting means 104 for a secondary battery 103 for use as charge means to be charged by power generating means 105 such as a photovoltaic generator or self-winding generator system, such as the one described in connection with the first example, and power generation detecting means 106 for detecting whether or not the power generating means 105 is in a power generating state. The analog electronic timepiece control device 100 having the CPU is connected to a driving pulse motor for driving the minute and hour hands of an hour-minute display device 107 and a pulse motor for driving the second hand of a second display device 108. The hour-minute display device 107 and the second display device 108 are drivingly controlled by drivingly controlling these pulse motors. Whether or not the pulse motor for driving the hour-minute display device 107 is being driven is detected in the same manner as in the first example, and the result is fed back to the analog electronic timepiece control device 100 (not shown).

Figure 35:
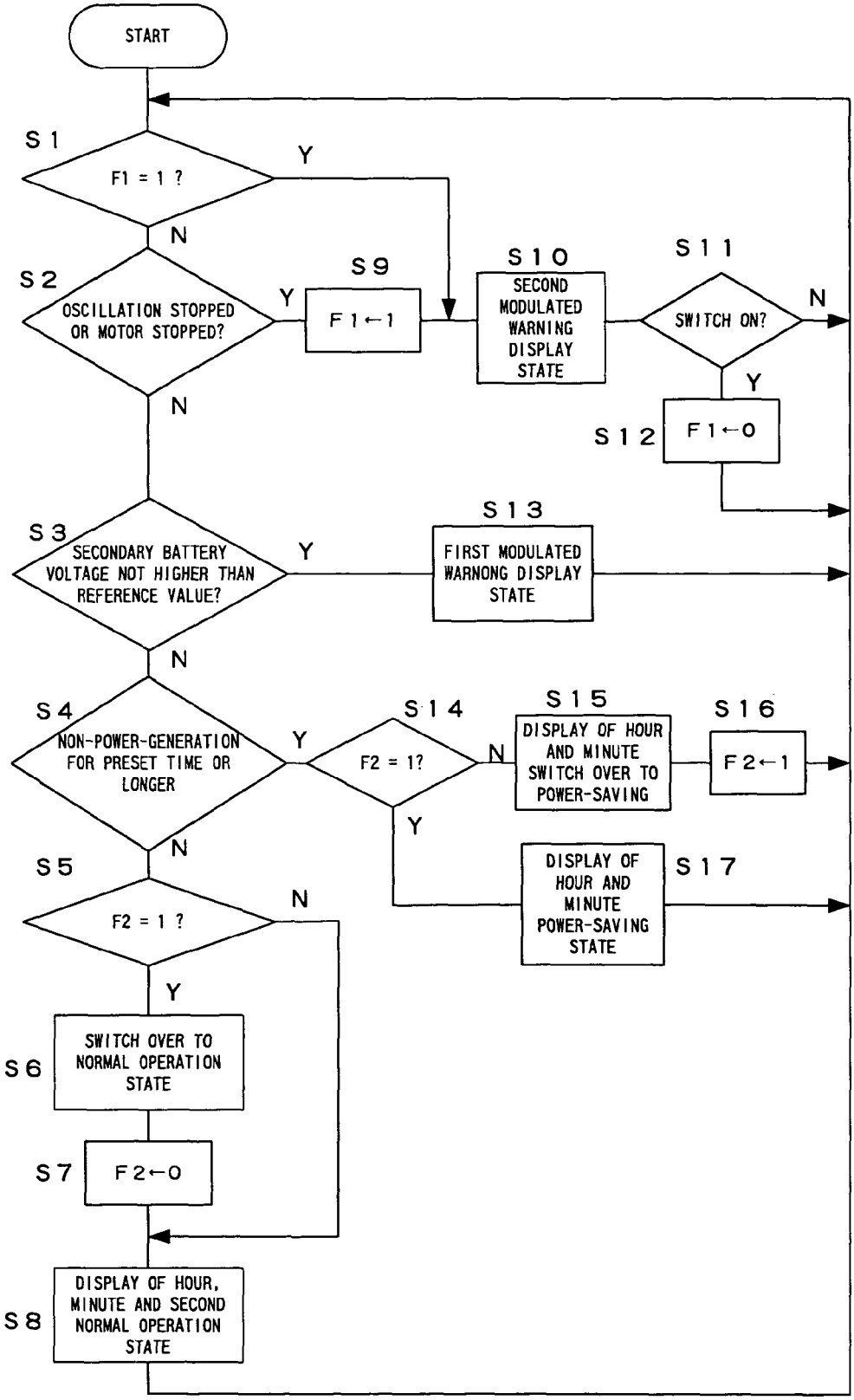
FIG. 35 is a flowchart showing a display switching process that a processor of an analog electronic timepiece control device of the second example having a CPU executes.

FIG. 35 is a flowchart showing a display switching process for a normal time display state, warning display state, power-saving state display state, etc. that the processor (CPU) of the analog electronic timepiece control device 100 of this second example executes.

The processor (CPU) of the analog electronic timepiece control device 100 determines whether or not a flag (hereinafter referred to as time adjustment requiring flag) F1 is set at "1" (Step S1). The time adjustment requiring flag F1 is stored for a state where an oscillator in the analog electronic timepiece control device 100 for generating a reference signal is stopped, or that the drive of the pulse motor for driving the hour and minute hands is stopped, and then no signal (signal indicative of the pullout of the stem) is delivered from an input operation switch 109 for time adjustment, and the movement of the hour and minute hands is suspended so that time adjustment has not been carried out. If the flag 1 is not set at "1", the processor determines whether or not the oscillator for generating the reference signal is stopped or the drive of the pulse motor for driving the hour and minute hands is stopped (Step S2). If the oscillator is operating and the pulse motor is driven, the processor determines whether or not the voltage of the secondary battery 103 detected by the voltage detecting means 104 is not higher than a reference value (Step S3). If the reference value is exceeded, the processor determines by the power generation detecting means 106 whether or not the non-power-generating state is maintained for the preset time or longer by the power generating means 105 (step S4). If the power generation is maintained, the processor determines whether or not a flag F2 (flag for storing the power-saving state as mentioned later) is set at "1" (Step S5). If the flag F2 is not set so, the normal display operation process for the hour, minute, and second is carried out (Step S8), whereupon the program returns to Step S1. If power generation is continued so that the voltage of the secondary battery is higher than the reference value, thereafter, the processes of Steps S1 to S5 and S8 are executed repeatedly, and the watch display in the normal state is performed. In this second example, the process of Step S8 constitutes general information generating means.

If power generation is stopped for the preset time or longer, on the other hand, the stoppage is detected in Step S4, and the processor determines whether or not the flag F2 for storing the power-saving state is "1" (Step S14). If the flag F2 is not "1", the display mode is switched over to power-saving state display (Step S15). Thus, the pulse motor for the second display device 108 is driven in a fast-forward mode such that the second hand is situated in the position "0" (position for twelve o'clock) without changing the display of the hour and minute (with the drive of the pulse motor for the hour-minute display device 107 kept in the normal state), and the second hand is stopped at the position "0" to switch the mode over to the power-saving state. Then, the power-saving state storage flag F2 is set at "1" (Step S16), whereupon the program returns to Step S1. Thereafter, the program advances to Steps S1 to S4. If the non-power-generating state is continued, the program advances from Step S4 to Step S14, whereupon the processor determines whether or not the flag F2 is "1". If the flag F2 is set at "1" in the aforesaid manner, the program advances to Step S17, whereupon the power-saving state is maintained. Thus, the pulse motor of the hour-minute display device 107 is driven so that the hour and minute hands continue time display. However, the second hand is kept stopped in the position "0", thereby indicating the power-saving state. Thereafter, the processes of Steps S1 to S4, S14 and S17 are repeatedly executed to maintain the power-saving state as long as the non-power-generating state lasts.

If power generation is restarted in a state where the power-saving state is maintained in this manner, the restart is detected in Step S4, and the program advances from Step S4 to Step S5, whereupon the processor determines whether or not the power-saving state storage flag F2 is "1". Since the flag F2 is set at "1" in this case, the pulse motor for second display is driven in a fast-forward mode to switch the display mode over to normal-state display such that the second hand is fast-forwarded to the current second position, whereupon the flag F2 is reset at "0" (Steps S6 and S7). Thereafter, the normal operation state is maintained (Step S8).

If the voltage detecting means detects in Step S3 that the voltage of the secondary battery is not higher than the reference value, on the other hand, a first modulated warning display state is entered (Step S13) without regard to the present state, whether the normal operation state or the power-saving state. More specifically, the pulse motor for the second display device is driven for two pulses every two seconds, thereby causing the second hand to perform two-second-step operation, and charge warning display is made to notify the user that the voltage of the secondary battery 103 is lowered and requires charge. Thus, the warning of charge is displayed with priority over the power-saving state.

If the stoppage of the oscillator or the stoppage of the drive of the pulse motor is detected in Step S2, moreover, the time adjustment requiring flag F1 is set at "1" (Step S9), and the display mode is switched over to a second modulated warning display state (run-down state warning display state) (Step S10). More specifically, the pulse motor for the second display device is driven with pulses of second modulation pattern different from a first modulation pattern (two-second-step feed pattern), and the second hand is moved in a second modulated movement, thus indicating a past interruption of the watch operation such that the current display of the watch time is wrong. Then, the processor determines whether or not a signal (time adjustment operation signal) is inputted by the input operation switch 109 (Step S11). If no signal is inputted, the program returns to Step S1. Since the time adjustment requiring flag F1 has already been set at "1", the program advances from Step S1 to Step S10, whereupon the second modulated warning display is continued, and run-down state warning display is made to inform the user of the necessity of time adjustment. Unless a signal (time adjustment operation signal) is inputted by the input operation switch 109, thereafter, the processes of Steps S1, S10 and S11 are repeatedly executed to make run-down state display, thereby continuing to inform the user of the necessity of time adjustment. If the signal (time adjustment operation signal) is inputted by the input operation switch 109, the program advances from Step S11 to Step S12, whereupon the time adjustment requiring flag F1 reset at "0". Thereafter, the processes of Steps S1 to S8 are repeated to execute normal time display.

As seen from the flowchart of FIG. 5, this second modulated warning display is made with priority over the first modulated warning display, as well as over the display of the power-saving state. In this second example, the processes of Steps S19 and S13 constitute warning information generating means.

Figure 36:
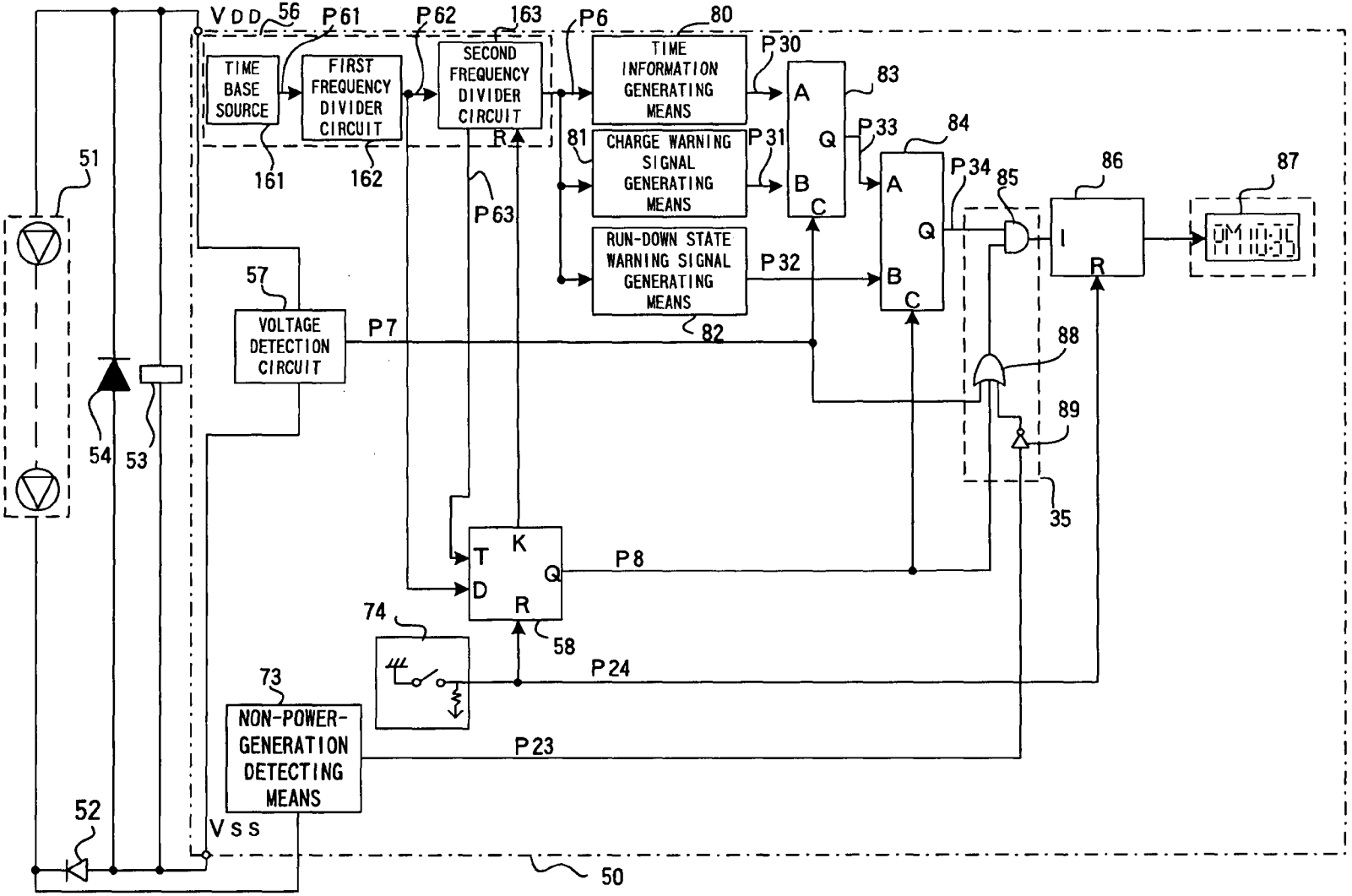
FIG. 36 is a block diagram showing the principal part of a third example of the second embodiment of the electronic timepiece according to the present invention.

FIG. 36 is a block diagram showing the principal part of a third example of the present invention. This third example is an example of a digital watch having a display device composed of a liquid crystal.

The third example is arranged in the same manner as the first example in that a power source is composed of power generating means 51, such as a solar cell, self-winding generator system, windup generator system, thermal generator means, or spring-type generator system, accumulator means 53, such as a high-capacity condenser or secondary battery, Zener diode 54 for use as overcharge preventing means, and diode 52 for preventing reverse-current charge, and like numerals are used to designate like elements. Further, the third example is arranged in the same manner as the first example in that a watch apparatus 50 comprises a reference signal generator circuit 56, voltage detection circuit 57, reference signal stop storage circuit 58, switch circuit 74, and non-power-generating state detection circuit 73, and like numerals are used to designate these individual elements.

The third example differs from the first example in that the watch apparatus 50 comprises time information generating means 80 for generating time information in response to the reference signal P6 from the reference signal generating means 56, charge warning signal generating means 81, and run-down state warning signal generating means 82, and also comprises first selection circuit 83 for use as a selector, second selection circuit 84, warning-first control means 35, display drive circuit 86, and digital display device 87.

The following is a description of the operation of this third example.

First, the voltage of the accumulator means 53 is higher than a reference value, the output signal P7 of the voltage detection circuit 57 is at "L" level, the power generating means 51 is generating power, and output P23 of the non-power-generating state detecting means 73 is at "L" level. Since the output signal P7 of the voltage detection circuit 57 is at "L" level in this normal state, the first selection circuit 83 that receives the output signal P7 at its C-terminal selects the A-terminal, and outputs time information P30 delivered from the time information generating means 80 through its Q-terminal. After the reference signal stop storage circuit 58 is reset by the output signal P24 of the manual switch circuit 74, moreover, it is not stored with any reference signal stop unless the operation of the reference signal generator circuit 56 is stopped, and its output signal P8 is at "L" level. In response to the "L" level output signal P8 of the reference signal stop storage circuit 58 applied to the C-terminal of the second selection circuit 84, therefore, the second selection circuit 84 selects the A-input terminal, and the time information P30 from the first selection circuit 83 is delivered as P83 from the Q-terminal.

Figure 37:
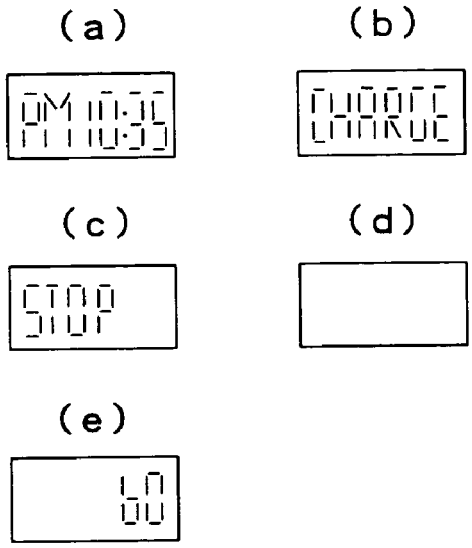
FIG. 37 is a diagram showing examples of display by a digital display device of third and fourth examples.

On the other hand, the output signal P23 of the non-power-generating state detecting means 73 is at "L" level, and an "H" level signal that is inverted by an inverter 89 of the warning-first control means 35 is applied to an AND gate 85 through an OR gate 88. Accordingly, the time information P30, which is an output signal P34 from the Q-terminal of the second selection circuit 84, is applied to the display drive circuit 86 through the AND gate 85. Based on this time information P30, the display drive circuit 86 displays the current time on the digital display device 87, as shown in FIG. 37(*a*).

If the supply voltage is higher than the reference value in the normal state where the power generating means 51 generate power, as described above, the current time is displayed on the digital display device 87 by the aforesaid operation.

If the non-power-generating state detecting means 73 detects that the power generating means has stopped generating power for the preset time or longer and if its output signal P23 turns to "H" level, in this state, for example, this signal P23 is inverted by the inverter 89, thereby turning to "L" level, and is applied to the OR gate 89. Since the other signals P7 and P8 that are applied to the OR gate 88 are also at "L" level (the output signal P7 of the voltage detection circuit 57 is at "L" level because the supply voltage is higher than the reference value, and the output signal P8 of the reference signal stop storage circuit 58 is at "L" level because the reference signal stop is not stored), the output signal of the OR gate 88 turns to "L" level, thereby closing the AND gate 85. Accordingly, an input signal to the display drive circuit 86 is stopped, so that the time display is stopped to establish the power-saving state, as shown in FIG. 37(*d*).

If the voltage of the accumulator means 53 is not higher than the reference value and if the output signal P7 of the voltage detection circuit 57 turns to "H" level, in this power-saving state, on the other hand, an "H" level signal is delivered from the OR gate 88, thereby opening the AND gate 85, so that the output signal P34 from the Q-terminal of the second selection circuit is applied to the display drive circuit 86. In this case, the "H" level signal P7 of the voltage detection circuit 57 is applied to the C-terminal of the first selection circuit 83, whereupon the first selection circuit 83 selects the B-terminal and outputs a charge warning signal P31 from the first selection circuit 81 through its Q-terminal. This charge warning signal P31 is applied to the display drive circuit 86 through the AND gate 85, whereupon charge warning display, such as the one shown in FIG. 37(*b*), is displayed on the digital display device 87.

If the voltage of the accumulator means 53 is not higher than the reference value and if the "H" level signal P7 is delivered from the voltage detection circuit 57, an "H" level signal is always delivered from the OR gate 88, without regard to the signal P23 from the non-power-generating state detecting means 73. Based on the selected charge warning signal P31, therefore, the charge warning display is given priority over the power-saving state display.

If the voltage of the accumulator means 53 is recovered after the generation of the reference signal from the reference signal generator circuit 56 is stopped owing to a drop of the voltage of the accumulator means 53 or the like, moreover, the time information generated from the time information generating means 80 is wrong and time adjustment is requested. As described in connection with the first example, in this case, the reference signal stop storage circuit 58 stores the reference signal stop, and maintains this memory unless a reset signal is applied to its R-terminal in the time adjustment operation. When the reference signal stop is stored, the output signal P8 is at "H" level. Accordingly, the second selection circuit 84, which receives the signal P8 at its C-terminal, selects the B-terminal, and outputs a run-down state warning signal P32 which is an output signal of the run-down state warning signal generating means 82 through its Q-terminal. On the other hand, the OR gate 88 receives the "H" level output signal P8 from the reference signal stop storage circuit 58 as an input, its output is at "H" level. Thereupon, the AND gate 85 is opened, and the run-down state warning signal P32 from the second selection circuit 84 is applied to the display drive circuit 86. In consequence, a run-down state warning is displayed on the digital display device 87, as shown in FIG. 37(*c*).

In response to the "H" level output signal P8 from the reference signal stop storage circuit 58, also in this case, an "H" level signal is always delivered from the OR gate 88, without regard to the signal P23 from the non-power-generating state detecting means 73. Based on the selected run-down state warning signal P32, therefore, the run-down state warning display is given priority over the power-saving state display.

Figure 38:
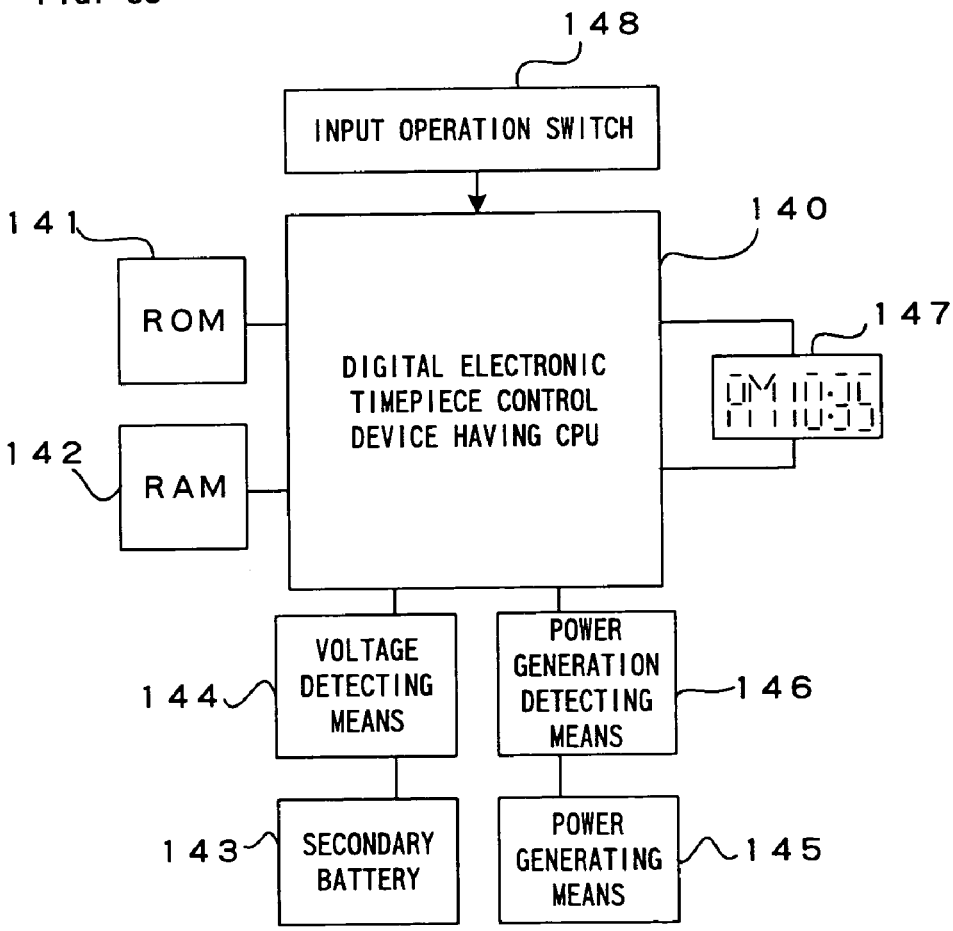
FIG. 38 is a block diagram showing the principal part of a fourth example of the second embodiment of the electronic timepiece according to the present invention.

FIG. 38 is a block diagram of a fourth example of the present invention. In this fourth example, time display control, warning display, and power-saving display can be displayed on a digital display device by a processor.

In FIG. 38, numeral 140 denotes a digital electronic timepiece control device that has a CPU (processor). This digital electronic timepiece control device 140 is bus-connected with a ROM 141 loaded with a system program for controlling the electronic timepiece and a RAM 142 that is used for temporary storage of data, and moreover, with voltage detecting means 144 for a secondary battery 143 for use as charge means to be charged by power generating means such as a photovoltaic generator or self-winding generator system, such as the one described in connection with the foregoing examples, and power generation detecting means 146 for detecting whether or not the power generating means 145 is in a power generating state. The digital electronic timepiece control device 140 having the CPU is connected to a digital display device 147 that digitally displays time and the like by a liquid crystal or the like, and controls this display device.

Figure 39:
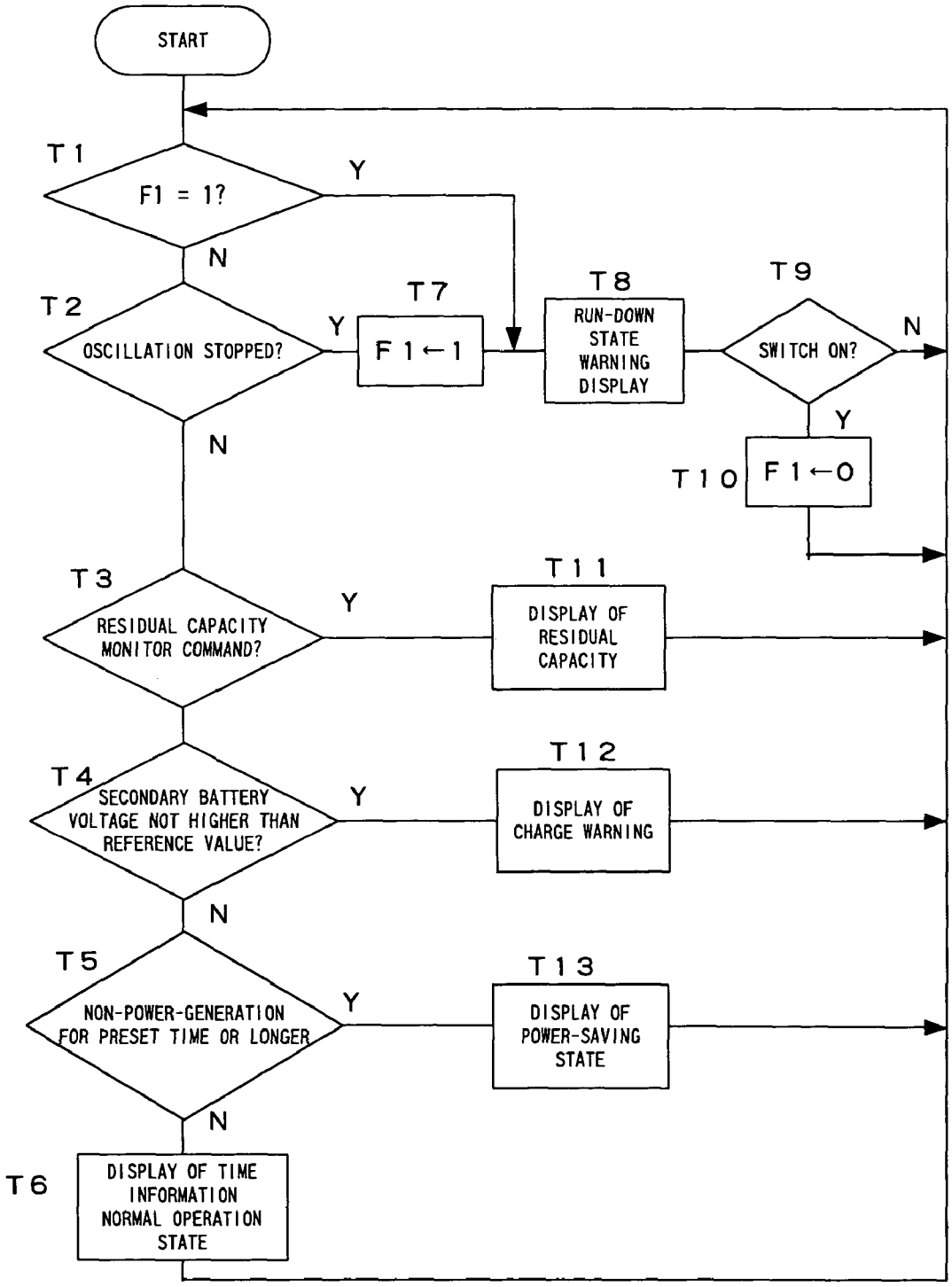
FIG. 39 is a flowchart showing a display switching process that a processor of a digital electronic timepiece control device of the fourth example having a CPU executes.

FIG. 39 is a flowchart showing a display switching process for a normal time display state, warning display state, power-saving state display state, etc. that the processor (CPU) of the digital electronic timepiece control device 140 of this fourth example executes.

The processor (CPU) of the digital electronic timepiece control device 140 determines whether or not the flag F1 is set at "1" (Step T1). If the flag 1 is not set at "1", the processor determines whether or not an oscillator in the digital electronic timepiece control device 140 for generating the reference signal is not stopped (Step T2). If the oscillator is not stopped, the processor determines whether or not a residual capacity monitor command is inputted by an input operation switch 148 (Step T3). If the command is not inputted, the processor determines whether or not the voltage of the secondary battery 143 is not higher than the reference value (Step T4). If the reference value is exceeded, the processor determines by the power generation detecting means 146 whether or not the non-power-generating state has bis maintained for the preset time or longer by the power generating means 145 (Step T5). If the power generation has been maintained, normal time information (AM/PM, hour, minute) are displayed (Step T6), whereupon the program returns to Step T1. If power generation is continued so that the voltage of the secondary battery 143 is higher than the reference value, thereafter, the processes of Steps T1 to T6 are executed repeatedly, and watch display in the normal state is performed.

If the interruption of power generation for the preset time or longer is detected in Step T5, on the other hand, the power-saving state is established as a no-display state where nothing is displayed on the digital display device 147 (Step T13), as shown in FIG. 7(*d*). Unless power generation is started, thereafter, the processes of Steps T1 to T5 and T13 are repeated, and the power-saving state where nothing is displayed on the digital display device 147 is maintained. If power generation is restarted, the restart is detected in Step T5, and the program advances from Step T5 to Step T6, whereupon the display mode is switched over to time information display in the normal operation state.

If the voltage detecting means 144 detects that the voltage of the secondary battery 143 is not higher than the reference value in Step T4, on the other hand, charge warning display is carried out (Step T12) without regard to the state, whether the normal operation state or the power-saving state. In this charge warning display, "CHARGE" is displayed as a warning to prompt charge, as shown in FIG. 37(*b*).

If the residual capacity monitor command (command delivered in response to the depression of a button switch, for example) for the secondary battery is inputted by the input operation switch 148, the input is detected in Step T3 without regard to the state, whether the normal operation state or the power-saving state. Based on the detected voltage from the voltage detecting means 144, the residual capacity of the secondary battery 143 is numerically displayed as residue warning information display on the digital display device 147. If the residual capacity is 60%, for example, "60" is displayed in the manner shown in FIG. 37(*e*) (Step T11). Unless operation for canceling the residual capacity monitor command for the secondary battery is performed by the input operation switch 148, thereafter, the processes of Steps T1 to T3 and T11 are executed repeatedly, and the residual capacity of the secondary battery is displayed.

If the stoppage of the oscillator is detected in Step T2, moreover, the time adjustment requiring flag F1 is set at "1" without regard to the state, whether the normal operation state or the power-saving state, whereupon run-down state warning display is entered (Step T8). In this run-down state warning display, information "STOP" is displayed on the digital display device 147 in the manner shown in FIG. 37(*c*). The processor determines whether or not a signal (signal for pullout of the stem to a position for time adjustment) is inputted by the input operation switch 148 (Step T9). If the signal is not inputted, the program returns to Step T1. Since the time adjustment requiring flag F1 has already been set at "1", the program advances from Step T1 to Step T8, whereupon the run-down state warning display is continued to notify the necessity of time adjustment. Unless a signal (time adjustment operation signal) is inputted by the input operation switch 148, thereafter, the processes of Steps T1, T8 and T9 are executed repeatedly, whereby the user continues to be informed of the necessity of time adjustment.

Thus, the stored current time is wrong even if the generation of the reference signal from the reference signal generator circuit 56 is recovered as the voltage of the secondary battery 143 is restored after the voltage is lowered so that the generation of the reference signal from the reference signal generator circuit 56 is stopped and means for storing the current time stops its function. Therefore, once the generation of the reference signal is stopped, the run-down state warning display is continued unless time adjustment is made.

If the signal (time adjustment operation signal) is then inputted by the input operation switch 148, the program advances from Step T9 to Step T10, whereupon the time adjustment requiring flag F1 is reset at "0". On the assumption that the time is adjusted accurately, thereafter, the processes of Steps T1 to T6 are executed repeatedly, and the time information is displayed normally.

As described above, the charge warning display due to a voltage drop is given priority over the power-saving state, and the residue warning information display for the residual capacity (residue) of the accumulator means is given priority over the power-saving state. Further, the generation of the reference signal (oscillation signal) from the reference signal generator circuit stops. If time adjustment is required, the run-down state warning display is given priority over the charge warning display or the residue warning information display, as well as over the power-saving state display. For the display priority between the residue warning information display and the charge warning display, the charge warning display may be given priority, although the residue warning information display is given priority according to the fourth example of the present invention. According to the present invention, moreover, the preference of the residue warning information display to the power-saving state has been described in connection with the digital electronic timepiece of the fourth example. However, the present invention includes a display system of an analog electronic timepiece designed so that the display of the residue warning information where the residual capacity (residue) of accumulator means 3 such as a secondary battery is indicated with the movement of an index (e.g., second hand) is given priority over the display of the power-saving state where power saving is conducted by stopping a hand (second hand, for example) at a present position.

In the case where the electronic timepiece is a generator-type electronic timepiece having power generating means, such as a solar cell or self-winding power generation, in particular, moreover, it is effective to give priority to display functions for time adjustment warning function information for warning of wrong time indication when the electronic timepiece once temporarily undercharged and stopped is restarted by recharge, charge warning function information which is a warning for prompting charge, and residue warning function information for indicating the residual capacity of the secondary battery or accumulator for use as accumulator means, over the power-saving function, in a case where a warning command is issued.

The configuration and operation of another embodiment in which the individual function information, including the warning function information, charge warning function information, and residue warning function information are given priority over the power-saving function will now be described with reference to FIGS. 40 to 45.

FIGS. 40 to 45 are block diagrams, flowcharts, and timing charts for illustrating the configuration and operation of the analog-display electronic timepiece in which the individual warning function states, including the warning function information, charge warning function information, residue warning function information, etc., are given priority over the power-saving function.

Figure 40:
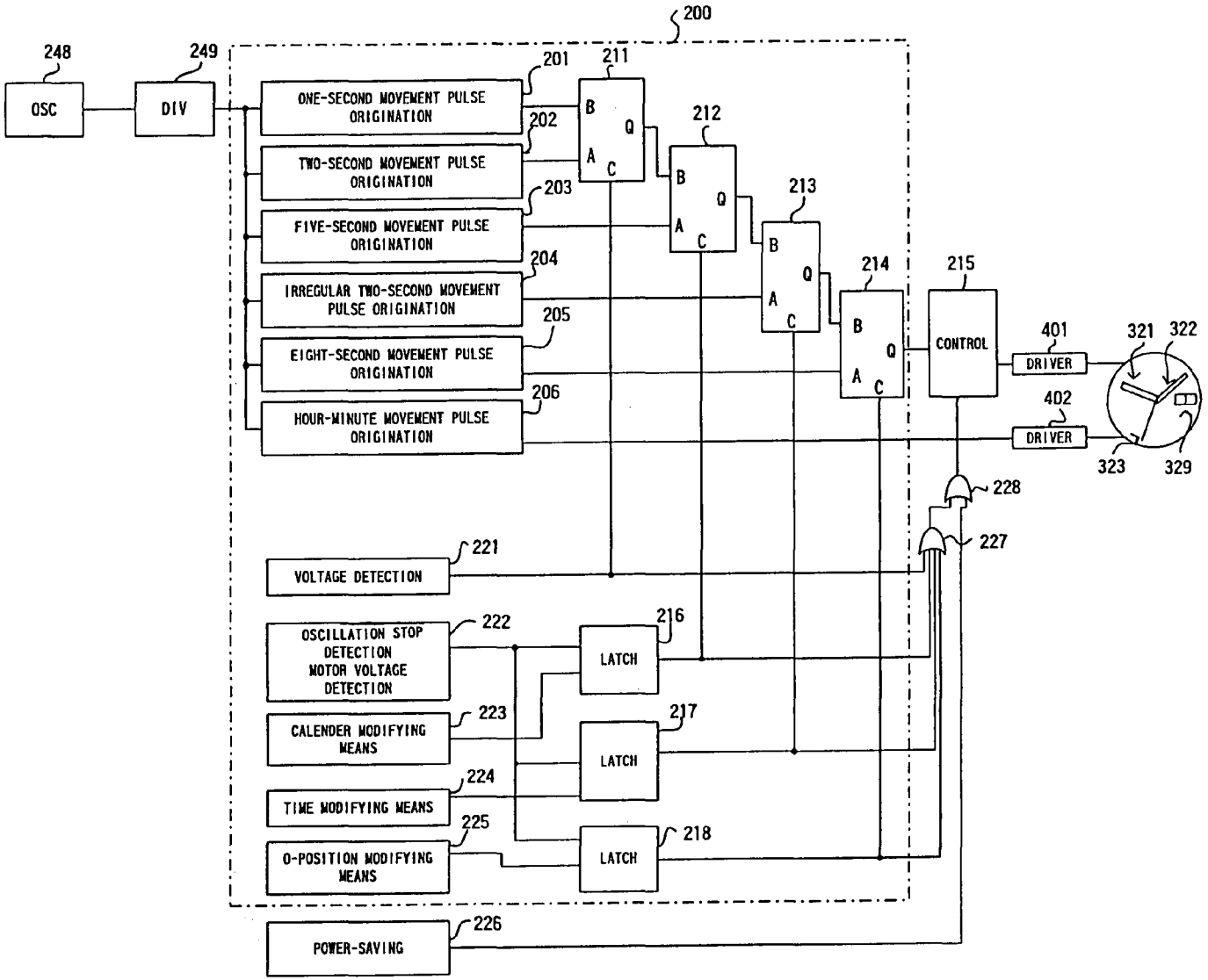
FIG. 40 is a block diagram illustrating an analog configuration and operation for giving priority to time adjustment warning function information, charge warning function information, etc. over a power-saving function.

The configuration shown in FIG. 40 is a watch of a configuration for analog display, which comprises display means 305, which has an hour hand 321, minute hand 322, second hand 323, and date plate, and display drive means 304 for driving the display means 305. In the configuration shown here, the display drive means 304 is provided with a driver circuit 401 and a driver circuit 402. The driver circuit 401 drives the second hand 323, while the driver circuit 402 drives the hour hand 321 and the minute hand 322.

An oscillator circuit 248 and a frequency divider circuit 249 that constitute reference signal generating means outputs a reference signal (SR). This reference signal causes the driver circuit 401 and the driver circuit 402 to drive the second hand 323, hour hand 321, and minute hand 322, thereby displaying time information, and is formed into pulse signals corresponding to the individual states in a watch circuit element 200 that includes controls for various warnings such as time adjustment and charge warnings. The pulse signals cause the driver circuit 401 to drive the second hand 223, thereby displaying the time adjustment warning that warns of wrong time indication at the restart and the charge warning to prompt charge. The second hand 323 is driven in response to a one-second movement pulse signal that is formed by one-second movement pulse forming means 201, while the hour hand 321 and the minute hand 322 are driven in response to hour and minute movement pulse signals that are formed by hour-minute movement pulse forming means 206.

The watch circuit element 200 comprises the one-second movement pulse forming means 201 that forms the pulse signal for moving the second hand 323 every second, two-second movement pulse forming means 202 that forms a pulse signal for moving the second hand 323 every two seconds in order to notify the necessity of charge owing to a supply voltage drop, five-second movement pulse forming mean 203 that forms a pulse signal for moving the second hand 323 every five seconds in order to notify the necessity of calendar adjustment owing the stoppage of the drive of the date plate, irregular two-second movement pulse forming means 204 that forms a pulse signal for irregularly moving the second hand 323 every two seconds in order to notify the necessity of time adjustment owing the stoppage of display information, and eight-second movement pulse forming means 205 that forms a pulse signal for moving the second hand 323 every eight seconds in order to notify that the second hand 323 is not aligned with a zero-second position. Various warnings of time adjustment, charge, calendar adjustment, uncompleted 0-position alignment, etc. are displayed by the pulse signals that are formed by these pulse forming means.

Among the warnings described above, the warnings to be displayed are selected by selectors 211 to 214. The selector 211 selects one of signals that are applied to its input terminals B and A by a selection signal from voltage detecting means 221 that is applied to its selection terminal C, and delivers a one-second movement pulse signal or two-second movement pulse signal through its output terminal Q, depending on the voltage value of the supply voltage. If the voltage value of the supply voltage becomes lower than a predetermined voltage, for example, the two-second movement pulse signal is outputted for charge warning.

Further, the selector 212 selects any one of signals that are applied to its input terminals B and A by a selection signal applied to its selection terminal C from a latch circuit 216 that is latched by a detection signal from detecting means 222 for oscillation stop (or detecting means for detecting a drop of the supply voltage below a necessary voltage for motor drive), and delivers the output signal of the selector 211 or a five-second movement pulse signal through its output terminal Q in response to the oscillation stop (or voltage drop of the supply voltage). If the oscillation is stopped, for example, the five-second movement pulse signal is outputted for calendar adjustment warning. If the date plate is modified by calendar modifying means 223 in response to the calendar adjustment warning, the latch circuit 216 is reset to switch the selection of the selector 212 and delivers the output signal of the selector 211.

Further, the selector 213, like the selector 212, selects any one of signals that are applied to its input terminals B and A by a selection signal applied to its selection terminal C from a latch circuit 217 that is latched by a detection signal from the detecting means 222 for oscillation stop (or detecting means for detecting a drop of the supply voltage below the necessary voltage for motor drive), and delivers the output signal of the selector 212 or an irregular two-second movement pulse signal through its output terminal Q in response to the oscillation stop (or voltage drop of the supply voltage). If the oscillation is stopped, for example, the irregular two-second movement pulse signal is outputted for time adjustment warning. If the time is modified by time modifying means 224 in response to the time adjustment warning, the latch circuit 217 is reset to switch the selection of the selector 213 and delivers the output signal of the selector 212.

Furthermore, the selector 214, like the selectors 212 and 213, selects ay one of signals that are applied to its input terminals B and A by a selection signal applied to its selection terminal C from a latch circuit 218 that is latched by a detection signal from the detecting means 222 for oscillation stop (or detecting means for detecting a drop of the supply voltage below the necessary voltage for motor drive), and delivers the output signal of the selector 213 or an eight-second movement pulse signal through its output terminal Q in response to the oscillation stop (or voltage drop of the supply voltage). If the oscillation is stopped, for example, the eight-second movement pulse signal is outputted to warn of uncompleted 0-position alignment. If the second hand 23 is located in a 0-position by 0-position modifying means 225 in response to the uncompleted 0-position alignment warning, the latch circuit 218 is reset to switch the selection of the selector 214 and delivers the output signal of the selector 213.

In order to give priority to the individual function information described above over the power-saving, the configuration shown in FIG. 40 is provided with power-saving state detecting means 226 and control means 215. The control means 215 receives an "L" level detection signal from the power-saving state detecting means 226 at its selection terminal C, an determines whether or not to deliver a signal for displaying the information from the selector 214 to the driver circuit 401. Even in the case of the power-saving state, any of the respective outputs of the circuits 221, 216, 217 and 218 as warning commands, that is, the output of an OR gate 227, is at "H" level, and the output of an OR gate 228 is also at "H" level. In this case, therefore, the warning information signal from the selector 214 is delivered to the driver circuit 401, whereupon warning information is displayed to give priority to the warning function over the power-saving function even though a power-saving state detection signal is delivered from the means 226.

If the power-saving state detection signal is outputted without any warning information, in contrast with this, the transmission of the function information from the selector 214 to the driver circuit 401 is stopped, and the display on the display means 5 is stopped, whereupon the power-saving state is established.

Figure 42:
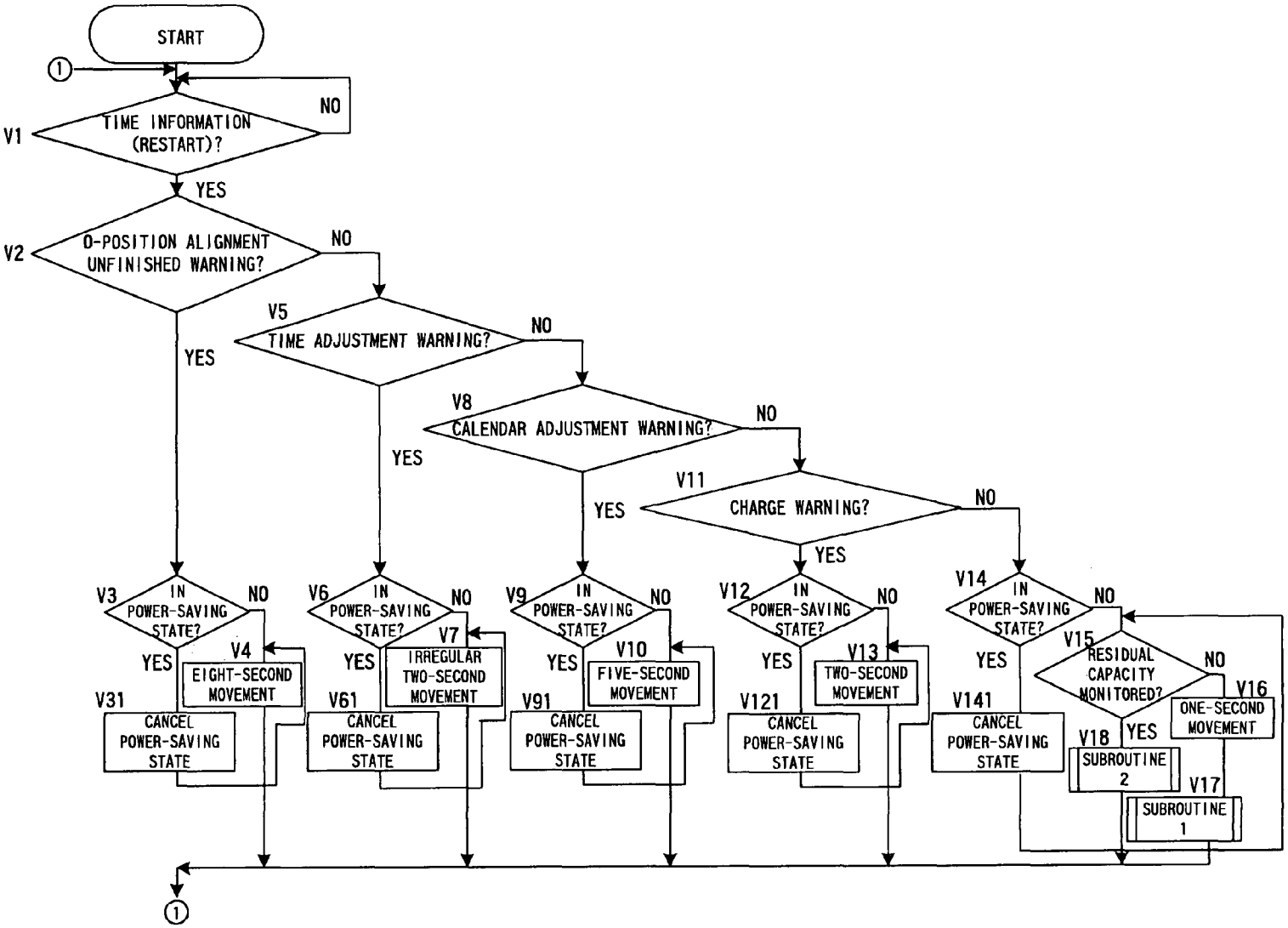
FIG. 42 is a flowchart illustrating the operation of an analog configuration for giving priority to various warning function states such as residual capacity warning function information, as well as the time adjustment warning function information and the charge warning function information, over the power-saving function.

An example of the power-saving-first operation according to the above-described configuration will be described with reference to the flowchart of FIG. 42.

In a case where the generator-type electronic timepiece having the power generating means, formed of a solar cell or self-winding power generation, is provided with the aforementioned configuration, when power generating means is undercharged, the detection signal of the voltage detecting means 221 may select the A-terminal side of the selector 211, or the detection signal of the oscillation stop detecting means 222 may set the latch circuits 216 to 218 to select the A-terminal side of the selectors 212 to 214, thereby issuing various warnings including a suspension of the operation of the watch.

The electronic timepiece is restarted by recharge from these warning states and loaded with time adjustment information, more specifically, the reference signal is applied to the watch circuit element 200 through the oscillator circuit 248 and the frequency divider circuit 249 (Step V1). Thereupon, whether or not the warning of 0-position alignment unfinished is issued is first determined in the watch circuit element 200. This decision can be made depending on whether the latch circuit 218 is set or reset (Step V2).

If the 0-position alignment is uncompleted (with the latch circuit 218 kept set), whether or not the power-saving state is established is determined (Step V3). If a power-saving signal is delivered from the power-saving state detecting means 226, it is concluded that power saving is in operation, and the power-saving state is canceled (Step V31), whereupon the program advances to Step V4. If power saving is not in operation, on the other hand, the control means 215 selects the eight-second movement pulse signal from the selector 214 so that the second hand 323 is driven intermittently every eight seconds, whereupon the program advances directly to Step V4 in which 0-position alignment unfinished is indicated.

If the 0-position alignment is finished (with the latch circuit 218 reset), whether or not the time adjustment warning is being issued is determined. This decision can be made depending on whether the latch circuit 217 is set or reset (Step V5). If the time adjustment warning is outputted (with the latch circuit 217 set), whether or not the power-saving state is established is determined (Step V6). If the power-saving signal is being delivered from the power-saving state detecting means 226, it is concluded that power saving is in operation, and the power-saving state is canceled (Step V61), whereupon the program advances to Step V7. If power saving is not in operation, on the other hand, the control means 215 selects the irregular two-second movement pulse signal from the selectors 213 and 214 so that the second hand 323 is driven at irregular intermittent intervals of two seconds, whereupon the program advances directly to Step V7 in which time adjustment unfinished is indicated.

If the time adjustment is completed (with the latch circuit 217 reset), whether or not the calendar adjustment warning is issued is determined. This decision can be made depending on whether the latch circuit 216 is set or reset (Step V8). If the calendar adjustment warning is outputted (with the latch circuit 216 set), whether or not the power-saving state is established is determined (Step V9). If the power-saving signal is delivered from the power-saving state detecting means 226, it is concluded that power saving is in operation, and the power-saving state is canceled (Step V91), whereupon the program advances to Step V10. If power saving is not in operation, on the other hand, the control means 215 selects the irregular two-second movement pulse signal from the selectors 212, 213 and 214 so that the second hand 23 is driven at intermittent intervals of five seconds, whereupon the program advances directly to Step V10 in which incompletion of calendar adjustment is indicated.

If the calendar adjustment is completed (with the latch circuit 216 reset), whether or not the charge warning is issued is determined. This decision can be made by the output of the voltage detecting means 221 (Step V11). If the charge warning is outputted (with a signal indicative of a voltage drop delivered from the voltage detecting means 221), whether or not the power-saving state is established is determined (Step V12). If the power-saving signal is delivered from the power-saving state detecting means 226, it is concluded that power saving is in operation, and the power-saving state is canceled (Step V121), whereupon the program advances to Step V13. If power saving is not in operation, on the other hand, the control means 215 selects the two-second movement pulse signal from the selectors 211, 212, 213 and 214 so that the second hand 323 is driven at intermittent intervals of two seconds, whereupon the program advances directly to Step V13 in which undercharge is indicated.

Figure 41:
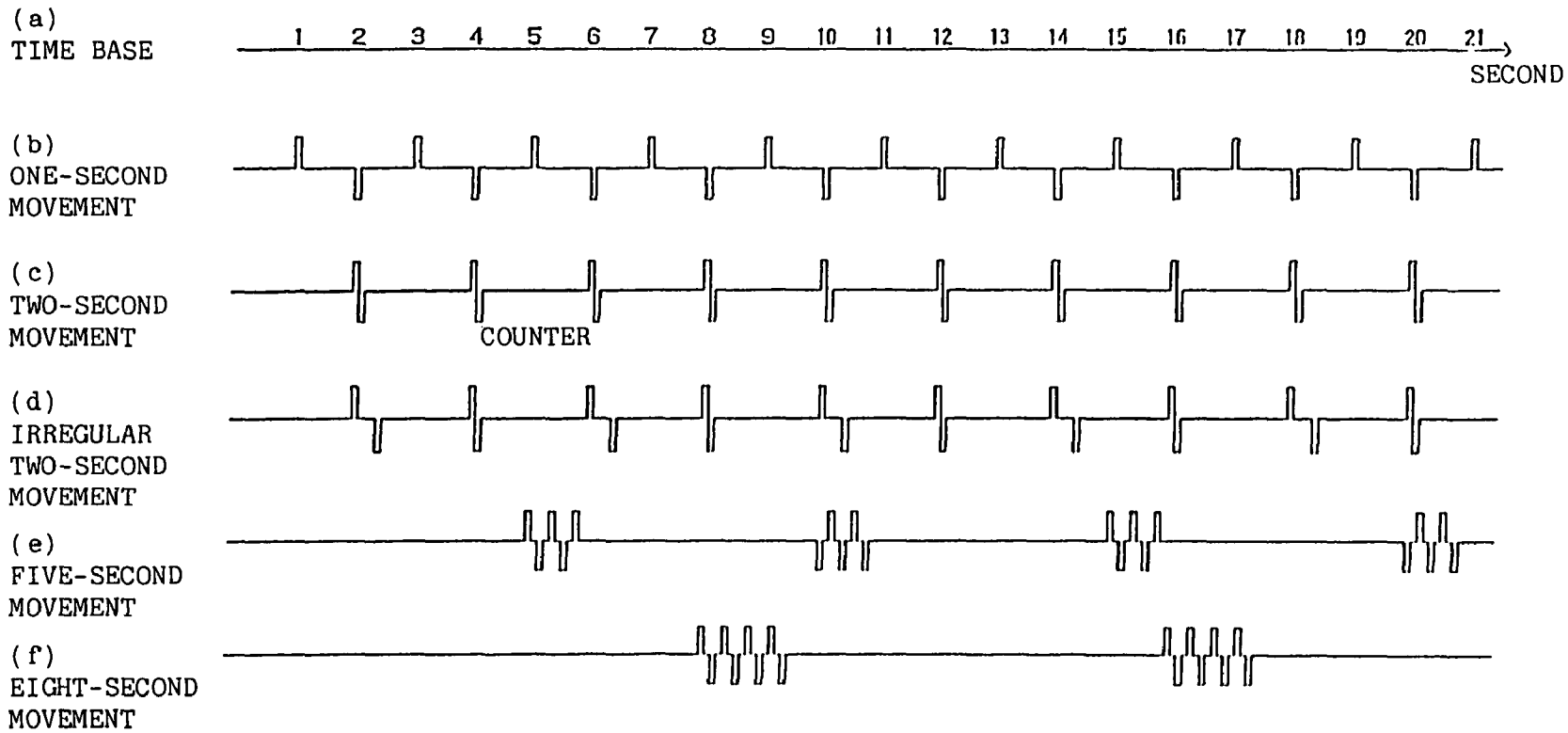
FIG. 41 is a timing chart showing warning function display drive signals for the time adjustment warning function information, charge warning function information, etc.

FIG. 41 shows examples of the respective signal states of the one-second movement pulse signal, two-second movement pulse signal, irregular two-second movement pulse signal, five-second movement pulse signal, and eight-second movement pulse signal. The one-second movement pulse signal shown in FIG. 41(*b*) outputs a pulse signal every second with respect to the time base shown in FIG. 41(*a*), and serves as a positive second signal indicative of time information. The two-second movement shown in FIG. 41(*c*) outputs two pulse signals every two seconds with respect to the time base shown in FIG. 40(*b*), and displays a charge warning. The irregular two-second movement pulse signal shown in FIG. 41(*d*) outputs two pulse signals every two seconds with respect to the time base shown in FIG. 41(*b*) at signal intervals different from those of the two-second movement pulse signal, and displays a time adjustment warning. The five-second movement pulse signal shown in FIG. 41(*e*) outputs five pulse signals every five seconds with respect to the time base shown in FIG. 41(*b*), and displays a calendar adjustment warning. The eight-second movement pulse signal shown in FIG. 41(*f*) outputs five pulse signals every eight seconds with respect to the time base shown in FIG. 41(*b*), and displays an uncompleted 0-position alignment warning.

The two-second movement pulse signal, irregular two-second movement pulse signal, five-second movement pulse signal, and eight-second movement pulse signal are examples of hand movement modes in which the second hand information made to indicate the individual warnings. Other hand movement modes may be used for the indication of the warnings. The individual movement pulse signals are examples that output positive and negative signals alternately.

If the watch is fully charged (without any signal indicative of a voltage drop delivered from the voltage detecting means 221), whether or not the power-saving state is established is determined in the process of Step V14. If the power-saving signal is delivered from the power-saving state detecting means 226, it is concluded that power saving is in operation, and the power-saving state is canceled (Step V141), whereupon the program advances to Step V15. If power saving is not in operation, on the other hand, the program advances directly to Step V15 in which whether or not a residual capacity monitor is operating.

If the residual capacity monitor is not operating (Step V15), the second hand 23 is normally driven by the one-second movement pulse signal to display the time information (Step V16). If the residual capacity monitor is selected in a subroutine 1, thereafter, residual capacity display is made (Step V17). If the residual capacity monitor is not operating (Step V15), on the other hand, a process for terminating the residual capacity monitor is carried out in a subroutine 2 (Step V18).

Figure 43:
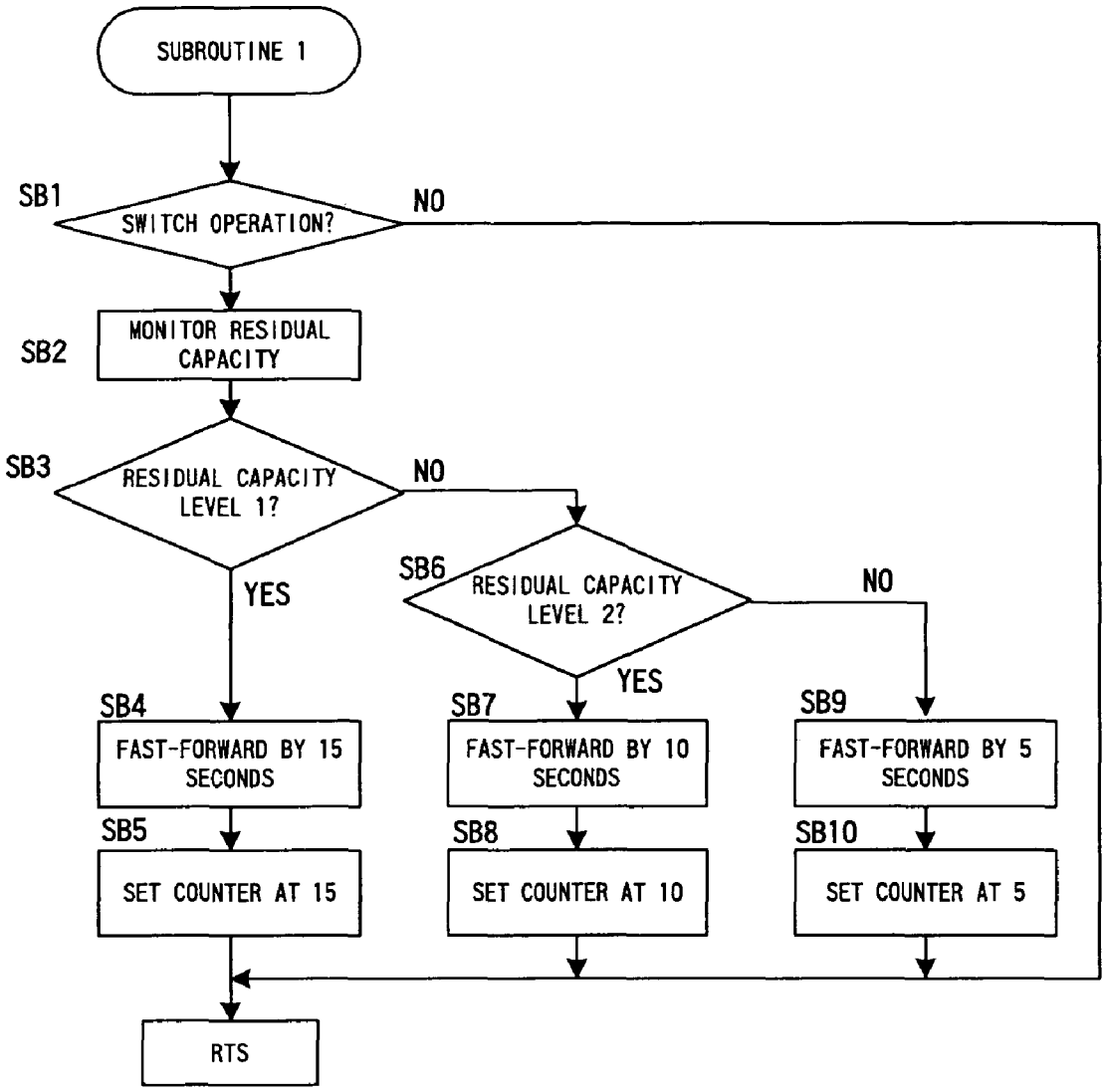
FIG. 43 is a flowchart for illustrating an operation example of a subroutine 1 of the flowchart of FIG. 42.

The flowchart of FIG. 43 shows an example of operation of the subroutine 1. Whether or not the residual capacity monitor is operated is selected by switching operation (Step SB1). If the residual capacity monitor operation is selected, the operation of the residual capacity monitor is started (Step SB2). The residual capacity monitor, in which a level 1 and a level 2 are previously set as threshold values, compares the voltage of the power source means with the levels 1 and 2, and displays the residual capacity level in accordance with the result of the comparison. If the voltage of the power source means is not lower than the level 1 (Step SB3), the second hand is fast-forwarded by fifteen seconds to indicate that the voltage is at the residual capacity level 1 (Step SB4), and the counter is set at 14 (Step SB5). If the voltage of the power source means is not higher than the level 1 and not lower than the level 2 (Step SB6), the second hand is fast-forwarded by ten seconds to indicate that the voltage is at the residual capacity level 2 (Step SB7), and the counter is set at 9 (Step SB8). If the voltage of the power source means is not higher than the level 2 (Step SB6), the second hand is fast-forwarded by five seconds to indicate that the voltage is at the residual capacity level 3 (Step SB9), and the counter is set at 4 (Step SB10).

Figure 44:
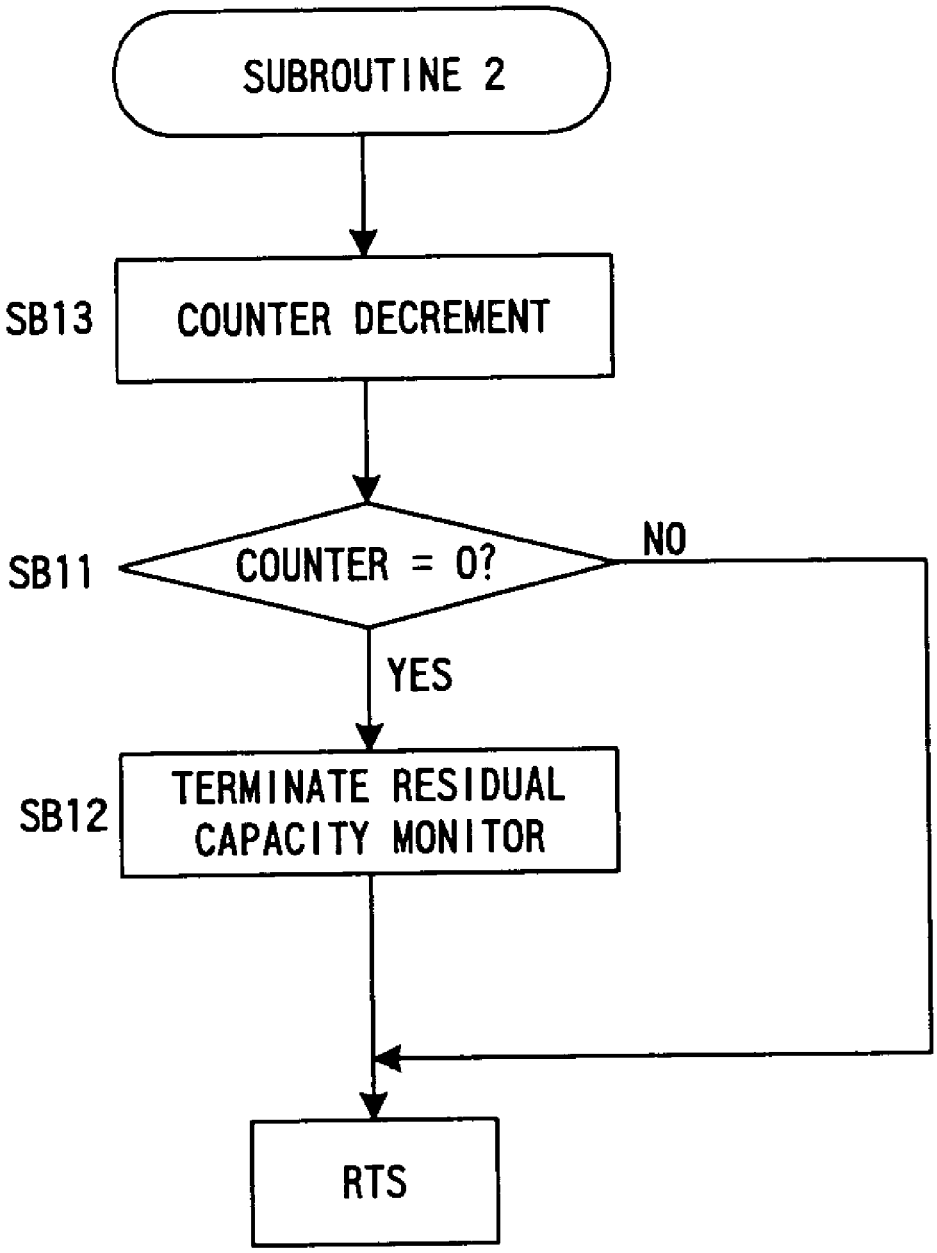
FIG. 44 is a flowchart for illustrating an operation example of a subroutine 2 of the flowchart of FIG. 42.

While the display on the residual capacity monitor is made in the subroutine 1, the process of the subroutine 2 is carried out in accordance with the decision of Step V15. The flowchart of FIG. 44 shows an example of operation of the subroutine 2. In the subroutine 2, a counter value set in the subroutine 1 is monitored, and whether or not this counter value is 0 is determined (Step SB11). If the counter value is not 0, the set counter value is reduced by 1 (Step SB13), and the decision in Step SB11 is made again in one second. Since the counter value is reduced in this case, the counter value becomes 0 after the passage of time corresponding to the set counter value, whereupon the residual capacity monitor is terminated (Step SB12). The residual capacity monitor can constitute hardware or software that determines voltage signals delivered from the voltage detecting means 221 or power generation detecting means for detecting the reduction of the power generating capability of power generating means such as a solar cell or self-winding generator system, if any, as compared with the residual capacity level as a threshold value.

Figure 45:
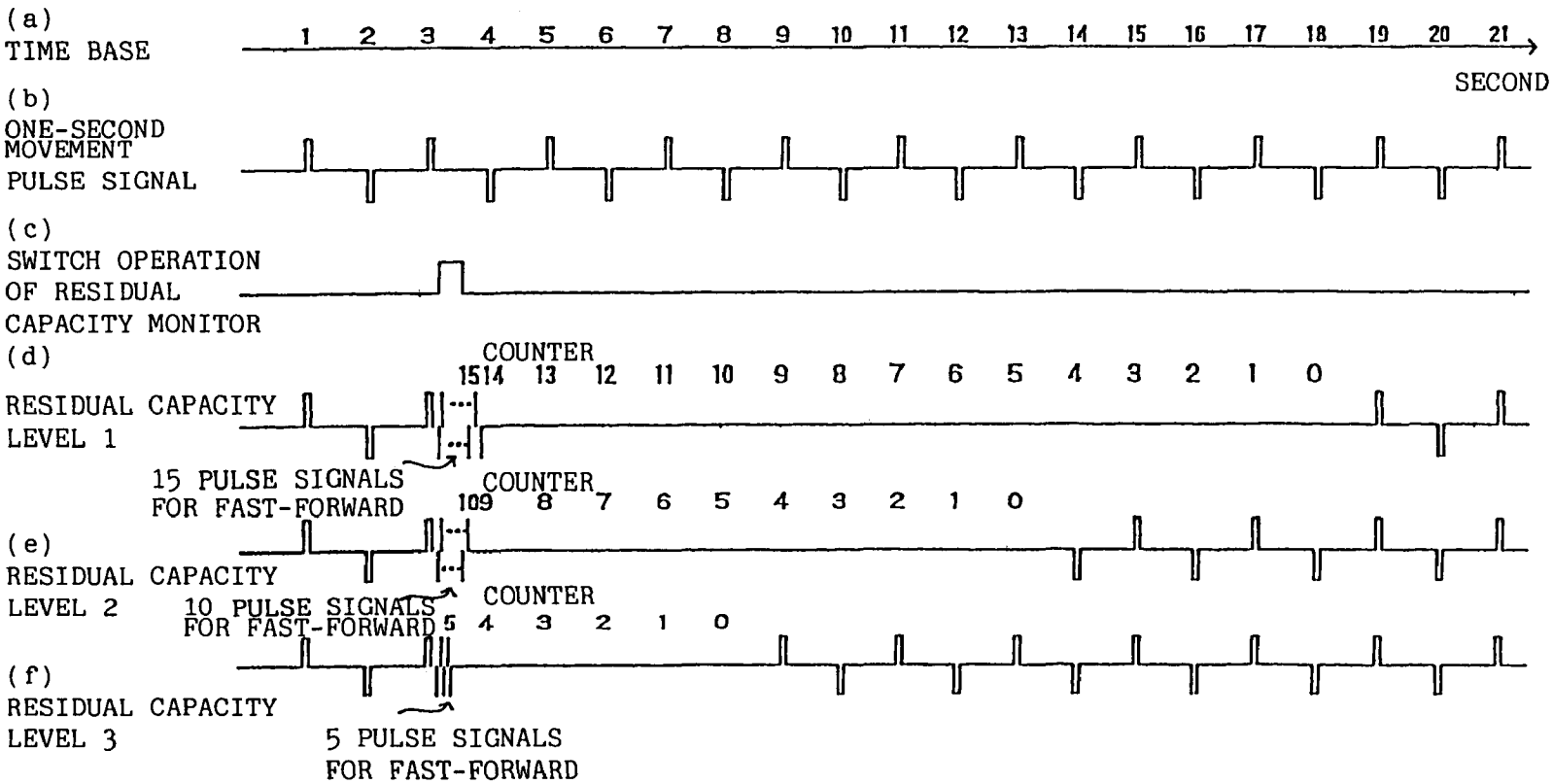
FIG. 45 is a timing chart showing warning function display drive signals for the residual capacity warning function information, in addition to those for time adjustment warning function information and the charge warning function information, and residual capacity monitor control.

FIG. 45 is a timing chart for illustrating the operation of the residual capacity monitor. The one-second movement pulse signal shown in FIG. 45(*b*) outputs a pulse signal every second with respect to the time base shown in FIG. 45(*a*), and displays an operation for each second. If an operation switch for actuating the residual capacity monitor at the point of time shown in FIG. 45(*c*) is set in this state, the pulse signal of FIG. 45(*d*), 45(*e*) or 45(*f*) is outputted in place of the one-second movement pulse signal shown in FIG. 45(*b*), depending on the voltage state of the power source element, whereupon the residual capacity monitor is indicated by the movement of the second hand.

If the voltage of the power source element is not lower than the level 1, for example, fifteen pulse signals are outputted in a short period as shown in FIG. 45(*d*), whereby the second hand is fast-forwarded by an amount corresponding to fifteen seconds to indicate that the voltage is at the residual capacity level 1. Thereafter, the counter subtracts the counter value, 15, every second, thereby stopping the hand movement of an amount corresponding to fifteen seconds. After the counter value becomes 0, normal hand movement is restarted. If the voltage of the power source element is not higher than the level 1 and not lower than the level 2, moreover, ten pulse signals are outputted in a short period as shown in FIG. 45(*e*), whereby the second hand is fast-forwarded by an amount corresponding to ten seconds to indicate that the voltage is at the residual capacity level 2. Thereafter, the counter subtracts the counter value, 10, every second, thereby stopping the hand movement of an amount corresponding to ten seconds. After the counter value becomes 0, normal hand movement is restarted. If the voltage of the power source element is not higher than the level 2, moreover, five pulse signals are outputted in a short period as shown in FIG. 45(*f*), whereby the second hand is fast-forwarded by an amount corresponding to five seconds to indicate that the voltage is at the residual capacity level 3. Thereafter, the counter subtracts the counter value, 5, every second, thereby stopping the hand movement of an amount corresponding to five seconds. After the counter value becomes 0, normal hand movement is restarted.

In the case where the power source is a primary battery, moreover, the power-saving state can be canceled so that the residue warning information display is given priority over the power-saving state in accordance with the aforesaid movement of the second hand without departing from the scope of the present embodiment when residue warning display monitoring is carried out by another switching operation with the power-saving state entered by manual switching operation.

In this second embodiment, the warning to prompt charge, residue warning to indicate the residual capacity of the accumulator means, and warning to prompt time adjustment are displayed with priority over the power-saving state display. In the electronic timepiece that combines the power-saving function and the warning information display function, therefore, these two functions can be fulfilled satisfactorily by displaying and notifying a warning more important than the power-saving function in a case where power-saving operation performed according to circumstances by the power-saving function of the electronic timepiece may possibly constitute a hindrance to the watch function or to the maintenance of the watch function. This is particularly effective for a rechargeable electronic timepiece that uses accumulator means rechargeable by power generating means as its power source.

The invention claimed is:

1. An electronic timepiece comprising:

a time information generating unit for generating time information;

a non-time information generating unit for generating other information other than the time information;

a display unit capable of alternatively displaying said time information and/or the other information;

a power-saving operation unit for operating the electronic timepiece in a power-saving operation state entailing lower power consumption than in a normal operation state; and a preferential operation selecting unit for changing priority sequence between said non-time information generating unit and said power-saving operation unit according to circumstances or a predetermined condition.

2. The electronic timepiece according to claim 1, wherein said information generating unit is function information generating unit for generating function information.

3. The electronic timepiece according to claim 1, wherein said information generating unit is warning information generating unit for generating warning information for prompting a predetermined warning.

4. The electronic timepiece according to claim 1, wherein at least a part of said display unit is composed of a digital display system or an analog display system.

5. The electronic timepiece according to claim 1, which further comprises a selecting unit for causing said preferential operation selecting unit to select the preferential operation, said selecting unit being adapted to cause said preferential operation selecting unit to select the preferential operation at the request of a user.

6. The electronic timepiece according to claim 1, wherein said power source unit includes a battery.

7. The electronic timepiece according to claim 1, wherein said power source unit comprises a power generating unit and accumulator unit to be charged by said power generating unit.

8. The electronic timepiece according to claim 7, which further comprises a residual capacity detecting unit for detecting the residual capacity of said accumulator unit, wherein said preferential operation selecting unit, based on residual capacity detection information from said residual capacity detecting unit, causes said information generating unit to operate with priority over said power-saving operation unit if said detected residual capacity is not lower than a predetermined value and, on the other hand, causes said power-saving operation unit to operate with priority over said information generating unit if said detected residual capacity is lower than the predetermined value.

9. The electronic timepiece according to claim 8, wherein said residual capacity detecting unit detects the output voltage or output current of said accumulator unit.

10. The electronic timepiece according to claim 7, which further comprises residual capacity detecting unit for detecting the residual capacity of said accumulator unit and power generation detecting unit for detecting the power generating state of said power generating unit, wherein said preferential operation selecting unit, based on residual capacity detection information from said residual capacity detecting unit and power generation detection information from said power generation detecting unit, causes said information generating unit to operate with priority over said power-saving operation unit if said detected residual capacity is not lower than a predetermined value and if said detected power generating state is not lower than a predetermined power generation level and, on the other hand, causes said power-saving operation unit to operate with priority over said information generating unit if said detected residual capacity is lower than the predetermined value and if said detected power generating state is lower than the predetermined power generation level.

11. The electronic timepiece according to claim 7, which further comprises residual capacity detecting unit for detecting the residual capacity of said accumulator unit and power generation detecting unit for detecting the power generating state of said power generating unit, wherein said preferential operation selecting unit, based on residual capacity detection information from said residual capacity detecting unit and power generation detection information from said power generation detecting unit, causes said information generating unit to operate with priority over said power-saving operation unit if said detected residual capacity is not lower than a predetermined value or if said detected power generating state is not lower than a predetermined power generation level and, on the other hand, causes said power-saving operation unit to operate with priority over said information generating unit if said detected residual capacity is lower than the predetermined value or if said detected power generating state is lower than the predetermined power generation level.

12. The electronic timepiece according to claim 7, which further comprises power generation detecting unit for detecting the power generating state of said power generating unit, wherein said preferential operation selecting unit, based on power generation detection information from said power generation detecting unit, causes said information generating unit to operate with priority over said power-saving operation unit if said detected power generating state is not lower than a predetermined power generation level and, on the other hand, causes said power-saving operation unit to operate with priority over said information generating unit if said detected power generating state is lower than the predetermined power generation level.

13. The electronic timepiece according to claim 12, wherein said power generation detecting unit detects the quantity of generated electricity, power generation voltage, or power generation current of said power generating unit.

14. The electronic timepiece according to claim 7, wherein a power source for driving each unit of the electronic timepiece is selected from among a power generating unit including a solar cell, windup generator, self winding generator, and temperature-difference generator, or a combination of said power generating unit and accumulator unit including a secondary battery or a high-capacity condenser.

15. An electronic timepiece comprising:

a time information generating unit for generating time information;

a function information generating unit for generating function information;

a warning information generating unit for generating warning information for prompting a predetermined warning;

a display unit capable of alternatively displaying said time information and/or the function information and/or the warning information;

a power-saving operation unit for operating the electronic timepiece in a power- saving operation state entailing lower power consumption than in a normal operation state;

a preferential operation selecting unit for controlling operating order of said function information unit, said warning information generating unit and said power saving operation unit such that generation of warning information occurs before generation of function information and before power saving operation, and generation of function information occurs before power saving operation; and means for providing power from a power source unit to the components of electronic timepiece requiring power.

16. The electronic timepiece according to claim 15, wherein the display of warning information by said warning information generating unit is given priority over the operation of said function information generating unit and the operation of said power-saving unit.

17. The electronic timepiece according to claim 16, wherein said function information generating unit or said power-saving unit is not operated even if conditions for the operation of said function information generating unit or said power-saving unit are met during the display of said warning information.

18. The electronic timepiece according to claim 16, wherein the operation of said function information generating unit or the operation of said power-saving unit is stopped and said warning information generating unit is operated to display the warning information if conditions for the operation of said warning information generating unit are met during the operation of said function information generating unit or during the operation of said power-saving unit.

19. The electronic timepiece according to claim 15, wherein display unit for displaying the function of said function information generating unit when the same is operated or display unit for stopping the display when said power-saving unit is operated and display unit for displaying the warning information when said warning information generating unit is operated are configured to be duplicate at least partially.

20. The electronic timepiece according to claim 15, wherein said warning information is any one of time adjustment warning information for warning of wrong time indication when the electronic timepiece temporarily was undercharged and stopped is restarted by recharge, charge warning information for prompting charge, and residue warning information for the accumulator unit.

21. A control method for an electronic timepiece which includes time information generating unit for generating time information, warning information generating unit for generating warning information for prompting a predetermined warning, function information generating unit for generating function information, display unit capable of alternatively displaying said time information and/or the function information and/or the warning information, power-saving operation unit for operating the electronic timepiece in a power-saving operation state entailing lower power consumption than in a normal operation state, and means for providing power from a power source unit to the components of the electronic timepiece requiring power said method comprising preferentially operating said warning information generating unit, rather than the function information unit, under a condition where said function information generating unit should be operated prior to said power saving operation unit.

22. The control method for an electronic timepiece according to claim 21, wherein said preferential operation is selected in accordance with the output voltage and/or output current of the power source unit.

23. The control method for an electronic timepiece according to claim 21, wherein said preferential operation is selected at the request of a user.

24. A control method for an electronic timepiece which includes reference signal generating unit, general information generating unit for generating general information including time information or function information in response to a reference signal from said reference signal generating unit, warning information generating unit for generating warning information for prompting a predetermined warning, display drive unit for outputting a drive signal for displaying said warning information and said general information, and display unit for displaying said general information and said warning information in response to the drive signal from said display drive unit, and can assume a power-saving state entailing lower power consumption than in a normal operation state, said method comprising controlling the electronic timepiece such that the display of the warning information by operating said warning information generating unit is given priority over the operation of said power-saving operation unit.

25. A control method for an electronic timepiece which includes reference signal generating unit, general information generating unit for generating general information including time information or function information in response to a reference signal from said reference signal generating unit, warning information generating unit for generating warning information for prompting a predetermined warning, display drive unit for outputting a drive signal for displaying said warning information and said general information, and display unit for displaying said general information and said warning information in response to the drive signal from said display drive unit, and can assume a power-saving state entailing lower power consumption than in a normal operation state, said method comprising controlling the electronic timepiece such that said power-saving state is not established even if conditions for the establishment of the power-saving state are met during the display of the warning information by said warning information generating unit.

26. A control method for an electronic timepiece which includes reference signal generating unit, general information generating unit for generating general information including time information or function information in response to a reference signal from said reference signal generating unit, warning information generating unit for generating warning information for prompting a predetermined warning, display drive unit for outputting a drive signal for displaying said warning information and said general information, and display unit for displaying said general information and said warning information in response to the drive signal from said display drive unit, and can assume a power-saving state entailing lower power consumption than in a normal operation state, said method comprising controlling the electronic timepiece such that said power-saving state is canceled to establish a display state for the warning information if conditions for the operation of said warning information generating unit are met during said power-saving state.

27. An electronic timepiece comprising:

a non-time information generating unit for generating time information;

an information generating unit for generating other information other than the time information;

a display unit capable of alternatively displaying said time information and/or the other information;

a power-saving operation unit for operating the electronic timepiece in a power-saving operation state entailing lower power consumption than in a normal operation state; and a preferential operation selecting unit for changing priority sequence between said non time information generating unit and said power saving operation unit according to an outside operation or a predetermined condition, wherein said individual unit is driven by a power source unit.

28. An electronic timepiece comprising:

a non-time information generating unit for generating time information;

an information generating unit for generating other information other than the a time information and power source information;

a display unit capable of alternatively displaying said time information and/or the other information;

a power-saving operation unit for operating the electronic timepiece in a power-saving operation state entailing lower power consumption than in a normal operation state; and a preferential operation selecting unit for changing priority sequence between said non-time information generating unit and said power saving operation unit according to an outside operation or a predetermined condition.

29. An electronic timepiece comprising:

a time information generating unit for generating time information;

a function information generating unit for generating function information;

warning information generating unit for generating warning information for prompting a predetermined warning;

a display unit capable of alternatively displaying said time information and/or the function information and/or the warning information;

a power-saving operation unit for operating the electronic timepiece in a power-saving operation state entailing lower power consumption than in a normal operation state; and a preferential operation selecting unit for preferentially operating said function information generating unit and/or the warning information generating unit, or said power-saving operation unit according to an outside operation.

30. An electronic timepiece comprising:

a time information generating unit for generating time information;

a function information generating unit for generating function information other than time information and power source information;

a warning information generating unit for generating warning information for prompting a predetermined warning;

a display unit capable of alternatively displaying said time information and/or the function information and/or the warning information;

a power-saving operation unit for operating the electronic timepiece in a power-saving operation state entailing lower power consumption than in a normal operation state; and a preferential operation selecting unit for preferentially operating said function information generating unit and/or the warning information generating unit, or said power-saving operation unit according to circumstances.

31. An electronic timepiece comprising:

a time information generating unit for generating time information;

a function information generating unit for generating function information;

a warning information generating unit for generating warning information for prompting a predetermined warning;

a display unit capable of alternatively displaying said time information and/or the function information and/or the warning information;

a power-saving operating unit for operating the electronic timepiece in a power-saving operation state entailing lower power consumption than in a normal operation state; and a preferential operation selecting unit for preferentially displaying the warning information by said warning information generating unit, prior to the operation of said function information generating unit and the operation of said power-saving operating unit, wherein said individual unit is driven by a power source unit.

* * * * *